United States Patent [19]

Saitoh et al.

[11] Patent Number: 4,705,731

[45] Date of Patent: Nov. 10, 1987

[54] MEMBER HAVING SUBSTRATE WITH PROTRUDING SURFACE LIGHT RECEIVING LAYER OF AMORPHOUS SILICON AND SURFACE REFLECTIVE LAYER

[75] Inventors: Keishi Saitoh, Ibaraki; Tetsuo Sueda, Chofu; Kyosuke Ogawa, Tokyo; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 740,901

[22] Filed: Jun. 3, 1985

[30] Foreign Application Priority Data

| | | | |
|---|---|---|---|
| Jun. 5, 1984 | [JP] | Japan | 59-113850 |
| Jun. 6, 1984 | [JP] | Japan | 59-115748 |
| Oct. 31, 1984 | [JP] | Japan | 59-227895 |
| Nov. 1, 1984 | [JP] | Japan | 59-228992 |
| Nov. 2, 1984 | [JP] | Japan | 59-230354 |
| Nov. 5, 1984 | [JP] | Japan | 59-231244 |
| Nov. 6, 1984 | [JP] | Japan | 59-232357 |
| Nov. 7, 1984 | [JP] | Japan | 59-233280 |

[51] Int. Cl.[4] ..... G03G 5/085

[52] U.S. Cl. ..... 430/57; 430/69; 430/84

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,671 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate having a large number of protruding portions on a surface thereof, each of said protruding portions having at a predetermined cut position a sectional shape comprising a main projection and a subprojection, the main projection and the subprojection overlapping each other, and a light-receiving layer with a multi-layer structure having a first layer comprising an amorphous material containing silicon atoms and germanium atoms, a second layer comprising an amorphous material containing silicon atoms and exhibiting photoconductivity, and a surface layer having the reflection preventive function provided successively from the substrate side, said light-receiving layer containing at least one selected from oxygen atoms, carbon atoms and nitrogen atoms.

63 Claims, 82 Drawing Figures

(A)

(B)

(C)

MEMBER HAVING SUBSTRATE WITH PROTRUDING SURFACE LIGHT RECEIVING LAYER OF AMORPHOUS SILICON AND SURFACE REFLECTIVE LAYER

CROSS-REFERENCE TO RELATED APPLICATIONS

This application contains subject matter related to commonly assigned, copending applications Ser. Nos. 697,141; 699,868; 705,516; 709,888; 720,011; 717,821; 786,970; 725,751; 726,768; 719,980; 739,867; 740,714; 741,300; 735,048; 752,920 and 753,011.

BACKGROUND OF THE INVENTION

1. Field of the Invention:

This invention relates to a light-receiving member having sensitivity to electromagnetic waves such as light [herein used in a broad sense, including ultraviolet rays, visible light, infrared rays, X-rays and gamma-rays]. More particularly, it pertains to a light receiving member suitable for using a coherent light such as laser beam.

2. Description of the Prior Art

As the method for recording a digital image information as an image, there have been well known the methods in which an electrostatic latent image is formed by scanning optically a light receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light receiving member for electrophotography which is suitable when using a semiconductor laser, an amorphous material containing silicon atoms (hereinafter written briefly as "A-Si") as disclosed in Japanese Laid-open patent application Nos. 86341/1979 and 83746/1981 is attracting attention for its high Vickers hardness and non-polluting properties in social aspect in addition to the advantage of being by far superior in matching in its photosensitive region as compared with other kinds of light receiving members.

However, when the photosensitive layer is made of a single A-Si layer, for ensuring dark resistance of $10^{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light receiving member is considerably limited.

As attempts to enlarge this tolerance in designing, namely to enable effective utilization of its high photosensitivity in spite of somewhat lower dark resistance, there have been proposed a light receiving layer with a multi-layer structure of two or more laminated layers with different conductivity characteristics with formation of a depletion layer within the light receiving layer, as disclosed in Japanese Laid-open patent application Nos. 121743/1979, 4053/1982 and 4172/1982, or a light-receiving member with a multi-layer structure in which a barrier layer is provided between the substrate and the photosensitive layer and/or on the upper surface of the photosensitive layer, thereby enhancing apparent dark resistance of the light receiving layer as a whole, as disclosed in Japanese Laid-open patent application Nos. 52178/1982, 52179/1982, 52180/1982, 58159/1982, 58160/1982 and 58161/1982.

According to such proposals, A-Si type light receiving members have been greatly advanced in tolerance in designing of commercialization thereof or easiness in management of its production and productivity, and the speed of development toward commercialization is now further accelerated.

When carrying out laser recording by use of such a light receiving member having a light receiving layer of a multi-layer structure, due to irregularity in thickness of respective layers, and also because of the laser beam which is an coherent monochromatic light, it is possible that the respective reflected lights reflected from the free surface on the laser irradiation side of the light receiving layer and the layer interface between the respective layers constituting the light receiving layer and between the substrate and the light receiving layer (hereinafter "interface" is used to mean comprehensively both the free surface and the layer interface) may undergo interference.

Such an interference phenomenon results in the so-called interference fringe pattern in the visible image formed and causes a poor iamge. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light receiving layer of a light receiving member, a reflected light $R_1$ from the upper interface 102 and a reflected light $R_2$ reflected from the lower interface 101.

Now, the average layer thickness of the layer is defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$(m is an integer, reflected lights are strengthened with each other) and $2nd=m\lambda(m+\frac{1}{2})\lambda$(m is an integer, reflected lights are weakened with each other) the reflected lights $R_1$ and $R_2$ conform.

In the light receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500 Å–±10000 Å, thereby forming a light scattering surface (as disclosed in Japanese Laid-open patent application No. 162975/1983); to provide a light absorbing layer by subjecting the aluminum substrate surface to black Alumite treatment or dispersing carbon, color pigment or dye in a resin (as disclosed in Japanese Laid-open patent application No. 165845/1982); and to provide a light scattering reflection preventive layer on the substrate surface by subjecting the aluminum substrate surface to satin-like Alumite treatment or by providing a sandy pine unevenness by sand blast (as disclosed in Japanese Laid-open patent application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficinent for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Besides, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light receiving layer 302 to become a reflected light $R_1$, with the remainder progressing internally through the light receiving layer 302 to become a transmitted light $I_1$. The transmitted light $I_1$ is partly scattered on the surface of the substrate 301 to become scattered lights $K_1$, $K_2$, $K_3 \ldots K_n$, with the remainder being regularly reflected to become a reflected light $R_2$, a part of which goes outside as an emitted light $R_3$. Thus, since the reflected light $R_1$ and the emitted light $R_3$ which is an interferable component rain, it is not yet possible to extinguish the interference fringe pattern.

On the other hand, if diffusibility of the surface of the substrate 301 is increased in order to prevent multiple reflections within the light receiving layer 302 through prevention of interference, light will be diffused used within the light receiving layer 302 to cause halation, whereby resolution is disadvantageously lowered.

Particularly, in a light receiving member of a multi-layer structure, as shown in FIG. 4, even if the surface of the substrate 401 may be irregularly roughened, the reflected light $R_2$ from the first layer 402, the reflected light $R_1$ from the second layer 403 and the regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light receiving layer 502.

Accordingly, for the incident light on that portion, $2nd_1=m\lambda$ or $2nd_1=(m+\frac{1}{2})\lambda$ holds, to make it a light portion or a dark portion. Also, in the light receiving layer as a whole, since there is nonuniformity in which the maximum difference among the layer thicknesses $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light receiving member of a single layer structure in FIG. 3, interferences by the reflected lights from the interfaces between the respective layers participate to make the extent of appearance of interferance fringe pattern more complicated than in the case of the light receiving member of a single layer structure.

SUMMARY OF THE INVENTION

An object of the present invention is to provide a novel light-receiving member sensitive to light, which has cancelled the drawbacks as described above.

Another object of the present invention is to provide a light-receiving member which is suitable for image formation by use of a coherent monochromatic light and also easy in production management.

Still another object of the present invention is to provide a light-receiving member which can cancel the interference fringe pattern appearing during image formation and appearance of speckles on reversal developing at the same time and completely.

Still another object of the prevent invention is to provide a light-receiving member which is high in dielectric strength and photosensitivity and excellent in electrophotographic characteristics.

It is also another object of the present invention to provide a light-receiving member, which can provide an image of high quality which is high in density, clear in halftone and high in resolution and is suitable for electrophotography.

According to one aspect of the present invention, there is provided a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer comprising a layer comprising an amorphous material containing silicon atoms, at least a part of the layer region of which has photosensitivity, and a surface layer having the reflection preventive function, said layer at least a part of the layer region of which has photosensitivity containing at least one selected from oxygen atoms, carbon atoms and nitrogen atoms.

According to another aspect of the present invention, there is provided a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer with a multi-layer structure having a first layer comprising an amorphous material containing silicon atoms and germanium atoms, a second layer comprising an amorphous material containing silicon atoms and exhibiting photoconductivity, and a surface layer having the reflection preventive function provided successively from the substrate side, said light-receiving layer containing at least one selected from oxygen atoms, carbon atoms and nitrogen atoms.

BRIEF DESCRIPTION OF THE DRAWINGS

FIG. 21, FIG. 64, FIG. 65, FIG. 80, FIG. 81 and FIG. 82 are schematic illustrations of the surface states of the aluminum substrates employed in Examples;

DESCRIPTION OF THE PREFERRED EMBODIMENTS

Referring now to the accompnaying drawings, the present invention is to be described in detail.

Figure 1:
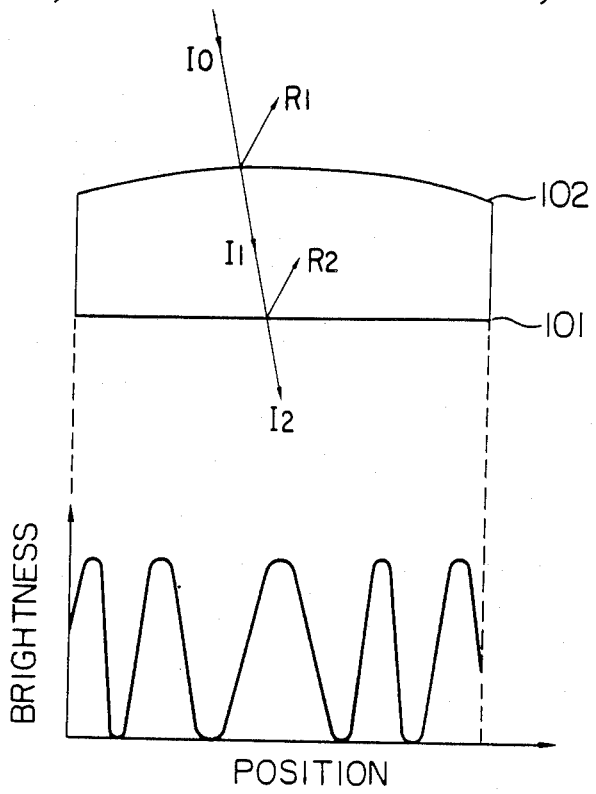
FIG. 1 is a schematic illustration of interference fringe in general.
Figure 2:
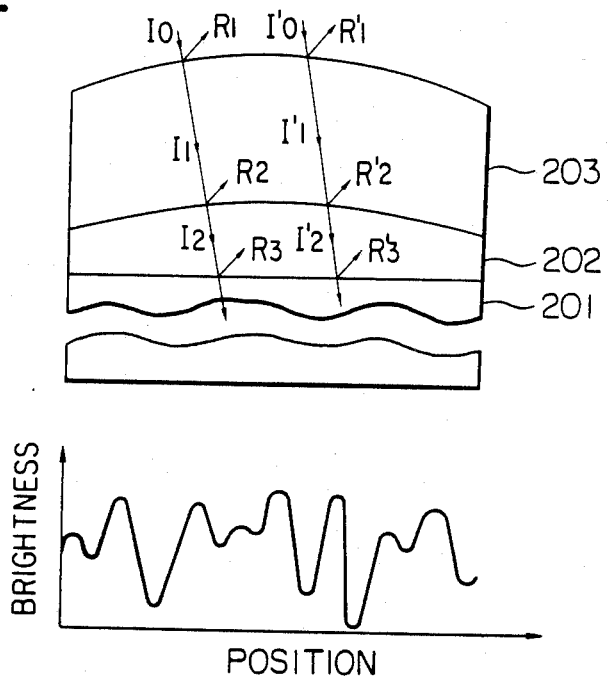
FIG. 2 is a schematic illustration of interference fringe in the case of a multi-layer light-receiving member.
Figure 3:
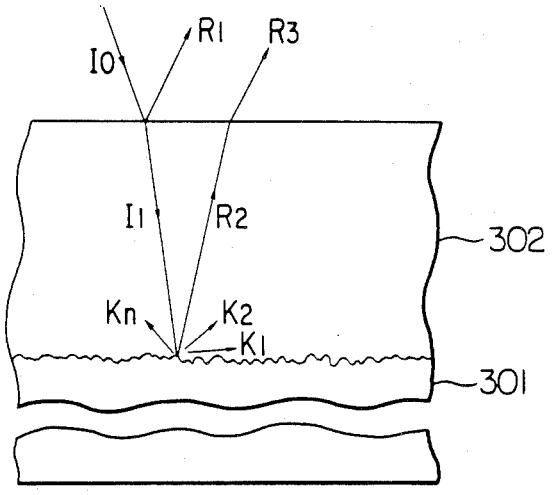
FIG. 3 is a schematic illustration of interference fringe by scattered light.
Figure 4:
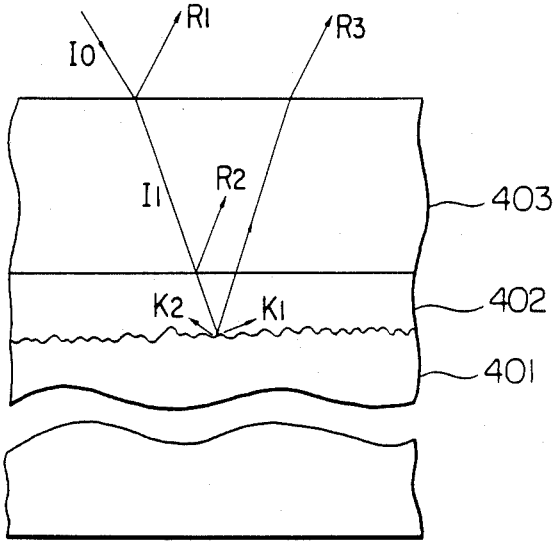
FIG. 4 is a schematic illustration of interference fringe by scattered light in the case of a multi-layer light-receiving member.
Figure 5:
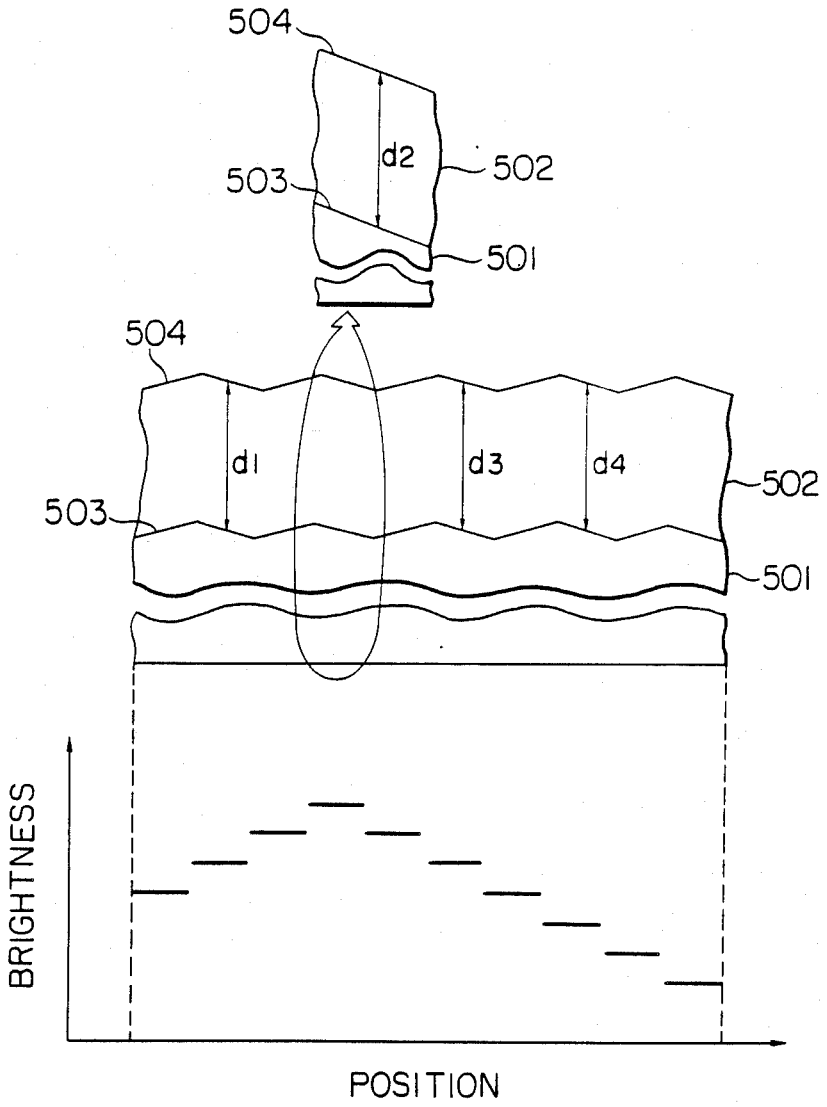
FIG. 5 is a schematic illustration of interference fringe in the case where the interfaces of respective layers of a light-receiving member are parallel to each other.
Figure 6:
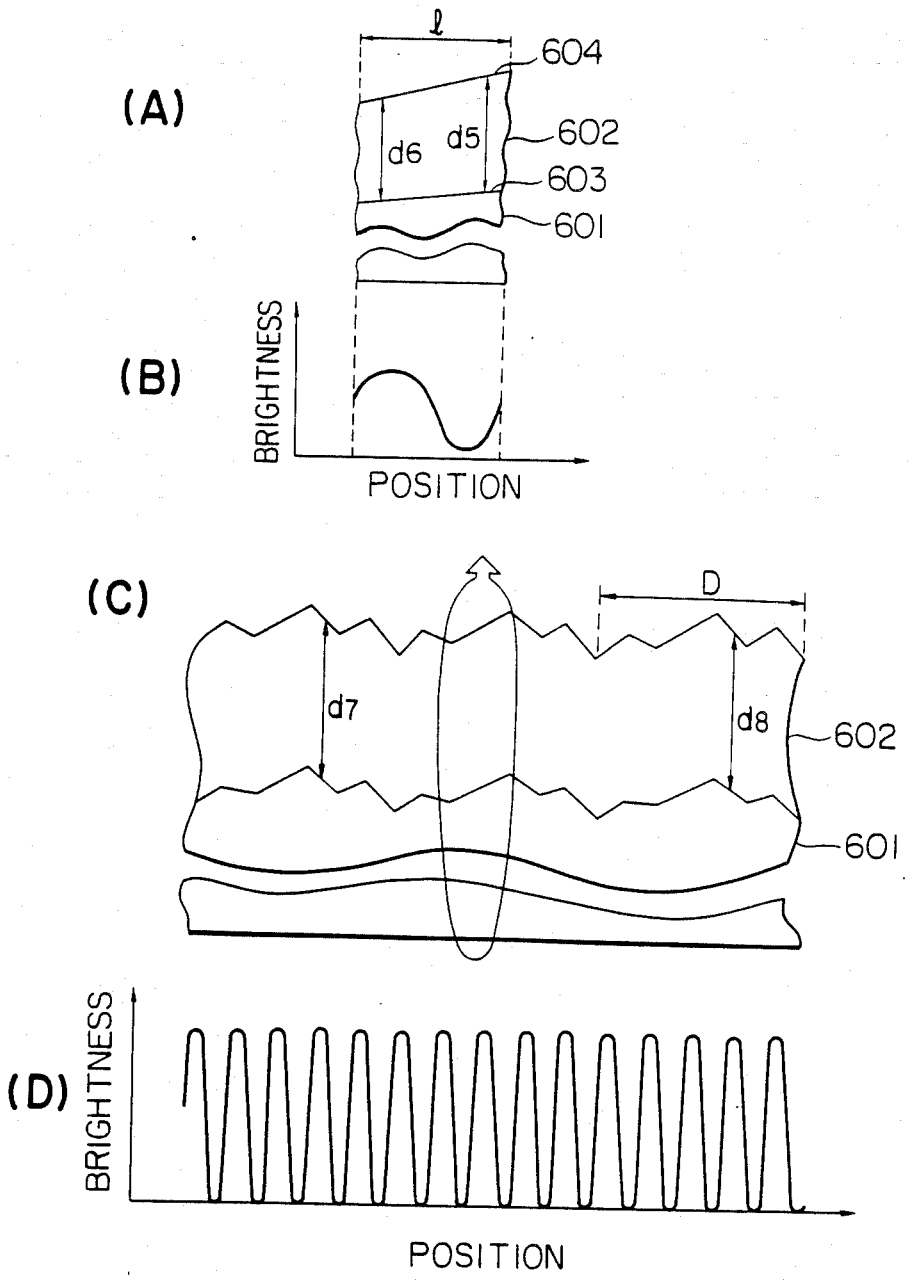
FIGS. 6 (A), (B), (C) and (D) are schematic illustrations of no appearance of interference fringe in the case of non-parallel interfaces between respective layers of a light-receiving member.

FIG. 6 is a schematic illustration for explanation of the basic principle of the present invention.

In the present invention, on a substrate (not shown) having a fine uneven shape smaller than the resolution required for the device, a light-receiving layer of a multi-layer constitution is provided along the uneven slanted plane, with the thickness of the second layer 602 being continuously changed from $d_5$ to $d_6$, as shown enlarged in a part of FIG. 6, and therefore the interface 603 and the interface 604 have respective gradients. Accordingly, the cohehent light incident on this minute portion (short range region ) l [indicated schematically in FIG. 6 (C), and its enlarged view shown in FIG. 6 (A)] undergoes interference at said minute portion l to form a minute interference fringe pattern.

Figure 7:
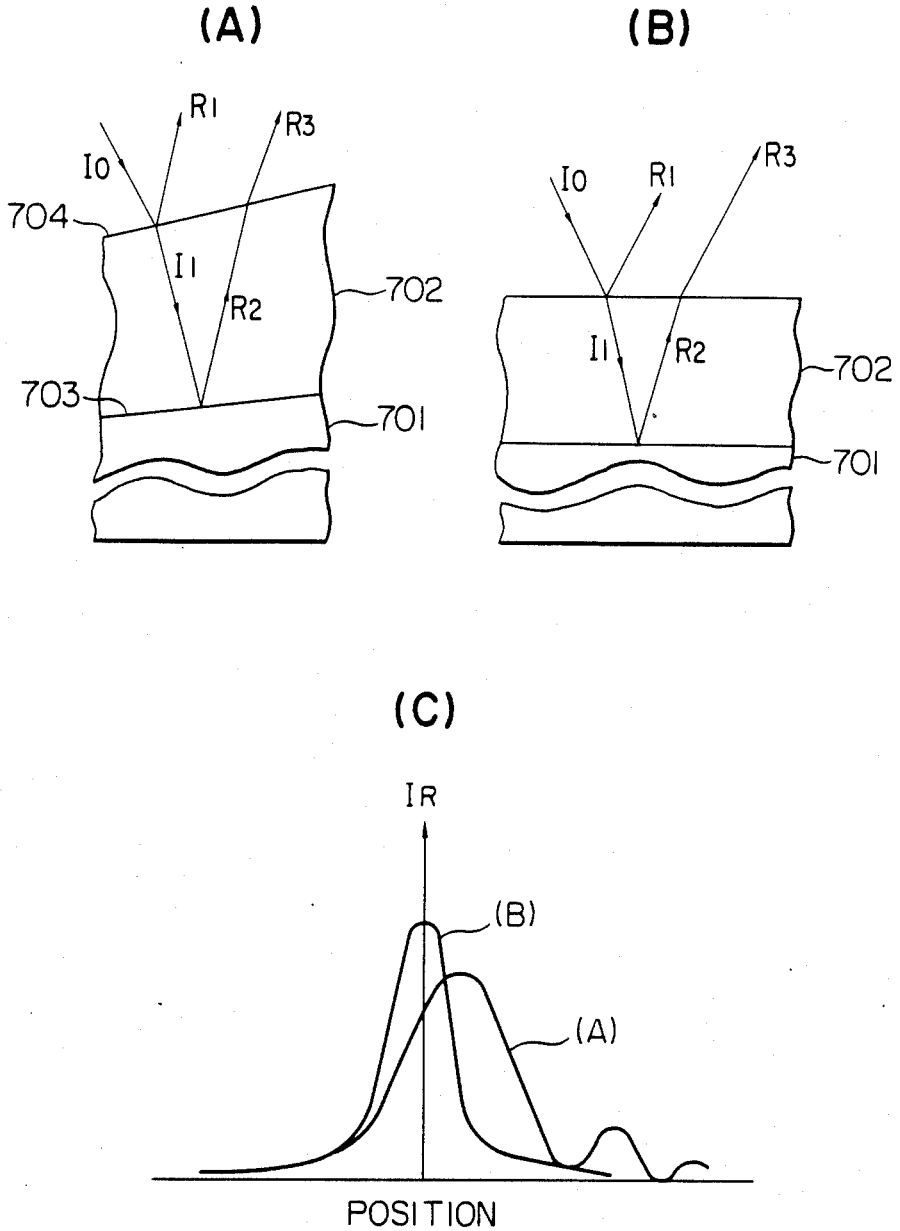
FIGS. 7 (A), (B) and (C) are schematic illustration of comparison of the reflected light intensity between the case of parallel interfaces and non-parallel interfaces beteeen the respective layers of a light-receiving member.

Also, as shown in FIG. 7, when the interface 703 between the first layer 701 and the second layer 702 and the free surface 704 are non-parallel to each other, the reflected light $R_1$ and the emitted light $R_3$ are different in direction of progress from each other relative to the incident light $I_0$ as shown in FIG. 7 (A), and therefore the degree of interference will be reduced as compared with the case (FIG. 7 (B)) when the interfaces 703 and 704 are parallel to each other.

Accordingly, as shown in FIG. 7 (C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6, even when the layer thickness of the layer 602 may be macroscopically ununiform ($d_7 \neq d_8$), and therefore the incident light quantity becomes uniform all over the layer region (see FIG. 6 (D)).

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exist in connection with the incident light $I_0$. Accordingly, at the respective layers, the same phenomenon as described with reference to FIG. 7 occurs.

Moreover, the interfaces between the respective layers at a minute portion function as a kind of slit, at which diffraction phenomenon will occur.

Accordingly, interference at respective layers appears as the effect of the product of interference due to difference in layer thickness and the interference due to difraction at the respective layer interfaces.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l \leqq L$, wherein L is the spot size of the irradiation light.

By such a designing, the diffraction effect at the ends of minute portions can positively be utilized, whereby appearance of interference fringe pattern can further be suppressed.

Further, in order to accomplish more effectively the objects of the present invention, the layer thickness difference $(d_5-d_6)$ at the minute portion l should desirably be as follows:

$d_5-d_6 \geqq \lambda/2n$ (where $\lambda$ is the wavelength of the irradiation light and n is the refractive index of the second layer 602) (See FIG. 6).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

For formation of the respective layers of the first layer and the second layer constituting the light-receiving layer, in order to accomplish more effectively and easily the objects of the present invention, the plasma chemical vapor deposition method (PCVD method), the optical CVD method and thermal CVD method can be employed, because the layer thickness can accurately be controlled on the optical level thereby As the method for working the substrate to accomplish the objects of the present invention, it is possible to utilize the chemical methods such as chemical etching, electric plating, etc., the physical methods such as vapor deposition, sputtering etc. and the mechanical methods such as lathe working, etc. However, the mechanical working method by lathe, etc. are preferred for easy production management. For example, a substrate may be worked with a lathe by fixing a bite having a V-shaped cutting blade at a predetermined position on a cutting working machine such as milling machine, lathe, etc, and cut working accurately the substrate surface by, for example, moving regularly in a certain direction while rotating a cylindrical substrate according to a program previously designed as desired, thereby forming to a desired unevenness shape, pitch and depth. The linear projection produced by the unevenness formed by such a cutting working has a spiral structure with the center axis of the cylindrical substrate as its center. The spiral structure of the projection may be made into a multiple spiral structure such as double or triple structure or a crossed spiral structure.

Alternatively, a straight line structure along the center axis may also be introduced in addition to the spiral structure.

Each of the protruding portions within a sectional shape at a predetermined cut position of the substrate of the present invention is preferred to have the same shape as the first order approximation at a predetermined section in order to enhance the effect of the invention and make the working control easy.

At a predetermined cut position, each of the protruding portions has a sectional shape comprising a main projection (main peak) and a subprojection (subpeak), the main projection and the subproject overlapping each other.

Figure 9:
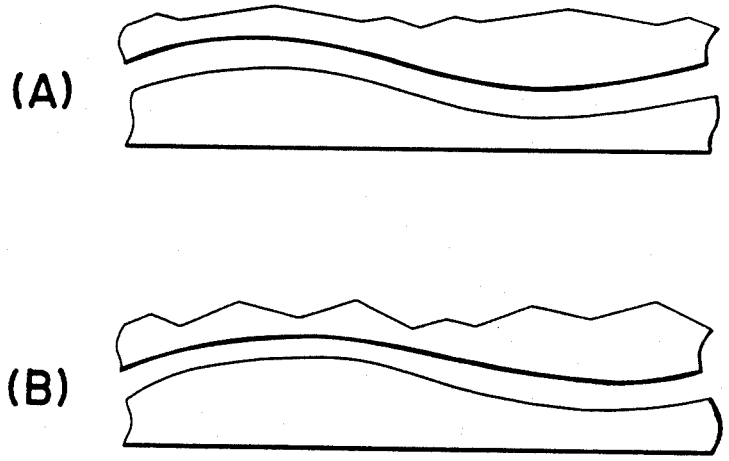
FIGS. 9 (A) and (B) are schematic illustrations of the surface condition of typical substrates.

Preferably, the above-mentioned protruding portions may be arranged regularly or periodically in order to enhance the effect of the invention. Further, the above-mentioned protruding portion, for further enhancing the effect of the invention and enhancing adhesion between the light-receiving layer and the substrate, may preferably have multiple subprojections which may overlap each other. In addition to these, for scattering with good efficiency the incident light in one direction, the above-mentioned protruding portion may preferably be united in symmetrically [FIG. 9(A)] or asymmetrically [FIG. 9(B)] with the main projection at its center. However, for enhancing the degree of freedom in management of substrate working, it is preferred that both exist mixed in the substrate.

In the case of a substrate such as one which is cylindrical and has an axis of symmetry and on which protruding portions of spiral structure are provided with the axis of symmetry as its center, the term "a predetermined cut position of a substrate" in the present invention refers to any plane including the axis of symmetry. Further, in the case of a substrate such as planar one having a plane, the above term refers to any plane crossing at least two of a large number of protruding portions formed on the substrate.

In the present invention, the respective dimensions of the unevenness provided on the substrate surface under managed condition are set so as to accomplish effectively the objects of the present invention in view of the following points.

More specifically, in the first place, the A-Si layer constituting the light receiving layer is sensitive to the structure of the surface on which the layer formation is effected, and the layer quality will be changed greatly depending on the surface condition.

Accordingly, it is desirable to set dimensions of the unevenness to be provided on the substrate surface so that lowering in layer quality of the A-Si layer may not be brought about.

Secondly, when there is extreme unevenness on the free surface of the light-receiving layer, cleaning cannot frequently be performed completely in cleaning step after image formation.

Further, in case of practicing blade cleaning, there is involved the problem that the blade will be damaged more earlier.

As the result of investigations of the problems is layer deposition as described above, problems in process of electrophotography and the conditions for prevention of interference fringe pattern, it has been found that the pitch at the recessed portion on the substrate surface should preferably be 500 μm to 0.3 μm, more preferably 200 μm to 1 μm, most preferably 50 μm to 5 μm.

It is also desirable that the maximum depth of the recessed portion should preferably be made 0.1 μm to 5 μm, more preferably 0.3 μm to 3 μm, most preferably 0.6 μm to 2 μm. When the pitch and the maximum depth of the recessed portions on the substrate surface are within the ranges as specified above, the gradient of the slanted plane at the recessed portion (or linear projection) may preferably be 1° to 20°, more preferably 3° to 15°, most preferably 4° to 10°.

On the other hand, the maximum of the difference in the layer thickness based on such an uniformness in layer thickness of the respective layers formed on such a substrate should preferably be made 0.1 μm to 2 μm within the same pitch, more preferably 0.1 μm to 1.5 μm, most preferably 0.2 μm to 1 μm.

The surface layer having the reflection preventive function may have a thickness which is determined as follows.

That is, when the refractive index of the surface layer is defined as a, and the wavelength of the light irradiated is as λ, the surface layer having the reflection preventing function should preferably have the thickness d as shown below:

$$d = \frac{\lambda}{4n} m \text{ (m is an odd number).}$$

Also, as the material for the surface layer, when the refractive index of the photosensitive layer on which the surface layer is to be deposited is defined as $n_a$, the material having the following refractive index may optimally be used:

$$n = \sqrt{n_a}$$

When such optical conditions are taken into consideration, the layer thickness of the reflection preventive layer should preferably be 0.05 to 2 μm, provided that the wavelength of the exposing light is within the wavelength region from near infrared to visible light.

In the present invention, the materials which can effectively be used for the surface layer having reflection preventive function may include, for example, inorganic fluorides, inorganic oxides or inorganic sulfur compounds such as $MgF_2$, $Al_2O_3$, $ZrO_2$, $TiO_2$, ZnS, $CeO_2$, $CeF_2$, $Ta_2O_5$, $AlF_3$, NaF and the like, or organic compounds such as polyvinyl chloride, polyamide resin, polyimide resin, vinylidene fluoride, melamine resin, epoxy resin, phenol resin, cellulose acetate, etc.

These materials may be formed into the surface layer according to the vapor deposition method, the sputtering method, the plasma chemical vapor deposition method (PCVD method), the optical CVD method, the thermal CVD method or the coating method, since these methods can control the layer thickness accurately on optical level in order to accomplish more effectively and easily the objects of the present invention.

Further, the light-receiving layer in the light-receiving member of the present invention has a multi-layer structure comprising a first layer constituted of an amorphous material containing silicon atoms and germanium atoms and a second layer constituted of an amorphous material containing silicon atoms and exhibiting photoconductivity provided on a substrate successively from the substrate side, and therefore can exhibit very excellent electrical, optical and photoconductive characteristics, dielectric strength as well as good use environmental characteristics.

In particular, when it is applied as a light-receiving member for electrophotography, there is no influence of residual potential on image formation at all, with its electrical properties being stable with high sensitivity and high SN ratio, also excellent in light fatigue resistance and repeated use characteristics, whereby it is possible to obtain repeatedly and stably images of high quality with high density, clear halftone and high resolution.

Further, the light-receiving member of the present invention is high in photosensitivity over the all visible light regions, particularly in photosensitivity to the light of longer wavelength region and is therefore excellent in matching to semiconductor laser and also rapid in light response.

Referring now the drawings, the light-receiving member of the present invention is to be described in detail.

Figure 10:
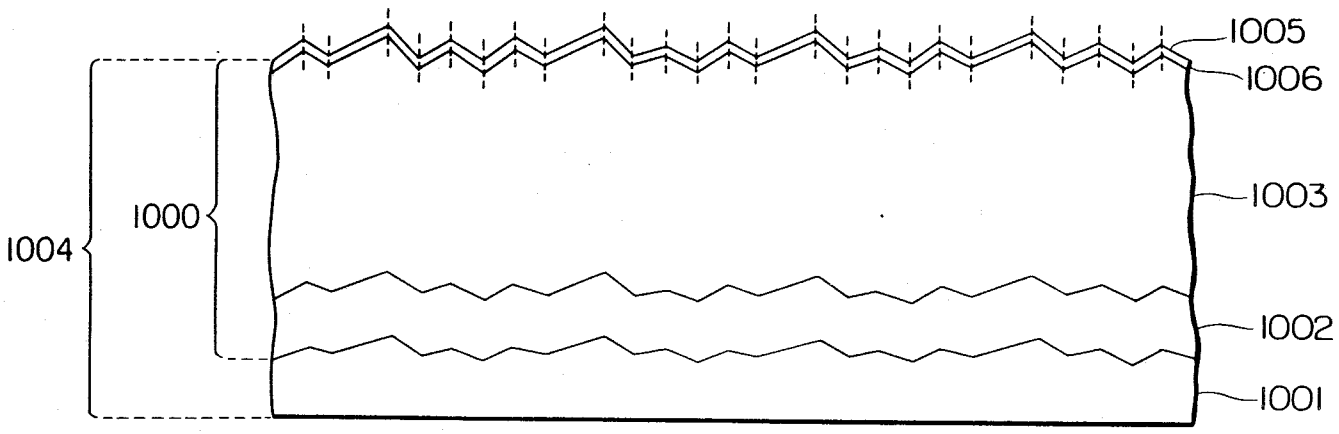
FIGS. 10 and 64 are respectively schematic illustrations of the layer constitution of a light-receiving member.

FIG. 10 is a schematic illustration of the constitution of the light-receiving member according to an embodiment of the present invention for the purpose of explanation of its layer constitution.

The light-receiving member 1004 shown in FIG. 10 has a light-receiving layer 1000 on a substrate 1001 for light-receiving member, the light-receiving layer 1000 having a free surface 1005 on one end surface.

The light-receiving layer 1000 has a layer constitution in which a first layer (G) 1002 constituted of a-Si containing germanium atoms and optionally hydrogen atoms and/or halogen atoms (X) (hereinafter abbreviated as "a-SiGe(H,X)"), a second layer (S) 1003 constituted of a-Si containing optionally hydrogen atoms and/or halogen atoms (X) (hereinafter abbreviated as "a-Si(H,X)") and having photoconductivity, and a surface layer 1006 having reflection preventive function are successively laminated from the substrate side 1001. In the present invention, in the light-receiving layer 1000, at least one selected from oxygen atoms, nitrogen atoms and carbon atoms are contained for the purpose as hereinafter described.

The germanium atoms contained in the first layer (G) 1002 may be contained so that the distribution state may be uniform within the first layer (G), or they can be contained continuously in the layer thickness direction in said first layer (G) 1002, being more enriched at the substrate 1001 side toward the side opposite to the side where said substrate 1001 is provided (the surface 1005 side of the light-receiving layer 1001).

When the distribution state of the germanium atoms contained in the first layer (G) is ununiform in the layer thickness direction, it is desirable that the distribution state should be made uniform in the interplanar direction in parallel to the surface of the substrate.

In the present invention, in the second layer (S) provided on the first layer (G), no germanium atoms is contained and by forming a light-receiving layer to such a layer structure, the light-receiving member obtained can be excellent in photosensitivity to the light with wavelengths of all the regions from relatively shorter wavelength to relatively longer wavelength, including visible light region.

Also, when the distribution state of germanium atoms in the first layer (G) is ununiform in the layer thickness direction, the germanium atoms are distributed continuously throughout the whole layer region while giving a change in distribution concentration C of the germanium atoms in the layer thickness direction which is decreased from the substrate toward the second layer (S), and therefore affinity between the first layer (G) and the second layer (S) is excellent. Also, as described as hereinafter, by extremely increasing the distribution concentration C of germanium atoms at the end portion on the substrate side extremely great, the light on the longer wavelength side which cannot substantially be absorbed by the second layer (S) can be absorbed in the first layer (G) substantially completely, when employing a semiconductor laser, whereby interference by reflection from the substrate surface can be prevented.

Also, in the light-receiving member of the present invention, the respective amorphous materials constituting the first layer (G) and the second layer (S) have the common constituent of silicon atoms, and therefore chemical stability can sufficiently be ensured at the laminated interface.

FIGS. 11 through 19 show typical examples of distribution in the layer thickness direction of germanium atoms contained in the first layer region (G) of the light-receiving member in the present invention.

In FIGS. 11 through 19, abscissa indicates the content C of germanium atoms and the ordinate the layer thickness of the first layer (G), $t_B$ showing the position of the end surface of the first layer (G) on the substrate side and $t_T$ the position of the end surface of the first layer (G) on the side opposite to the substrate side. That is, layer formation of the first layer (G) containing germanium atoms proceeds from the $t_B$ side toward the $t_T$ side.

Figure 11:
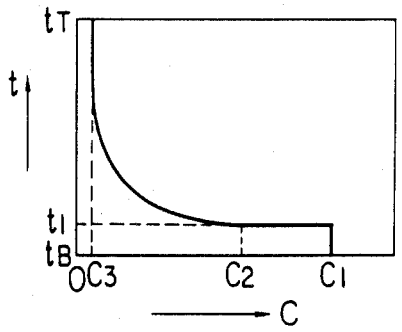
FIGS. 11 through 19 are schematic illustrations of the distribution states of germanium atoms in the first layer.

In FIG. 11, there is shown a first typical embodiment of the depth profile of germanium atoms in the layer thickness direction contained in the first layer (G).

In the embodiment as shown in FIG. 11, from the interface position $t_B$ at which the surface, on which the first layer (G) containing germanium atoms is to be formed, comes into contact with the surface of said first layer (G) to the position $t_1$, germanium atoms are contained in the first layer (G) formed, while the distribution concentration C of germanium atoms taking a constant value of $C_1$, the concentration being gradually decreased from the concentration $C_2$ continuously from the position $t_1$ to the interface position $t_T$. At the interface position $t_T$, the distribution concentration C of germanium atoms is made $C_3$.

Figure 12:
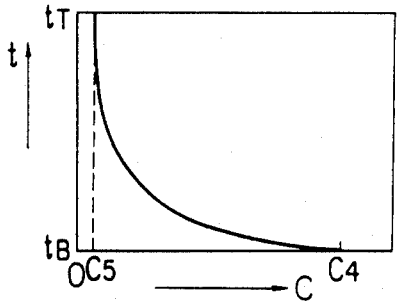

In the embodiment shown in FIG. 12, the distribution concentration C of germanium atoms contained is decreased gradually and continuously from the position $t_B$ to the position $t_T$ from the concentration $C_4$ until it becomes the concentration $C_5$ at the position $t_T$.

Figure 13:
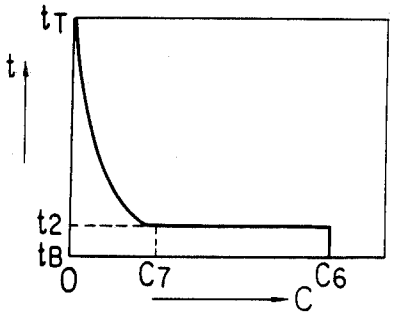

In case of FIG. 13, the distribution concentration C of germanium atoms is made constant as $C_6$ at the position $t_B$, gradually decreased continuously from the position $t_2$ to the position $t_T$, and the concentration C is made substantially zero at the position $t_T$ (substantially zero herein means the content less than the detectable limit).

Figure 14:
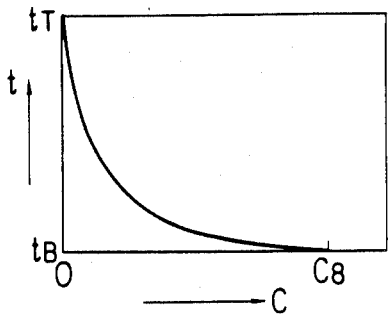

In case of FIG. 14, germanium atoms are decreased gradually and continuously from the position $t_B$ to the position $t_T$ from the concentration $C_8$, until it is made substantially zero at the position $t_T$.

Figure 15:
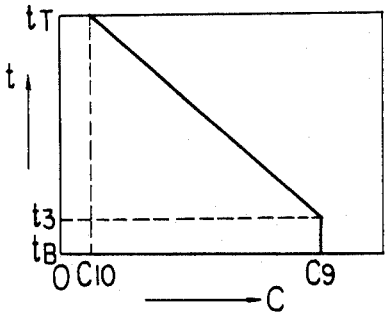

In the embodiment shown in FIG. 15, the distribution concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 16:
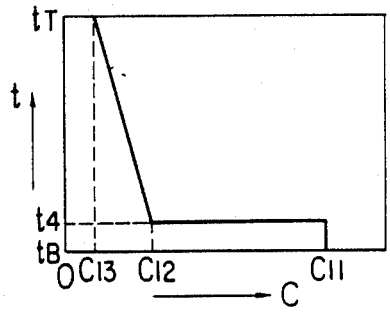

In the embodiment shown in FIG. 16, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 17:
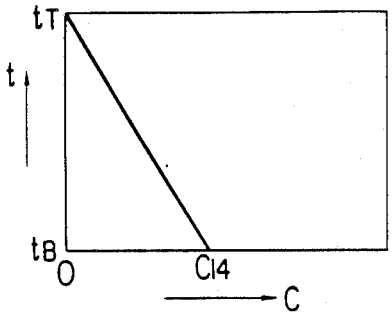

In the embodiment shown in FIG. 17, the distribution concentration C of germanium atoms is decreased as a first order function from the concentration $C_{14}$ to zero from the position $t_B$ to the position $t_T$.

Figure 18:
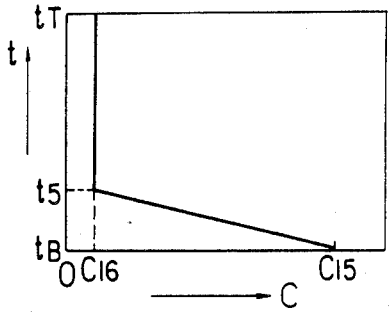

In FIG. 18, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 19:
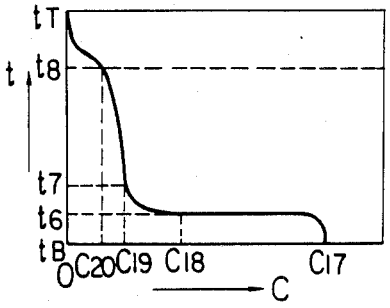

In the embodiment shown in FIG. 19, the distribution concentration C of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer (G) in the direction of the layer thickness by referring to FIGS. 11 through 19, when the distribution state of germanium atoms is ununiform in the layer thickness direction, the first layer (G) is provided desirably in a depth profile so as to have a portion enriched in distribution concentration C of germanium atoms on the substrate side and a portion depleted in distribution concentration C of germanium atoms considerably lower than that of the substrate side on the interface $t_T$ side.

The first layer (G) constituting the light-receiving member in the present invention is desired to have a localized region (A) containing germanium atoms at a relatively higher concentration on the substrate side as described above.

In the present invention, the localized region (A), as explained in terms of the symbols shown in FIG. 11 through FIG. 19, may be desirably provided within $5\mu$ from the interface position $t_B$.

In the present invention, the above localized region (A) may be made to be identical with the whole of the layer region ($L_T$) on the interface position $t_B$ to the thickness of $5\mu$, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentrations of germanium atoms in a distribution in the layer thickness direction may preferably be 1000 atomic ppm or more, more preferably 5000 atomic ppm or more, most preferably $1\times10^4$ atomic ppm or more based on silicon atoms.

That is, according to the present invention, it is desirable that the layer region (G) containing germanium atoms is formed so that the maximum value Cmax of the distribution concentration C may exist within a layer thickness of 5μ from the substrate side (the layer region within 5μ thickness from $t_B$).

In the present invention, the content of germanium atoms in the first layer (G), which may suitably be determined as desired so as to acheive effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the present invention, the layer thickness of the first layer (G) and the thickness of the second layer (S) are one of the important factors for accomplishing effectively the objects of the present invention, and therefore sufficient care should desirably be paid in designing of the light-receiving member so that desirable characteristics may be imparted to the light-receiving member formed.

In the present invention, the layer thickness $T_B$ of the first layer (G) may preferably be 30 Å to 50μ, more preferably 40 Å to 40 μ, most preferably 50 Å to 30μ.

On the other hand, the layer thickness T of the second layer (S) may be preferably 0.5 to 90μ, more preferably 1 to 80μ, most preferably 2 to 50μ.

The sum of the above layer thicknesses T and $T_B$, namely $(T+T_B)$ may be suitably determined as desired in designing of the layers of the light-receiving member, based on the mutual organic relationship between the characteristics required for both layer regions and the characteristics required for the whole light-receiving layer.

In the light-receiving member of the present invention, the numerical range for the above $(T_B+T)$ may generally be from 1 to 100μ, preferably 1 to 80μ, most preferably 2 to 50 μ.

In a more preferred embodiment of the present invention, it is preferred to select the numerical values for respective thicknesses $T_B$ and T as mentioned above so that the relation of $T_B/T\leqq1$ may be satisfied.

In selection of the numerical values for the thicknesses $T_B$ and T in the above case, the values of $T_B$ and T should preferably be determined so that the relation $T_B/T\leqq0.9$, most preferably, $T_B/T\leqq0.8$, may be satisfied.

In the present invention, when the content of germanium atoms in the first layer (G) is $1\times10^5$ atomic ppm or more, the layer thickness $T_B$ should desirably be made considerably thinner, preferably 30μ or less, more preferably 25μ or less, most preferably 20μ or less.

In the present invention, illustrative of halogen atoms (X), which may optionally be incorporated in the first layer (G) and the second layer (S) constituting the light-receiving layer, are fluorine, chlorine, bormine and iodine, particularly preferably fluorine and chlorine.

In the present invention, formation of the first layer (G) constituted of A-SiGe(H,X) may be conducted according to the vacuum deposition method utilizing discharging phenomenon, such as glow discharge method, sputtering method or ion-plating method. For example, for formation of the first layer (G) constituted of A-SiGe(H,X) according to the glow discharge method, the basic procedure comprises introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting layer formation on the surface of a substrate placed at a predetermined position while controlling the depth profile of germanium atoms according to a desired rate of change curve to form a layer constituent of A-SiGe (H,X). Alternatively, for formation according to the sputtering method, when carrying out sputtering by use of two sheets of targets of a target constituted of Si and a target constituted of Ge, or a target of a mixture of Si and Ge in an atmosphere of an inert gas such as Ar, He, etc. or a gas mixture based on these gases, a gas for introduction of hydrogen atoms (H) and/or a gas for introduction of halogen atoms (X) may be introduced, if desired, into a deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred because of easiness in handling during layer formation and high efficiency for supplying Si.

As the substances which can be used as the starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred because of easiness in handling during layer formation and high efficiency for supplying Ge.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light-receiving member of the present invention is formed according to the glow discharge method by emplovment of such a silicon compound containing halogen atoms, it is possible to form the first layer (G) constituted of A-SiGe containing halogen atoms on a desired substrate without use of a hydrogenated silicon gas as the starting gas capable of supplying Si together with the starting gas for Ge supply.

In the case of forming the first layer (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer (G) and exciting glow discharge to form a plasma atmosphere of these gases, whereby the first layer (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer (G) comprising A-SiGe(H,X) according to the reactive sputtering method or the ion plating method, for example, in the case of the sputtering method, two sheets of a target of Si and a target of Ge or a target of Si and Ge is employed and subjected to sputtering in a desired gas plasma atmosphere. In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the first layer (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $siH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing halogen atoms can preferably be used as the starting material for introduction of halogens, because hydrogen atoms, which are very effective for controlling electrical or photoelectric characteristics, can be introduced into the layer simultaneously with introduction of halogen atoms during formation of the first layer (G).

For introducing hydrogen atoms structurally into the first layer (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer (G) constituting the light-receiving layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer (S) constituted of A-Si(H,X), the starting materials (I) for formation of the first layer (G), from which the starting materials for the starting gas for supplying Ge are omitted, are used as the starting materials (II) for formation of the second layer (S), and layer formation can be effected following the same procedure and conditions as in formation of the first layer (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer (S) constituted of A-Si(H,X) according to the glow discharge method, the basic procedure comprises introducing a starting gas for Si supply capable of supplying silicon atoms (Si) as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X) may be introduced into a deposition chamber when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H+X) to be contained in the second layer (S) constituting the light-receiving layer to be formed should preferably be 1 to 40 atomic %, more preferably 5 to 30 atomic %, most preferably 5 to 25 atomic %.

In the light-receiving member 1004, by incorporating a substance (C) for controlling conductivity in at least the first layer (G) 1002 and/or the second layer (S) 1003, desired conductivity characteristics can be given to the layer containing said substance (C).

In this case, the substance (C) for controlling conductivity may be contained throughout the whole layer region in the layer containing the substance (C) or contained locally in a part of the layer region of the layer containing the substance (C).

Also, in the layer region (PN) containing said substance (C), the distribution state of said substance (C) in the layer thickness direction may be either uniform or nonuniform, but desirably be made uniform within the plane in parallel to the substrate surface. When the distribution state of the substance (C) is nonuniform in the layer thickness direction, and when the substance (C) is to be incorporated in the whole layer region of the first layer (G), said substance (C) is contained in the first layer (G) so that it may be more enriched on the substrate side of the first layer (G).

Thus, in the layer region (PN), when the distribution concentration in the layer thickness direction of the above substance (C) is made nonuniform, optical and electrical junction at the contacted interface with other layers can further be improved.

In the present invention, when the substance (C) for controlling conductivity is incorporated in the first layer (G) so as to be locally present in a part of the layer region, the layer region (PN) in which the substance (C) is to be contained is provided as an end portion layer region of the first layer (G), which is to be determined case by case suitably as desired depending on.

In the present invention, when the above substance (C) is to be incorporated in the second layer (S), it is desirable to incorporate the substance (C) in the layer region including at least the contacted interface with the first layer (G).

When the substance (C) for controlling conductivity is to be incorporated in both the first layer (G) and the second layer (S), it is desirable that the layer region containing the substance (C) in the first layer (G) and the layer region containing the substance (C) in the second layer (S) may contact each other.

Also, the above substance (C) contained in the first layer (G) may be either the same as or different from that contained in the second layer (S), and their contents may be either the same or different.

However, in the present invention, when the above substance (C) is of the same kind in the both layers, it is preferred to make the content in the first layer (G) sufficiently greater, or alternatively to incorporate substances (C) with different electrical characteristics in respective layers desired.

In the present invention, by incorporating a substance (C) for controlling conductivity in at least the first layer (G) and/or the second layer (S) constituting the light-receiving layer, conductivity of the layer region containing the substance (C) [which may be either a part or the whole of the layer region of the first layer (G) and/or the second layer (S)] can be controlled as desired. As a substance (C) for controlling conductivity characteristics, there may be mentioned so called impurities in the field of semiconductors. In the present invention, there may be included p-type impurities giving p-type condutivity characteristics and n-type impurities and/or giving n-type conductivity characteristics to A-Si(H,X) and/or A-SiGe(H,X) constituting the light receiving layer to be formed.

More specifically, there may be mentioned as p-type impurities atoms belonging to the group III of the periodic table (Group III atoms), such as B (boron), Al(aluminum), Ga(gallium), In(indium), Tl(thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) may be suitably be determined depending on the conductivity required for said layer region (PN), or when said layer region (PN) is provided in direct contact with the substrate, the organic relationships such as relation with the characteristics at the contacted interface with the substrate, etc.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably 1 to $5\times10^3$ atomic ppm.

In the present invention, by making the content of said substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance to be incorporated is a n-type impurity, migration of positive holes injected from the substrate side into the light-receiving layer may be effectively inhibited when the free surface of the light-receiving layer is subjected to the charging treatment to ⊖ polarity.

In the case as mentioned above, the layer region (Z) at the portion excluding the above layer region (PN) under the basic constitution of the present invention as described above may contain a substance for controlling conductivity of the other polarity, or a substance for controlling conductivity having characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other, thus providing a so called depletion layer at said contact region.

In short, for example, a layer containing the aforesaid p-type impurity and a layer region containing the aforesaid n-type impurity are provided in the light-receiving layer in direct contact with each other to form the so called p-n junction, whereby a depletion layer can be provided.

FIGS. 27 through 35 show typical examples of the depth profiles in the layer thickness direction of the substance (C) contained in the layer region (PN) in the light-receiving layer of the present invention. In each of these Figures, representations of layer thickness and concentration are shown in rather exaggerated forms for illustrative purpose; since the difference between respective Figures will be indistinct if represented by the real values as such, and it should be understood that these Figures are schematic in nature. As practical distribution, the values of ti ($1 \leqq i \leqq 9$) or Ci ($1 \leqq i \leqq 17$) should be chosen so as to obtain desired distribution concentration lines, or values obtained by multiplying the distribution curve as a whole with an appropriate coefficient should be used.

In FIGS. 27 through 35, the abscissa shows the distribution concentration C of the substance (C), and the ordinate the layer thickness of the layer region (PN), $t_B$ indicating the position of the end surface on the substrate side of the layer region (G) and $t_T$ the position of the end surface on the side opposite to the substrate side Thus, layer formation of the layer region (PN) containing the substance (C) proceeds from the $t_B$ side toward the $t_T$ side.

Figure 27:
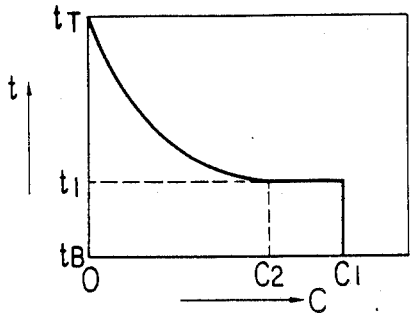
FIGS. 27 through 35 are schematic illlustrations of the distribution state of the substance (C) in the layer region (PN)

FIG. 27 shows a first typical example of the depth profile of the substance (C) in the layer thickness direction contained in the layer region (PN).

In the embodiment shown in FIG. 27, from the interface position $t_B$ where the surface at which the layer region (PN) containing the substance (C) contacts the surface of said layer (G) to the position $t_1$, the substance (C) is contained in the layer region (PN) formed while the distribution concentration C of the substance (C) taking a constant value of $C_1$, and the concentration is gradually decreased from the concentration $C_2$ continuously from the position $t_1$ to the interface position $t_T$. At the interface position $t_T$, the distribution concentration C of the substance (C) is made substantially zero (here substantially zero means the case of less than detectable limit).

Figure 28:
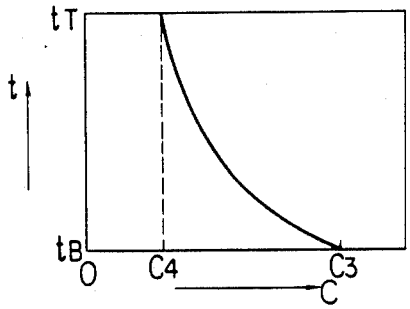

In the embodiment shown in FIG. 28, the distribution concentration C of the substance (C) contained is decreased from the position $t_B$ to the position $t_T$ gradually and continuously from the concentration $C_3$ to the concentration $C_4$ at $t_T$.

Figure 29:
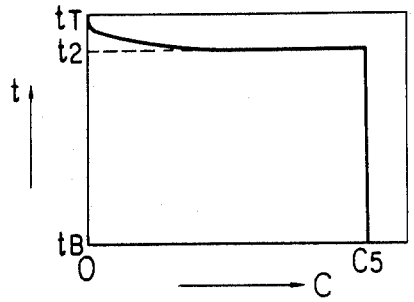

In the case of FIG. 29, from the position $t_B$ to the position $t_2$, the distribution concentration C of the substance (C) is made constantly at $C_5$, while between the position $t_2$ and the position $t_T$, it is gradually and continuously decreased, until the distribution concentration is made substantially zero at the position $t_T$.

Figure 30:
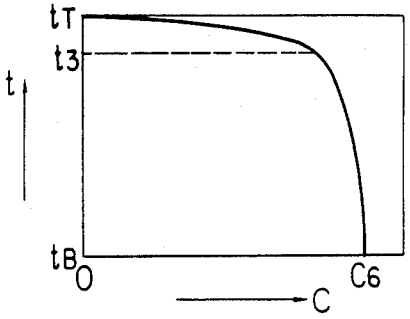

In the case of FIG. 30, the distribution concentration C of the substance (C) is first decreased continuously and gradually from the concentration $C_6$ from the position $t_B$ to the position $t_3$, from where it is abruptly decreased to substantially zero at the position $t_T$.

Figure 31:
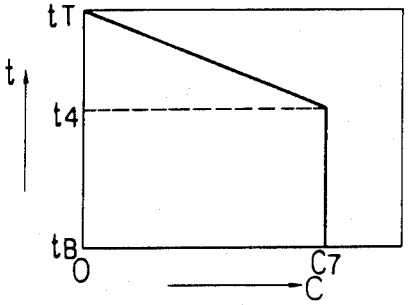

In the embodiment shown in FIG. 31, the distribution concentration of the substance (C) is constantly $C_7$ between the position $t_B$ and the position $t_T$, and the distribution concentration is made zero at the position $t_T$. Between the $t_4$ and the position $t_T$, the distribution concentration C is decreased as a first order function from the position $t_4$ to the position $t_T$.

Figure 32:
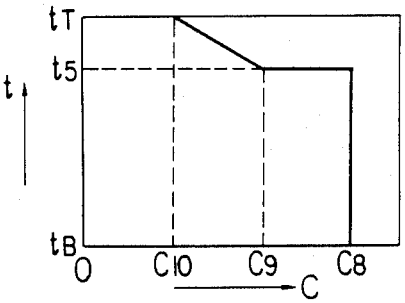

In the embodiment shown in FIG. 32, the distribution concentration C takes a constant value of $C_8$ from the position $t_B$ to the position $t_5$, while it was decreased as a first order function from the concentration $C_9$ to the concentration $C_{10}$ from the position $t_5$ to the position $t_T$.

Figure 33:
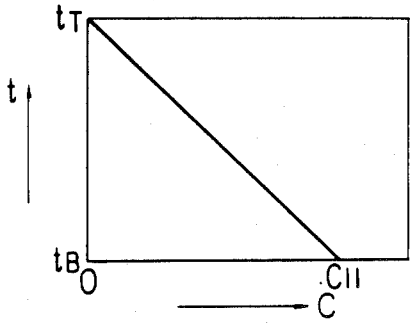

In the embodiment shown in FIG. 33, from the position $t_B$ to the position $t_T$, the distribution concentration C of the substance (C) is decreased continuously as a first order function from the concentration $C_{11}$ to zero.

Figure 34:
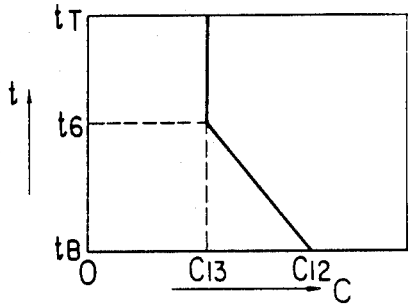

In FIG. 34, there is shown an embodiment, in which, from the position $t_B$ to the position $t_6$, the distribution concentration C of the substance C is decreased as a first order function from the concentration $C_{12}$ to the concentration $C_{13}$, and the concentration is made a constant value of $C_{13}$ between the position $t_6$ and the position $t_T$.

Figure 35:
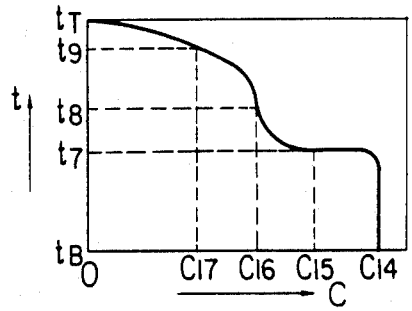

In the embodiment shown in FIG. 35, the distribution concentration C of the substance (C) is $C_{14}$ at the position $t_B$, which is gradually decreased initially from $C_{14}$ and then abruptly near the position $t_7$, where it is made $C_{15}$ at the position $t_7$.

Between the position $t_7$ and the position $t_8$, the concentration is initially abruptly decreased and then moderately gradually, until it becomes $C_{16}$ at the position $t_8$, and between the position $t_8$ and the position $t_9$, the concentration is gradually decreased to reach $C_{17}$ at the position $t_9$. Between the position $t_9$ and the position $t_T$, the concentration is decreased from $C_{17}$, following the curve with a shape as shown in Figure, to substantially zero.

As described above by referring to some typical examples of depth profiles in the layer thickness direction of the substance (C) contained in the layer region (PN) shown FIGS. 27 through 35, it is desirable in the present invention that a depth profile of the substance (C) should be provided in the layer region (PN) so as tc have a portion with relatively higher distribution concentration C of the substance (C) on the substrate side, while having a portion on the interface $t_T$ side where said distribution concentration is made considerably lower as compared with the substrate side.

The layer region (PN) constituting the light-receiving member in the present invention is desired to have a localized region (B) containing the substance (C) preferably at a relatively higher concentration on the substrate side as described above.

In the present invention, the localized region (B) as explained in terms of the symbols shown in FIGS. 27 through 35, may be desirably provided within 5μ from the interface position $t_B$.

In the present invention, the above localized region (B) may be made to be identical with the whole of the layer region (L) from the interface position $t_B$ to the thickness of 5μ, or alternatively a part of the layer region (L).

It may suitably be determined depending on the characteristics required for the light-receiving layer to be formed whether the localized region (B) should be made a part or the whole of the layer region (L).

For formation of the layer region (PN) containing the aforesaid substance (C) by incorporating a substance (C) for controlling conductivity such as the group III atoms or the group V atoms structurally into the light-receiving layer, a starting material for introduction of the group III atoms or a starting material for introduction of the group V atoms may be introduced under gaseous state into a deposition chamber together with other starting materials for formation of the respective layers during layer formation.

As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, SbCl, $BiH_3$, $BiCl_3$, $BiBr_3$ and the like effectively as the starting material for introduction of the group V atoms.

In the light-receiving member of the present invention, for the purpose of obtaining higher photosensitivity and dark resistance, and further for the purpose of improving adhesion between the substrate and the light-receiving layer, at least one kind of atoms selected from oxygen atoms, carbon atoms and nitrogen atoms is contained in the light-receiving layer in either uniform or ununiform distribution state in the layer thickness direction. Such atoms (OCN) to be contained in the light-receiving layer may be contained therein throughout the whole layer region of the light-receiving layer or localized by being contained in a part of the layer region of the light-receiving layer.

The distribution concentration C (OCN) of the atoms (OCN) should desirably be uniform within the plane parallel to the surface of the substrate.

In the present invention, the layer region (OCN) where atoms (OCN) are contained is provided so as to occupy the whole layer region of the light-receiving layer when it is primarily intended to improve photosensitivity and dark resistance, while it is provided so as to occupy the end portion layer region on the substrate side of the light-receving layer when it is primarily intended to strengthen adhesion between the substrate and the light-receiving layer.

In the former case, the content of atoms (OCN) contained in the layer region (OCN) should desirably be made relatively smaller in order to maintain high photosensitivity, while in the latter case relatively larger in order to ensure reinforcement of adhesion to the substrate.

In the present invention, the content of the atoms (OCN) to be contained in the layer region (OCN) provided in the light-receiving layer can be selected suitably in organic relationship with the characteristics required for the layer region (OCN) itself, or with the characteristic at the contacted interface with the substrate when the said layer region (OCN) is provided in direct contact with the substrate, etc.

When other layer regions are to be provided in direct contact with the layer region (OCN), the content of the atoms (OCN) may suitably be selected with due considerations about the characteristics of said other layer regions or the characteristics at the contacted interface with said other layer regions.

The amount of the atoms (OCN) contained in the layer region (OCN) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (OCN) occupies the whole region of the light-receiving layer or, although not occupying the whole region, the proportion of the layer thickness $T_O$ of the layer region (OCN) occupied in the layer thickness T of the light-receiving layer is sufficiently large, the upper limit of the content of the atoms (OCN) contained in the layer region (OCN) should desirably be made sufficiently smaller than the value as specified above.

In the case of the present invention, when the proportion of the layer thickness $T_O$ of the layer region (OCN) occupied relative to the layer thickness T of the light-receiving layer is 2/5 or higher, the upper limit of the atoms (OCN) contained in the layer region (OCN) should desirably be made 30 atomc % or less, more preferably 20 atomic % or less, most preferably 10 atomic % or less.

According to a preferred embodiment of the present invention, it is desirable that the atoms (OCN) should be contained in at least the above first layer to be provided directly on the substrate. In short, by incorporating the atoms (OCN) at the end portion layer region on the substrate side in the light-receiving layer, it is possible to effect reinforcement of adhesion between the substrate and the light-receiving layer.

Further, in the case of nitrogen atoms, for example, under the co-presence with boron atoms, improvement of dark resistance and improvement of photosensitivity can further be ensured, and therefore they should preferably be contained in a desired amount in the light-receiving layer.

Plural kinds of these atoms (OCN) may also be contained in the light-receiving layer. For example, oxygen atoms may be contained in the first layer, nitrogen atoms in the second layer, or alternatively oxygen atoms and nitrogen atoms may be permitted to be co-present in the same layer region.

FIGS. 43 through 51 show typical examples of ununiform depth profiles in the layer thickness direction of the atoms (OCN) contained in the layer region (OCN) in the light-receiving member of the present invention.

In FIGS. 43 through 51, the abscissa indicates the distribution concentration C of the atoms (OCN), and the ordinate the layer thickness of the layer region (OCN), $t_B$ showing the position of the end surface of the layer region on the substrate side, while $t_T$ shows the position of the end face of the layer region (OCN) opposite to the substrate side. Thus, layer formation of the layer region (OCN) containing the atoms (OCN) proceeds from the $t_B$ side toward the $t_T$ side.

Figure 43:
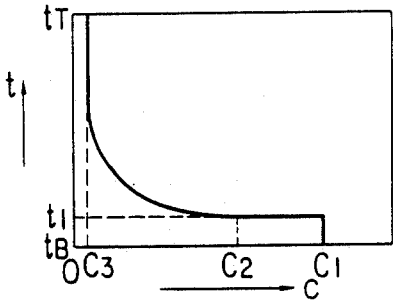
FIGS. 43 through 51 are schematic illustrations of the distribution states of the atoms (OCN) in the layer region (OCN).

FIG. 43 shows a first typical embodiment of the depth profile in the layer thickness direction of the atoms (OCN) contained in the layer region (OCN).

In the embodiment shown in FIG. 43, from the interface position $t_B$ where the surface on which the layer region (OCN) containing the atoms (OCN) is formed contacts the surface of said layer region (OCN) to the position of $t_1$, the atoms (OCN) are contained in the layer region (OCN) to be formed while the distribution concentration of the atoms (OCN) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 44:
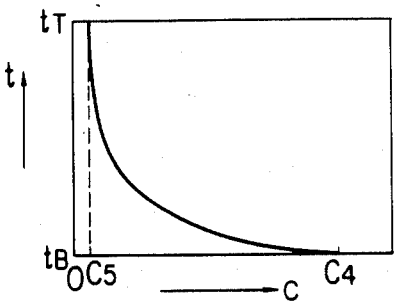

In the embodiment shown in FIG. 44, the distribution concentration C of the atoms (OCN) contained is reduced gradually continuously from the concentration $C_4$ from the position $t_B$ to the position $t_T$, at which it becomes the concentration $C_5$.

Figure 45:
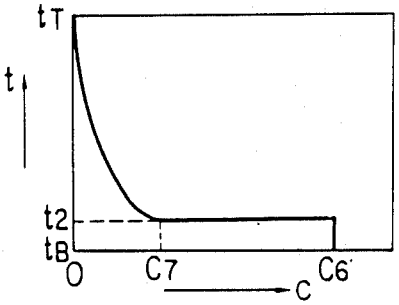

In the case of FIG. 45, from the position $t_B$ to the position $t_2$, the distribution concentration of the atoms (OCN) is made constantly at $C_6$, reduced gradually continuously from the concentration $C_7$ between the position $t_2$ and the position $t_T$, until at the position $t_T$, the distribution concentration C is made substantially zero (here substantially zero means the case of less than the detectable level).

Figure 46:
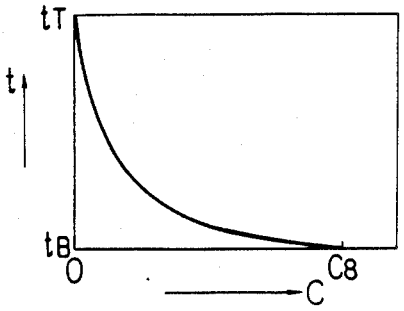

In the case of FIG. 46, the distribution concentration C of the atoms (OCN) is reduced gradually continuously from the concentration $C_8$ from the position $t_B$ up to the position $t_T$, to be made substantially zero at the position $t_T$.

Figure 47:
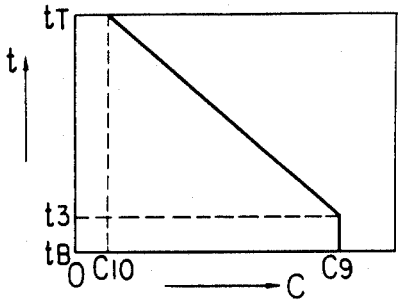

In the embodiment shown in FIG. 47, the distribution concentration C of the atoms (OCN) is made constantly $C_9$ between the position $t_B$ and the position $t_3$, and it is made the concentration $C_{10}$ at the position $t_T$. Between the position $t_3$ and the position $t_T$, the distribution concentration C is reduced from the concentration $C_9$ to substantially zero as a first order function from the position $t_3$ to the position $t_T$.

Figure 48:
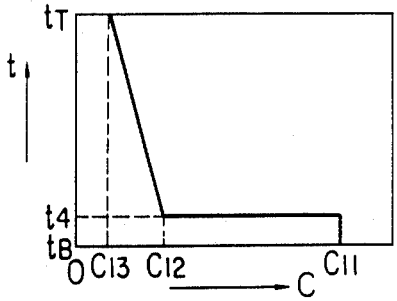

In the embodiment shown in FIG. 48, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$, and the concentration C is made substantially zero at the position $t_T$.

Figure 49:
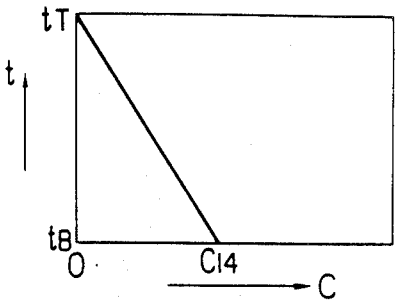

In the embodiment shown in FIG. 49, from the position $t_B$ to the position $t_T$, the distribution concentration C of the atoms (OCN) is reduced as a first order function from the concentration $C_{14}$ to substantially zero.

Figure 50:
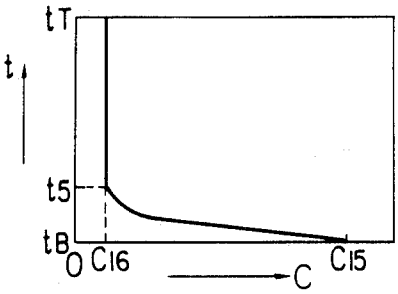

In FIG. 50, there is shown an embodiment, wherein from the position $t_B$ to the position $t_5$, the distribution concentration of the atoms (OCN) is reduced approximately as a first order function from the concentration $C_{15}$ to $C_{16}$, and it is made constantly $C_{16}$ between the position $t_5$ and the position $t_T$.

Figure 51:
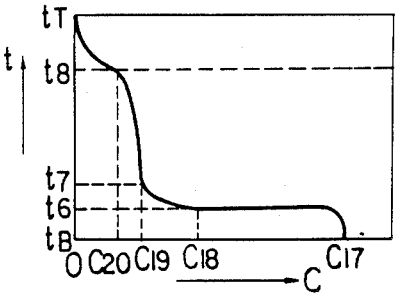

In the embodiment shown in FIG. 51, the distribution concentration C of the atoms (OCN) is $C_{17}$ at the position $t_B$, and, toward the position $t_6$, this $C_{17}$ is initially reduced gradually and then abruptly reduced near the position $t_6$, until it is made the concentration $C_{18}$ at the position $t_6$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced very gradually to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (OCN) contained in the layer region (OCN) by referring to FIGS. 43 through 51, it is desirable in the present invention that, when the atoms (OCN) are to be contained ununiformly in the layer region (OCN), the atoms (OCN) should be distributed in the layer region (OCN) with higher concentration on the substrate side, while having a portion considerably depleted in concentration on the interface $t_T$ side as compared with the substrate side.

The layer region (OCN) containing atoms (OCN) should desirably be provided so as to have a localized region (B) containing the atoms (OCN) at a relatively higher concentration on the substrate side as described above, and in this case, adhesion between the substrate and the light-receiving layer can be further improved.

The above localized region (B) should desirably be provided within 5μ from the interface position $t_B$, as explained in terms of the symbols indicated in FIGS. 43 through 51.

In the present invention, the above localized region (B) may be made the whole of the layer region ($L_T$) from the interface position $t_B$ to 5μ thickness or a part of the layer region ($L_T$).

It may suitably be determined depending on the characteristics required for the light-receiving layer to be formed whether the localized region (B) is made a part or the whole of the layer region ($L_T$).

The localized region (B) should preferably be formed to have a depth profile in the layer thickness direction such that the maximum value Cmax of the distribution concentration of the atoms (OCN) may preferably be 500 atomic ppm or more, more preferably 800 atomic ppm or more, most preferably 1000 atomic ppm or more.

In other words, in the present invention, the layer region (OCN) containing the atoms (OCN) should preferably be formed so that the maximum value Cmax of the distribution concentration C may exist within 5μ layer thickness from the substrate side (in the layer region with 5μ thickness from $t_B$).

In the present invention, when the layer region (OCN) is provided so as to occupy a part of the layer region of the light-receiving layer, the depth profile of the atoms (OCN) should desirably be formed so that the refractive index may be changed moderately at the interface between the layer region (OCN) and other layer regions.

By doing so, reflection of the light incident upon the light-receiving layer from the interface between contacted interfaces can be inhibited, whereby appearance of interference fringe pattern can more effectively be prevented.

It is also preferred that the distribution concentration C of the atoms (OCN) in the layer region (OCN) should be changed along a line which is changed continuously and moderately, in order to give smooth refractive index change.

In this regard, it is preferred that the atoms (OCN) should be contained in the layer region (OCN) so that the depth profiles as shown, for example, in FIGS. 43 through 46, FIG. 49 and FIG. 51 may be assumed.

In the present invention, for provision of a layer region (OCN) containing the atoms (OCN) in the light-receiving layer, a starting material for introduction of the atoms (OCN) may be used together with the starting material for formation of the light-receiving layer during formation of the light-receiving layer and incorporated in the layer formed while controlling its amount.

When the glow discharge method is employed for formation of the layer region (OCN), a starting material for introduction of the atoms (OCN) is added to the material selected as desired from the starting materials for formation of the light-receiving layer as described above. For such a starting material for introduction of the atoms (OCN), there may be employed most of gaseous or gasified gasifiable substances containing at least the atoms (OCN) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; saturated hydrocarbons having 1–5 carbon atoms such as methane ($CH_4$), ethane ($C_2H_6$), propane ($C_3H_8$), n-butane (n-$C_4H_{10}$), pentane ($C_5H_{12}$); ethylenic hydrocarbons having 2–5 carbon atoms such as ethylene ($C_2H_4$), propylene ($C_3H_6$), butene-1 ($C_4H_8$), butene-2 ($C_4H_8$), isobutylene ($C_4H_8$), pentene ($C_5H_{10}$); acetylenic hydrocarbons having 2–4 carbon atoms such as acetylene ($C_2H_2$), methyl acetyllene ($C_3H_4$), butyne ($C_4H_6$); and the like; nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), nitrogen tetrafluoride ($F_4N$) and so on.

In the case of the sputtering method, as the starting material for introduction of the atoms (OCN), there may also be employed solid starting materials such as $SiO_2$, $Si_3N_4$ and carbon black in addition to those gasifiable as enumerated for the glow discharge method. These can be used in the form of a target for sputtering together with the target of Si, etc.

In the present invention, when forming a layer region (OCN) containing the atoms (OCN) during formation of the light-receiving layer, formation of the layer region (OCN) having a desired depth profile in the direction of layer thickness formed by varying the distributibn concentration C of the atoms (OCN) contained in said layer region (OCN) may be conducted in the case of glow discharge by introducing a starting gas for introduction of the atoms (OCN) the distribution concentration C of which is to be varied into a deposition chamber, while varying suitably its gas flow rate according to a desired change rate curve.

For example, by the manual method or any other method conventionally used such as an externally driven motor, etc., the opening of a certain needle valve provided in the course of the gas flow channel system may be gradually varied. During this operation, the rate of variationis not necessarily required to be linear, but the flow rate may be controlled according to a variation rate curve previously designed by means of, for example, a microcomputer to give a desired content curve.

When the layer region (OCN) is formed according to the sputtering method, formation of a desired depth profile of the atoms (OCN) in the layer thickness direction by varying the distribution concentration C of the atoms (OCN) may be performed first similarly as in the case of the glow discharge method by employing a starting material for introduction of the atoms (OCN) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1004 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally 10 $\mu$ or more from the points of fabrication and handling of the substrate as well as its mechanical strength.

Figure 64:
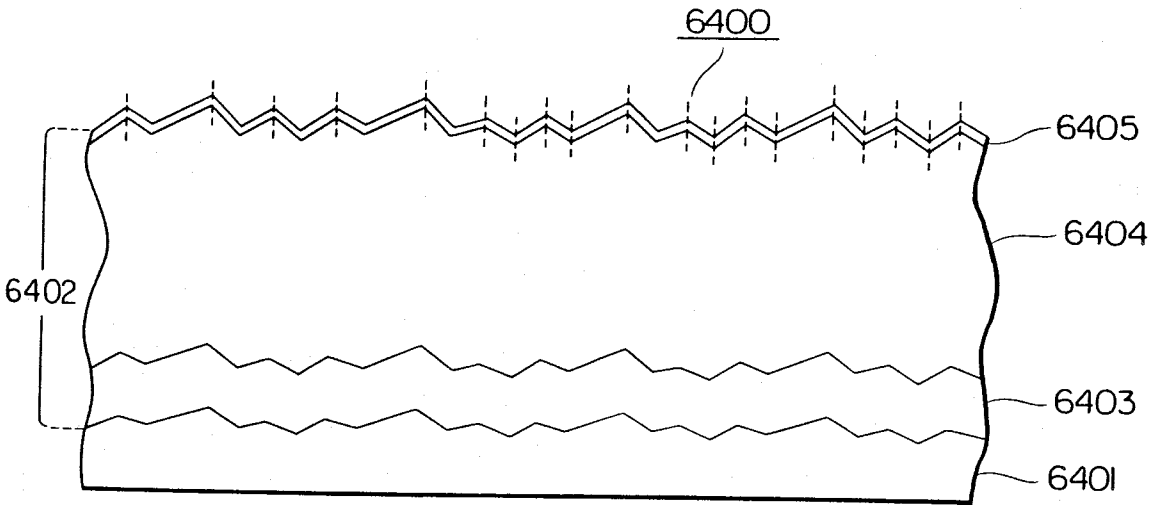

Referring now to FIG. 64, another preferred embodiment of the light-receiving member of the present invention having a multi-layer constitution is to be described.

The light-receiving member 6400 shown in FIG. 64 has a light-receiving layer 6402 on a substrate 6401 which is subjected to surface cutting working so as to achieve the objects of the invention, said light-receiving layer 6402 being constituted of a charge injection preventive layer 6403, a photosensitive layer 6404 and a surface layer having reflection preventive function 6405 from the side of the substrate 6401.

In the light-receiving member 6400 shown in FIG. 64, the substrate 6401, the photosensitive layer 6404, the surface layer 6405 are the same as the substrate 1001, the second layer (S) 1003 and the surface layer 1006, respectively, in the light sensitive member 1000 as shown in FIG. 10.

The charge injection preventive layer 6403 is provided for the purpose of preventing injection of charges into the photosensitive layer 6404 from the substrate 6401 side, thereby increasing apparent resistance.

The charge injection preventive layer 6403 is constituted of A-Si containing hydrogen atoms and/or halogen atoms (X) (hereinafter written as "A-Si(H,X)") and also contains a substance (C) for controlling conductivity.

In the present invention, the content of the substance (C) for controlling conductivity contained in the charge injection preventive layer 6403 may be suitably selected depending on the charge injection preventing characteristic required, or when the charge injection preventive layer 6403 is provided on the substrate 6401 directly contacted therewith, the organic relationship such as relation with the characteristic at the contacted interface with the substrate 6401. Also, the content of the substance (C) for controlling conductivity is selected suitably with due considerations of the relationships with characteristics of other layer regions provided in direct contact with the above charge injection preventive layer or the characteristics at the contacted interface with said other layer regions.

The content of the substance (C) for controlling conductivity contained in the charge injection preventive layer 6403 should preferably be 0.001 to $5\times10^4$ atomic ppm, more preferably 0.5 to $1\times10^4$ atomic ppm, most preferably 1 to $5\times10^3$ atomic ppm.

By making the content of the substance (C) in the charge injection preventive layer 6403 preferably 30 atomic ppm or more, more preferably 50 atomic ppm or more, most preferably 100 atomic ppm or more, for example, in the case when the substance (C) to be incorporated is a p-type impurity mentioned above, migration of electrons injected from the substrate side into the photosensitive layer 6404 can be effectively inhibited when the free surface of the light-receiving layer 6405 is subjected to the charging treatment to ⊕ polarity. On the other hand, when the substance (C) to be incorporated is a n-type impurity as mentioned above, migration of positive holes injected from the substrate 6401 side into the photosensitive layer 6404 can be more effectively inhibited when the free surface of the light-receiving layer 6405 is subjected to the charging treatment to ⊖ polarity.

The charge injection preventive layer 6403 may have a thickness preferably of 30 Å to 10 μ, more preferably of 40 Å to 8 μ, most preferably of 50 Å to 5 μ.

The photosensitive layer 6404 may contain a substance for controlling conductivity of the other polarity than that of the substance for controlling conductivity contained in the charge injection preventive layer 6403 , or a substance for controlling conductivity of the same polarity may be contained therein in an amount by far smaller than that practically contained in the charge injection preventive layer 6403 .

In such a case, the content of the substance for controlling conductivity contained in the above photosensitive layer 6404 can be determined adequately as desired depending on the polarity or the content of the substance contained in the charge injection preventive layer 6403 , but it is preferably 0.001 to 1000 atomic ppm, more preferably 0.05 to 500 atomic ppm, most preferably 0.1 to 200 atomic ppm.

When the same kind of a substance for controlling conductivity is contained in the charge injection preventive layer 6403 and the photosensitive layer 6404, the content in the photosensitive layer 6404 should preferably be 30 atomic ppm or less.

In the light-receiving member 6400 as shown in FIG. 64, the amount of hydrogen atoms (H) or the amount of halogen atoms (X) or the sum of the amounts of hydrogen atoms and halogen atoms (H+X) to be contained in the charge injection preventive layer 6403 should preferably be 1 to 40 atomic %, more preferably 5 to 30 atomic %.

As halogen atoms (X), F, Cl, Br and I may be included and among them, F and Cl may preferably be employed.

In the light-receiving member shown in FIG. 64 a so-called barrier layer comprising an electrically insulating material may be provided in place of the charge injection preventive layer 6403. Alternatively, it is also possible to use said barrier layer in combination with the charge injection preventive layer 6403 .

As the material for forming the barrier layer, there may be included inorganic insulating materials such as $Al_2O_3$, $SiO_2$, $Si_3N_4$, etc. or organic insulating materials such as polycarbonate, etc.

The light-receiving layer 6400 shown in FIG. 64 can accomplish the objects of the present invention more effectively by incorporating either one of oxygen atoms and nitrogen atoms in the light-receiving layer 6402, similarly as in the light-receiving layer 1000 in the light-receiving member 1004 shown in FIG. 10.

Figure 26:
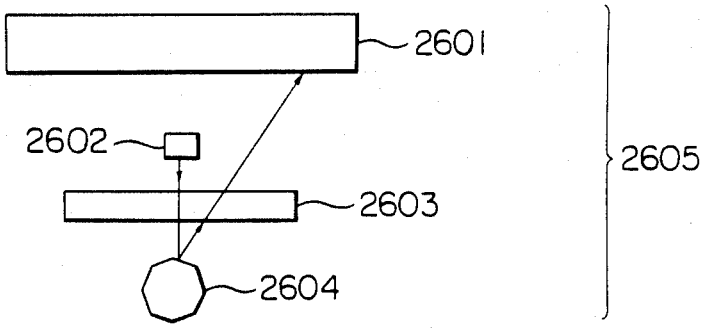
FIG. 26 is a schematic illustration of the image forming device employed in Examples.
Figure 26:
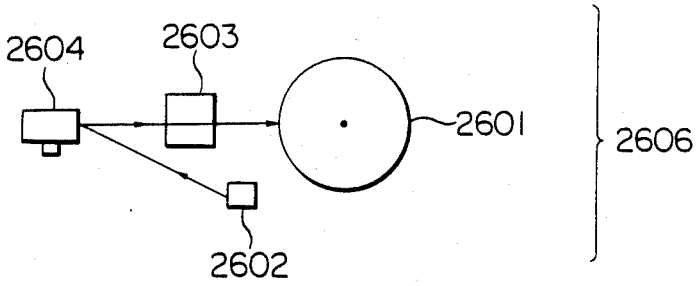

FIG. 26 is a schematic illustration of an example of the image forming device employing electrophotographic technique in which the light-receiving member of the present invention is mounted.

In this Figure, 2601 is a drum-shaped light-receiving member of the present invention prepared for use in electrophotography, 2602 is a semiconductor laser device which the light source for applying exposure on the light-receiving member 2601 corresponding to the information to be recorded, 2603 is a fθ lens, 2604 is a polygon-mirror, 2605 shows the plane view of the device and 2606 shown the side view of the device.

In FIG. 26, devices to be generally employed for practicing electrophotographic image formation, such as developing device, transfer device, fixing device, cleaning device, etc., are not shown.

Next, an example of the process for producing the light-receiving member of this invention is to be briefly described.

Figure 20:
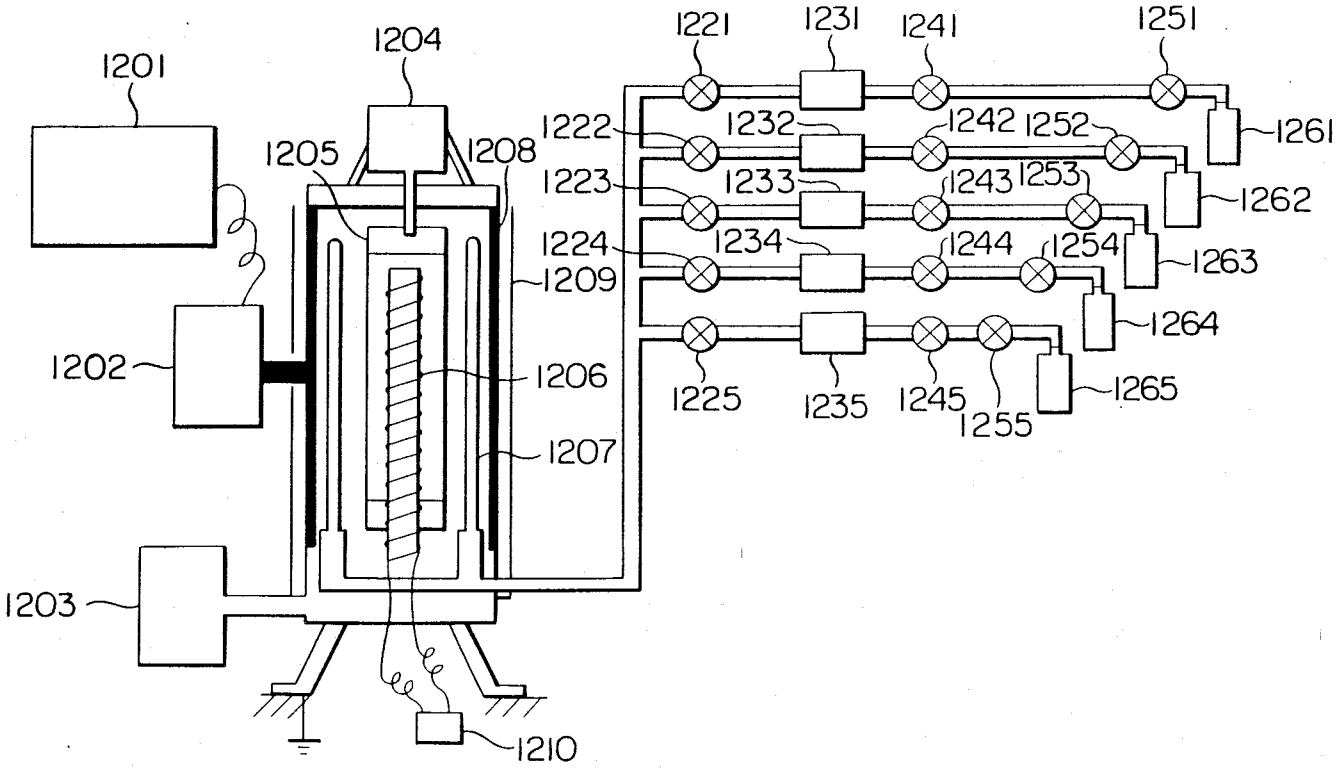
FIG. 20 and FIG. 63 are schematic illustrations of the vacuum deposition devices for preparation of the light-receiving members employed in Examples.

FIG. 20 shows one example of a device for producing a light-receiving member.

In the gas bombs 2002 to 2006, there are hermetically contained starting gases for formation of the light-receiving member of the present invention. For example, 2002 is a bomb containing $SiH_4$ gas (purity 99.999%, hereinafter abbreviated as $SiH_4$), 2003 is a bomb contaiing $GeH_4$ gas (purity 99.999%, hereinafter abbreviated as $GeH_4$), 2004 is a bomb containing NO gas (purity 99.99%, hereinafter abbreviated as NO), 2005 is bomb containing $B_2H_6$ gas diluted with $H_2$ (purity 99.999%, hereinafter abbreviated as $B_2H_6/H_2$) and 2006 is a bomb containing $H_2$ gas (purity: 99.999%).

For allowing these gases to flow into the reaction chamber 2001, on confirmation of the valves 2022 to 2026 of the gas bombs 2002 to 2006 and the leak valve 2035 to be closed, and the inflow valves 2012 to 2016, the outflow valves 2017 to 2021 and the auxiliary valves 2032 and 2033 to be opened, the main valve 2034 is first opened to evacuate the reaction chamber 2001 and the gas pipelines. As the next step, when the reading on the vacuum indicator 2036 becomes $5\times10^{-6}$ Torr, the auxiliary valves 2032, 2033 and the outflow valves 2017 to 2021 are closed.

Referring now to an example of forming a light-receiving layer on the cylindrical substrate 2037, $SiH_4$ gas from the gas bomb 2002, $GeH_4$ gas from the gas bomb 2003, NO gas from the gas bomb 2004, $B_2H_6/H_2$ gas from the gas bomb 2005 and $H_2$ gas from the gas bomb 2006 are permitted to flow into the mass-flow controllers 2007, 2008, 2009, 2010 and 2011, respectively, by opening the valves 2022, 2023, 2024, 2025 and 2026 and controlling the pressures at the output pressure gauges 2027, 2028, 2029 2030 and 2031 to 1 $Kg/cm^2$ and opening gradually the inflow valves 2012, 2013, 2014, 2015 and 2016, respectively. Subsequently, the outflow valves 2017, 2018, 2019, 2020 and 2021 and the auxiliary valves 2032 and 2033 were gradually opened to permit respective gases to flow into the reaction chamber 2001. The outflow valves 2017, 2018, 2019, 2020 and 2021 are controlled so that the flow rate ratio of $SiH_4$ gas, $GeH_4$ gas, $B_2H_6/H_2$ gas, NO gas and $H_2$ may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° to 400° C. by the heater 2038, the power source 2040 is set at a desired power to excite glow discharge in the reaction chamber 2001, simultaneously with controlling of the distributed concentrations of germanium atoms and boron atoms, to be contained in the layer formed by carrying out the operation to change gradually the openings of the valves 2018, 2020 by the manual method or by means of an externally driven motor, etc. thereby changing the flow rates of $GeH_4$ gas and $B_2H_6$ gas according to previously designed change rate curves.

By maintaining the glow discharge as described above for a desired period time, the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valves 2019 or 2020, oxygen atoms or boron atoms may be contained or not, or oxygen atoms or boron atoms may be contained only in a part of the layer region of the respective layers.

When nitrogen atoms are to be contained in place of oxygen atoms, layer formation may be conducted by replacing NO gas in the gas bomb 2004 with $NH_3$ gas or $N_2$ gas. Also, when the kinds of the gases employed are desired to be increased, bombs of desirable gases may be provided additionally before carrying out layer formation similarly. During layer formation, for uniformization of the layer formation, it is desirable to rotate the substrate 2037 by means of a motor 2039 at a constant speed.

The present invention is described in more detail by referring to the following Examples.

EXAMPLE 1

In this Example, a semiconductor laser (wavelength: 780 nm) with a spot size of 80 μm was employed. Thus, on a cylindrical aluminum substrate [length (L) 357 mm, outerdiameter (r) 80 mm] on which A-Si:H is to be deposited, a spiral groove was prepared by a lathe. The cross-sectional shape of the groove is shown in FIG. 21(B).

On this aluminum substrate, the charge injection preventive layer and the photosensitive layer were deposited by means of the device as shown in FIG. 20 in the following manner.

First, the constitution of the device is to be explained. 1201 is a high frequency power source, 1202 is a matching box, 1203 is a diffusion pump and a mechanical booster pump, 1204 is a motor for rotation of the aluminum substrate, 1205 is an aluminum substrate, 1206 is a heater for heating the aluminum substrate, 1207 is a gas inlet tube, 1208 is a cathode electrode for introduction of high frequency, 1209 is a shield plate, 1210 is a power source for heater, 1221 to 1225, 1241 to 1245 are valves, 1231 to 1235 are mass flow controllers, 1251 to 1255 are regulators, 1261 is a hydrogen ($H_2$) bomb, 1262 is a silane ($SiH_4$) bomb, 1263 is a diborane ($B_2H_6$) bomb, 1264 is a nitrogen oxide (NO) bomb and 1265 is a methane ($CH_4$) bomb.

Next, the preparation procedure is to be explained. All of the main cocks of the bombs 1261–1265 were closed, all the mass flow controllers and the valves were opened and the deposition device was internally evacuated by the diffusion pump 1203 to $10^{-7}$ Torr. At the same time, the aluminum substrate 1205 was heated by the heater 1206 to 250° C. and maintained constantly at 250° C. After the aluminum substrate 1205 became constantly at 250° C., the valves 1221–1225, 1241–1245 and 1251–1255 were closed, the main cocks of bombs 1261–1266 opened and the diffusion pump 1203 was changed to the mechanical booster pump. The secondary pressure of the valve equipped with regulators 1251–1255 wes set at 1.5 $Kg/cm^2$. The mass flow controller 1231 was set at 300 SCCM, and the valves 1241 and 1221 were successively opened to introduce $H_2$ gas into the deposition device.

Next, by setting the mass flow controller 1232 at 150 SCCM, $SiH_4$ gas in 1261 was introduced into the deposition device according to the same procedure as introduction of $H_2$ gas. Then, by setting the mass flow controller 1233 so that $B_2H_6$ gas flow rate of the bomb 1263 may be 1600 vol. ppm relative to $SiH_4$ gas flow rate, $B_2H_6$ gas was introduced into the deposition device according to the same procedure as introduction of $H_2$ gas.

Then, by setting the mass flow controller 1234 so as to control the flow rate of NO gas of 1264 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1201 was turned on and glow discharge was generated between the aluminum substrate 1205 and the cathode electrode 1208 by controlling the matching box 1202, and a A-Si:H layer (p-type A-Si:H layer containing B) was deposited to a thickness of 5 μm at a high frequency power of 150 W (charge injection preventive layer). After deposition of the 5 μm thick A-Si:H layer (p-type), inflow of $B_2H_6$ was stopped by closing the valves 1223 without discontinuing discharging.

And, A-Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate lowered to room temperature and the substrate having formed layers up to the photosensitive layer thereon was taken out.

According to the same method, 22 cylinders having formed layers up to the photosensitive layer thereon were prepared.

Next, the hydrogen ($H_2$) bomb 1261 was replaced with argon (Ar) gas bomb, the deposition device cleaned and a target comprising the surface layer material as shown in Table 1A (Condition No. 101 A) was placed over the entire surface of the cathode electrode. One of the substrates having formed layers to the above photosensitive layer was set, and the deposition device was sufficiently evacuated by means of a diffusion pump. Thereafter, argon gas was introduced to 0.015 Torr, and glow discharge was excited at a high frequency power of 150 W to effect sputtering of the surface material, thereby forming a surface layer of Table 1A (Condition No. 101 A) on the above substrate (Sample No. 101 A). For remaining 21 substrates, the surface layers were formed under the conditions as shown in Table 1A (Condition No. 102A–120A) to deposit surface layers thereon (Sample No. 102A–120A).

Figure 21:
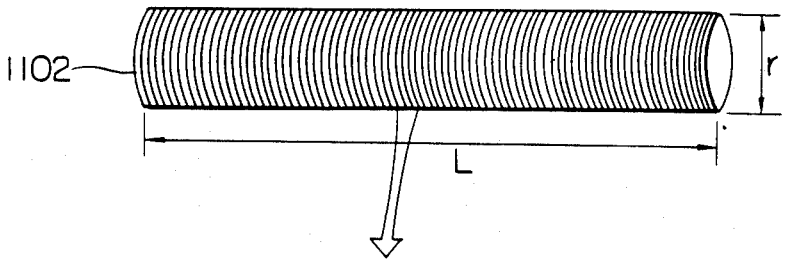
Figure 21:
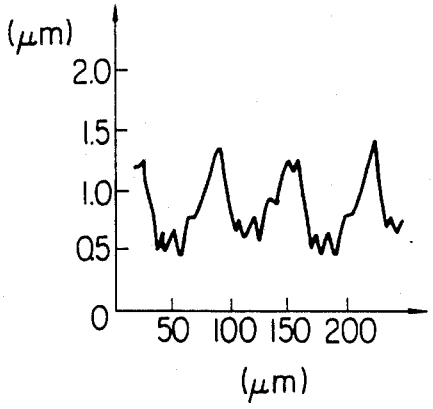
Figure 21:
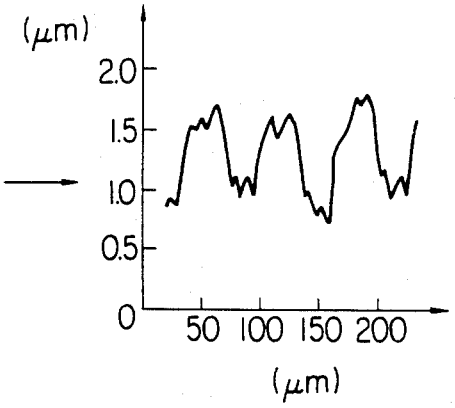

In these light-receiving member, as shown in FIG. 21 (B) and (C), the surface of the substrate and the surface of the photosensitive layer were non-parallel to each other. In this case, the difference in average layer thickness between the center and the both ends of the aluminum substrate was 2 μm.

For the 22 kinds of light-receiving member for electrophotography as described above, image exposure was effected by means of the device shown in FIG. 26 with a semiconductor laser of a wavelength 780 nm with a spot size of 80 μm, followed by developing and transfer to obtain an image.

In this case, no interference fringe pattern was observed to obtain a member exhibiting practically satisfactory electrophotographic characteristics.

EXAMPLE 2

Figure 80:
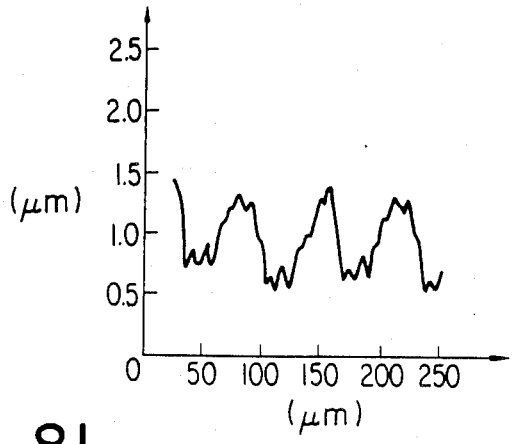

By means of a lathe, a cylindrical aluminum substrate (length (L): 357 mm, outerdiameter (r): 80 mm) was worked as shown in FIG. 80.

A light-receiving member for electrophotography of A-Si:H was deposited on the each cylindrical aluminum substrate under the same conditions as in Example 1.

The light-receiving member for electrophotography as prepared above was subjected to image exposure by means of a device as shown in FIG. 26 similarly as in Example 1, followed by development and transfer to obtain an image. In this case, the transferred image was free from any interference fringe pattern observed and proved to be satisfactory for practical application.

EXAMPLE 3

Figure 81:
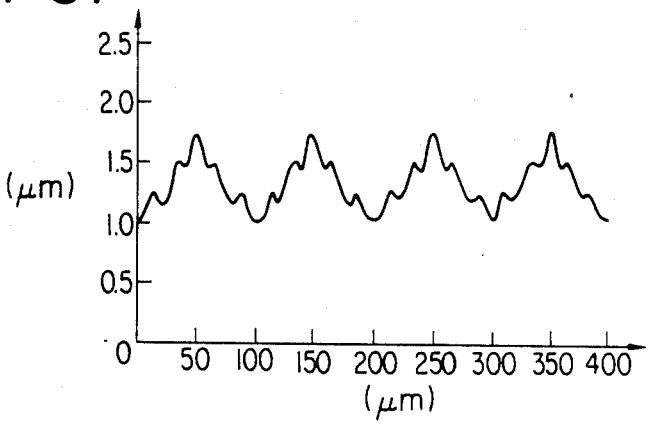
Figure 82:
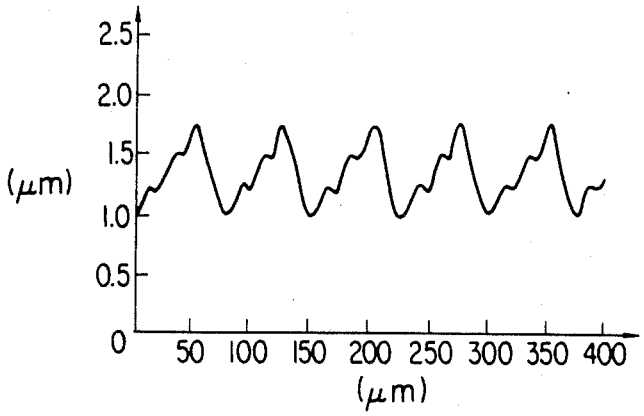

On cylindrical aluminum substrate having the surface characteristics as shown in FIG. 81 and FIG. 82, light-receiving members for electrophotography were formed under the conditions shown in Table 2A.

For these light-receiving members for electrophotography, by means of the same device as in Example 1, image exposure was effected, followed by development, transfer and fixing, to obtain visible images on plain papers. Such an image forming process was repeated continuously for 100,000 times.

In this case, in all the images obtained, no interference fringe pattern was observed to give practically satisfactory characteristics. There was also no difference observed at all between the initial and the image after 100,000 copying, all being of high quality images.

EXAMPLE 4

On cylindrical aluminum substrates having the surface characteristics as shown in FIG. 81 and FIG. 82, light-receiving members for electrophotography were formed under the conditions shown in Table 3A.

For these light-receiving members for electrophotography, by means of the same device as in Example 1, image exposure was effected, followed by developing, transfer and fixing, to obtain visible images on plain papers.

In this case, in all the images obtained, no interference fringe pattern was observed to give practically satisfactory characteristics.

EXAMPLE 5

On cylindrical aluminum substrates having the surface characteristics as shown in FIG. 81 and FIG. 82, light-receiving members for electrophotography were formed under the conditions shown in Table 4A.

For these light-receiving members for electrophotography, by means of the same device as in Example 1, image exposure was effected, followed by development, transfer and fixing, to obtain visible images on plain papers.

In this case, in all the images obtained, no interference fringe pattern was observed to give practically satisfactory characteristics.

EXAMPLE 6

On cylindrical aluminum substrates having the surface characteristics as shown in FIG. 81 and FIG. 82, light-receiving members for electrophotography were formed under the conditions shown in Table 5A.

For these light-receiving members for electrophotography, by means of the same device as in Example 1, image exposure was effected, followed by development, transfer and fixing, to obtain visible images on plain papers.

In this case, in all the images obtained, no interference fringe pattern was observed to give practically satisfactory characteristics.

EXAMPLE 7

In this Example, a semiconductor laser (wavelength: 780 nm) with a spot size of 80 μm was employed. Thus, on a cylindrical aluminum substrate [length (L) 357 mm, outerdiameter (r) 80 mm] on which A-Si:H is to be deposited, a spiral groove was prepared by a lathe. The cross-sectional shape of the groove is shown in FIG. 21 (B).

On this aluminum substrate, the charge injection preventive layer and the photosensitive layer were deposited by means of the device as shown in FIG. 20 in the following manner.

All of the main cocks of the bombs 1261–1265 were closed, all the mass flow controllers and the valves were opened and the deposition device was internally evacuated by the diffusion pump 1203 to $10^{-7}$ Torr. At the same time, the aluminum substrate 1205 was heated by the heater 1206 to 250° C. and maintained constantly at 250° C. After the aluminum substrate 1205 became constantly at 250° C., the valves 1221–1225, 1241–1245 and 1251–1255 were closed, the main cocks of bombs 1261–1266 opened and the diffusion pump 1203 was changed to the mechanical booster pump. The secondary pressure of the valve equipped with regulators 1251–1255 was set at 1.5 Kg/cm$^2$. The mass flow controller 1231 was set at 300 SCCM, and the valves 1241 and 1221 were successively opened to introduce $H_2$ gas into the deposition device.

Next, by setting the mass flow controller 1232 at 150 SCCM, $SiH_4$ gas in 1261 was introduced into the deposition device according to the same procedure as introduction of $H_2$ gas. Then, by setting the mass flow controller 1233 so that $B_2H_6$ gas flow rate of the bomb 1263 may be 1600 Vol. ppm relative to $SiH_4$ gas flow rate, $B_2H_6$ gas was introduced into the deposition device according to the same procedure as introduction of $H_2$ gas.

Then, by setting the mass flow controller 1234 so as to control the flow rate of NO gas of 1264 at 3.4 Vol. % based on $SiH_4$ gas flow rate, NO gas was introduced into the deposition device according to the same procedure as introduction of $H_2$.

And, when the inner pressure in the deposition device was stabilized at 0.2 Torr, the high frequency power source 1201 was turned on and glow discharge was generated between the aluminum substrate 1205 and the cathode electrode 1208 by controlling the matching box 1202, and a A-Si:H:B:O layer (p-type A-Si:H layer containing B and O) was deposited to a thickness of 5 μm at a high frequency power of 160 W (charge injection preventive layer). During this operation, the NO gas flow rate was varied as shown in FIG. 49 relative to the $SiH_4$ gas flow rate until the NO gas flow rate became zero on completion of the layer formation. After depositing thus an A-Si:H:B:O (p-type) layer with a 5 μm thickness, inflow of $B_2H_6$ and NO was stopped by closing the valves 1223 and 1224 without discontinuing discharging.

And, A-Si:H layer (non-doped) with a thickness of 20 μm was deposited at a high frequency power of 150 W (photosensitive layer). Then, with the high frequency power source and all the valves being closed, the deposition device was evacuated, the temperature of the aluminum substrate lowered to room temperature and the substrate having formed layers up to the photosensitive layer thereon was taken out.

According to the same method, 22 cylinders having formed layers up to the photosensitive layer thereon were prepared.

Next, the hydrogen ($H_2$) bomb 1261 was replaced with argon (Ar) gas bomb, the deposition device cleaned and a target comprising the surface layer material as shown in Table 1A (condition No. 101 A) was placed over the entire surface of the cathode electrode. One of the substrates having formed layers to the above photosensitive layer was set, and the deposition device was sufficiently evacuated by means of a diffusion pump. Thereafter, argon gas was introduced to 0.015 Torr, and glow discharge was excited at a high frequency power of 150 W to effect sputtering of the surface material, thereby forming a surface layer of Table 1A (Condition No. 101 A) on the above substrate (Sample No. 101 A). For remaining 21 substrates, the surface layers were formed under the conditions as shown in Table 1B (Condition No. 102 B–120 B) to deposit surface layers thereon (Sample No. 102 B–120 B).

In these light-receiving member, as shown in FIG. 21 (B) and (C), the surface of the substrate and the surface of the photosensitive layer were non-parallel to each other. In this case, the difference in average layer thickness between the center and the both ends of the aluminum substate was 2 μm.

For the 22 kinds of light-receiving member for electrophotography as described above, image exposure was effected by means of the device shown in FIG. 26 with a semiconductor laser of a wavelength 780 nm with a spot size of 80 μm, followed by developing and transfer to obtain an image.

In this case, no interference fringe pattern was observed to obtain a member exhibiting practically satisfactory electrophotographic characteristics.

EXAMPLE 8

By means of a lathe, 22 cylindrical aluminum substrates were worked as shown in FIG. 80.

A light-receiving member for electrophotography of A-Si:H type was deposited on each aluminum substrate under the same conditions as in Example 7.

The light-receiving member for electrophotography as prepared above was subjected to image exposure by means of a device as shown in FIG. 26 similarly as in Example 7, followed by development and transfer to obtain an image. In this case, the transferred image was free from any interference fringe pattern observed and proved to be satisfactory for practical application.

EXAMPLE 9

On cylindrical aluminum substrates having the surface characteristics as shown in FIG. 27 and FIG. 28, light-receiving members for electrophotography were formed following the change rate curve of the gas flow rate ratio of $NH_3/SiH_4$ shown in Table 9 and under the conditions shown in Table 2B.

For these light-receiving members for electrophotography, by means of the same device as in Example 7, image exposure was effected, followed by development, transfer and fixing, to obtain visible images on plain papers. Such an image forming process was repeated continuously for 100,000 times.

In this case, in all the images obtained, no interference fringe pattern was observed to give practically satisfactory characteristics. There was also no difference observed at all between the initial image and the image after 100,000 copying, all being of high quality images.

EXAMPLE 10

On cylindrical aluminum substrates having the surface characteristics as shown in FIG. 81 and FIG. 82, light-receiving members for electrophotography were formed under the conditions shown in Table 3B and following the change rate curve of the gas flow rate ratio of $CH_4/SiH_4$ as shown in FIG. 49.

For these light-receiving members for electrophotography, by means of the same device as in Example 7, image exposure was effected, followed by development, transfer and fixing, to obtain visible images on plain papers.

In this case, in all the images obtained, no interference fringe pattern was observed to give practically satisfactory characteristics.

EXAMPLE 11

On cylindrical aluminum substrates having the surface characteristics as shown in FIG. 81 and FIG. 82, light-receiving members for electrophotography were formed under the conditions shown in Table 4B and following the change rate curve of the gas flow rate ratio of $CH_4/SiH_4$ as shown in FIG. 49.

For these light-receiving members for electrophotography, by means of the same device as in Example 7, image exposure was effected, followed by development, transfer and fixing, to obtain visible images on plain papers.

In this case, in all the images obtained, no interference fringe pattern was observed to give practically satisfactory characteristics.

EXAMPLE 12

On cylindrical aluminum substrates having the surface characteristics as shown in FIG. 81 and FIG. 82, light-receiving members for electrophotography were formed under the conditions shown in Table 5B and following the change rate curve of the gas flow rate ratio of $CH_4/SiH_4$ as shown in FIG. 49.

For these light-receiving members for electrophotography, by means of the same device as in Example 7, image exposure was effected, followed by development, transfer and fixing, to obtain visible images on plain papers.

In this case, in all the images obtained, no interference fringe pattern was observed to give practically satisfactory characteristics.

EXAMPLE 13

Figure 66:
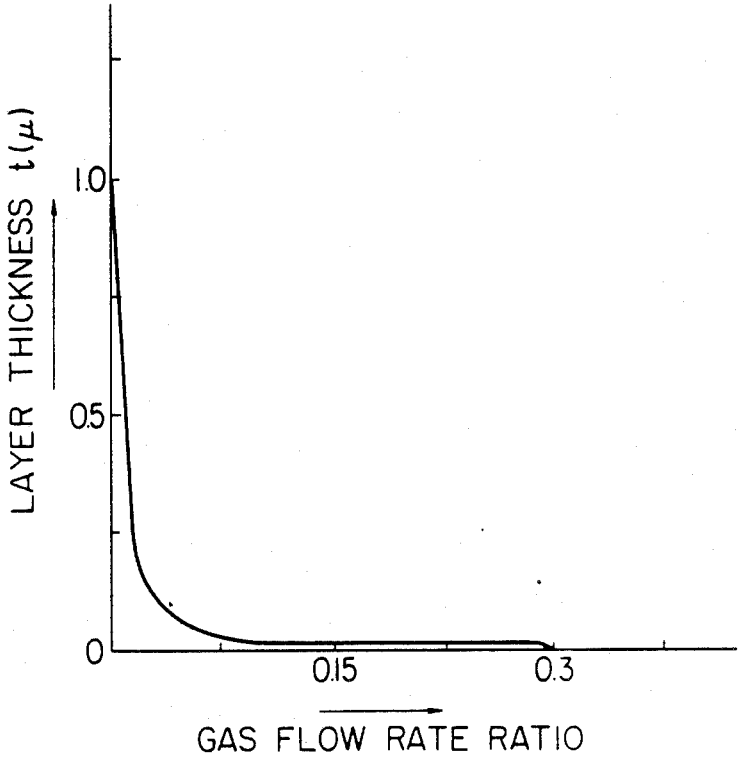

On cylindrical aluminum substrates having the surface characteristics as shown in FIG. 81 and FIG. 82, light-receiving members for electrophotography were formed under the conditions shown in Table 6B and following the change rate curve of the gas flow rate ratio of NO and $SiH_4$ as shown in FIG. 66. Otherwise, the same conditions and the same procedure as in Example 7 was followed.

For these light-receiving members for electrophotography, by means of the same device as in Example 7, image exposure was effected, followed by development, transfer and fixing, to obtain visible images on plain papers.

In this case, in the images obtained, no interference fringe pattern was observed to give practically satisfactory characteristics.

EXAMPLE 14

Figure 67:
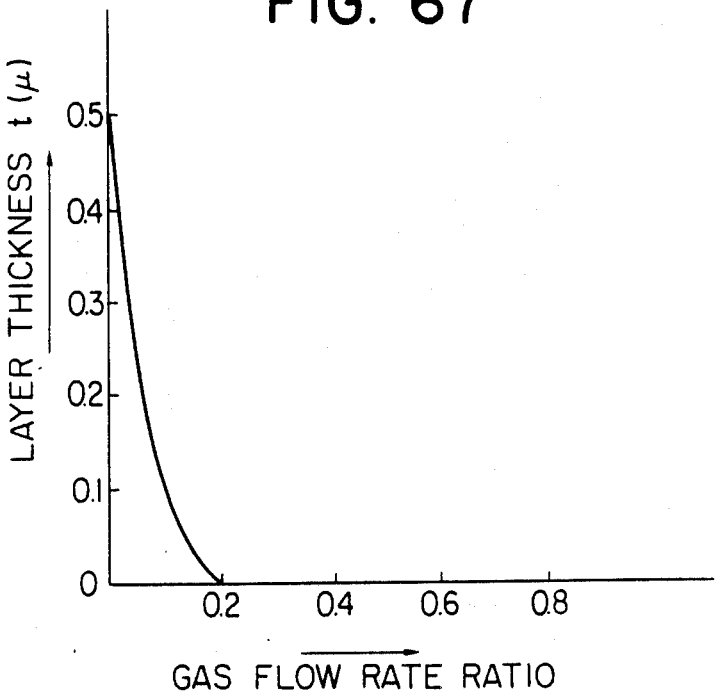

On cylindrical aluminum substrates having the surface characteristics as shown in FIG. 81 and FIG. 82, light-receiving members for electrophotography were formed under the conditions shown in Table 7B and following the change rate curve of the gas flow rate ratio of NO and $SiH_4$ as shown in FIG. 67. Otherwise, the same conditions and the same procedure as in Example 7 were followed.

For these light-receiving members for electrophotography, by means of the same device as in Example 7, image exposure was effected, followed by development, transfer and fixing, to obtain visible images on plain papers.

In this case, in the images obtained, no interference fringe pattern was observed to give practically satisfactory characteristics.

EXAMPLE 15

Figure 68:
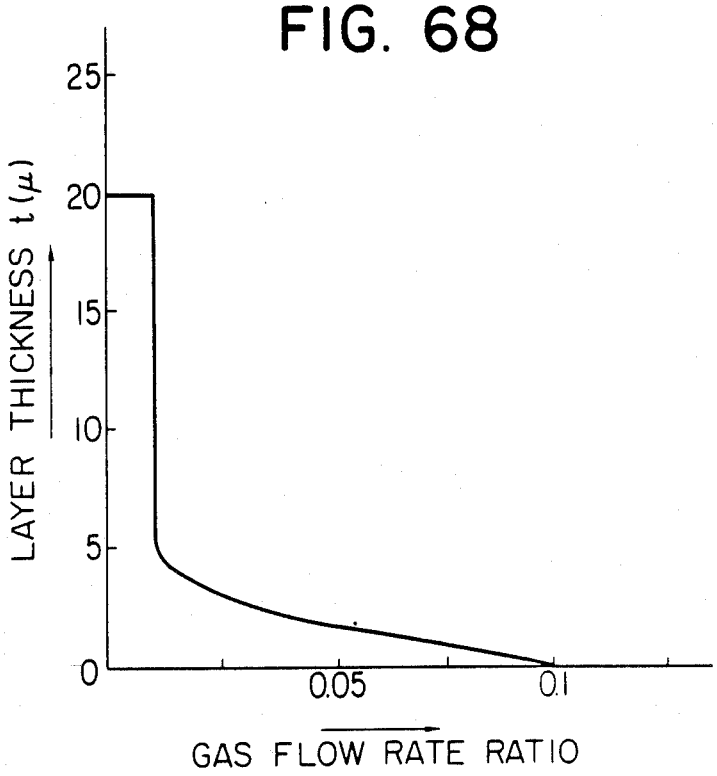

On cylindrical aluminum substrates having the surface characteristics as shown in FIG. 81 and FIG. 82, light-receiving members for electrophotography were formed under the conditions shown in Table 8B and following the change rate curve of the gas flow rate ratio of NO and $SiH_4$ as shown in FIG. 68. Otherwise, the same conditions and the same procedure as in Example 7 were followed.

For these light-receiving members for electrophotography, by means of the same device as in Example 7, image exposure was effected, followed by development, transfer and fixing, to obtain visible images on plain papers.

In this case, in the images obtained, no interference fringe pattern was observed to give practically satisfactory characteristics.

EXAMPLE 16

Figure 69:
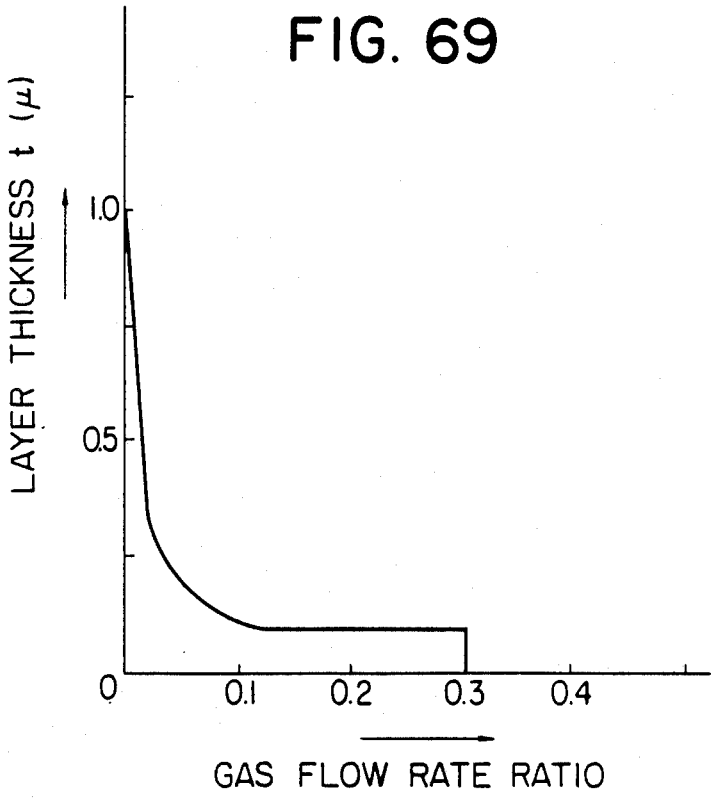

On cylindrical aluminum substrates having the surface characteristics as shown in FIG. 81 and FIG. 82, light-receiving members for electrophotography were formed under the conditions shown in Table 9B and following the change rate curve of the gas flow rate ratio of NO and $SiH_4$ as shown in FIG. 69. Otherwise, the same conditions and the same procedure as in Example 7 were followed.

For these light-receiving members for electrophotography, by means of the same device as in Example 7, image exposure was effected, followed by development, transfer and fixing, to obtain visible images on plain papers.

In this case, in the images obtained, no interference fringe pattern was observed to give practically satisfactory characteristics.

EXAMPLE 17

On cylindrical aluminum substrates having the surface characteristics as shown in FIG. 81 and FIG. 82, light-receiving members for electrophotography were formed under the conditions shown in Table 10B and following the change rate curve of the gas flow rate ratio of NO and $SiH_4$ as shown in FIG. 69. Otherwise, the same conditions and the same procedure as in Example 7 were followed.

For these light-receiving members for electrophotography, by means of the same device as in Example 7, image exposure was effected, followed by development, transfer and fixing, to obtain visible images on plain papers.

In this case, in the images obtained, no interference fringe pattern was observed to give practically satisfactory characteristics.

EXAMPLE 18

Figure 63:
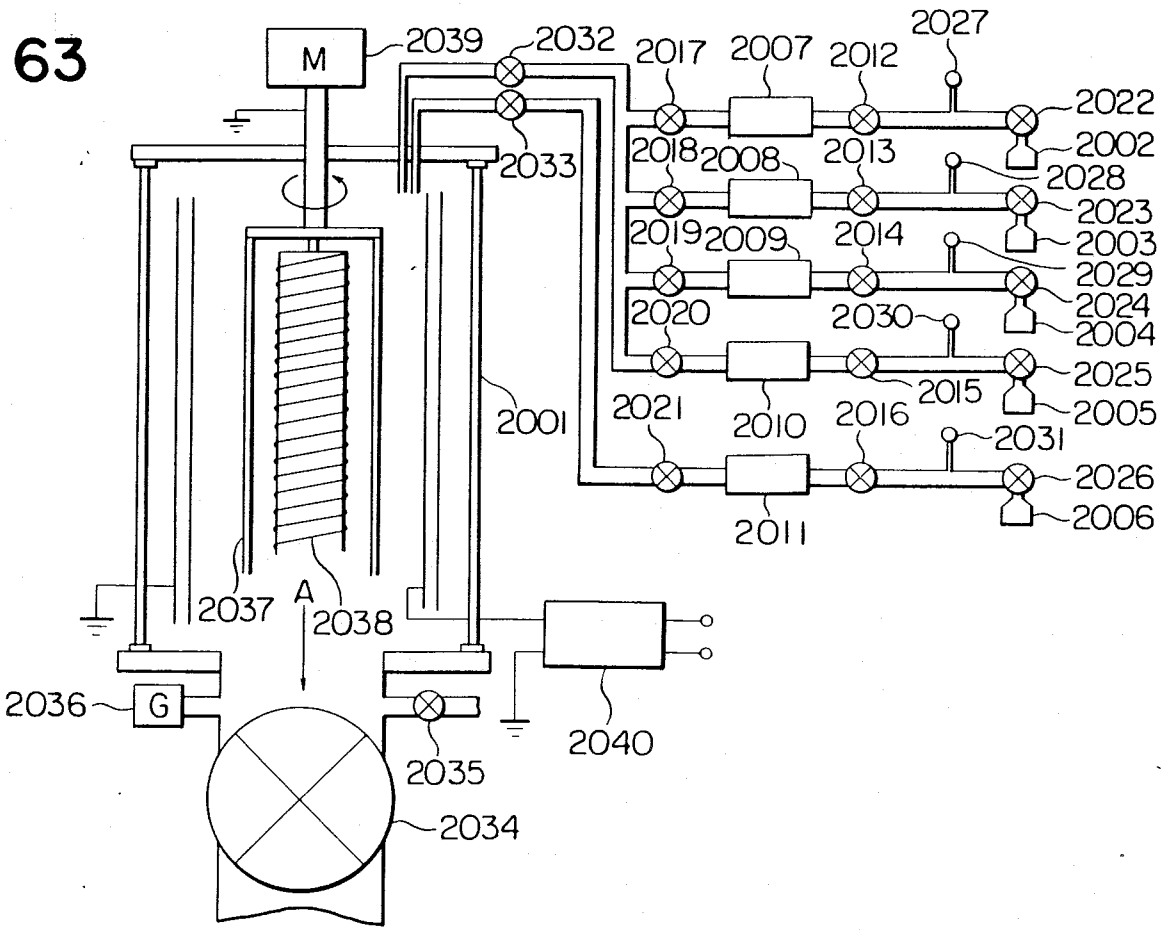

FIG. 63 shows one example of a device for producing a light-receiving member.

In the gas bombs 2002 to 2006, there are hermetically contained starting gases for formation of the light-receiving member of the present invention. For example, 2002 is a bomb containing $SiH_4$ gas (purity 99.999%, hereinafter abbreviated as $SiH_4$), 2003 is a bomb containing $GeH_4$ gas (purity 99.999%, hereinafter abbreviated as $GeH_4$), 2004 is a bomb containing NO gas (purity 99.99%, hereinafter abbreviated as NO), 2005 is bomb containing $B_2H_6$ gas diluted with $H_2$ (purity 99.999%, hereinafter abbreviated as $B_2H_6/H_2$) and 2006 is a bomb containing $H_2$ gas (purity: 99.999%).

For allowing these gases to flow into the reaction chamber 2001, on confirmation of the valves 2022 to 2026 of the gas bombs 2002 to 2006 and the leak valve 2035 to be closed, and the inflow valves 2012 to 2016, the outflow valves 2017 to 2021 and the auxiliary valves 2032 and 2033 to be opened, the main valve 2034 is first opened to evacuate the reaction chamber 2001 and the gas pipelines. As the next step, when the reading on the vacuum indicator 2036 becomes $5\times10^{-6}$ Torr, the auxiliary valves 2032, 2033 and the outflow valves 2017 to 2021 are closed.

Referring now to an example of forming a light-receiving layer on the cylindrical substrate 2037, $SiH_4$ gas from the gas bomb 2002, $GeH_4$ gas from the gas bomb 2003, NO gas from the gas bomb 2004, $B_2H_6/H_2$ gas from the gas bomb 2005 and $H_2$ gas from the gas bomb 2006 are permitted to flow into the mass-flow controllers 2007, 2008, 2009, 2010 and 2011, respectively, by opening the valves 2022, 2023, 2024, 2025 and 2026 and controlling the pressures at the output pressure gauges 2027, 2028, 2029, 2030 and 2031 to 1 $Kg/cm^2$ and opening gradually the inflow valves 2012, 2013, 2014, 2015 and 2016, respectively. Subsequently, the outflow valves 2017, 2018, 2019, 2020 and 2021 and the auxiliary valves 2032 and 2033 were gradually opened to permit respective gases to flow into the reaction chamber 2001. The outflow valves 2017, 2018, 2019, 2020 and 2021 are controlled so that the flow rate ratio of $SiH_4$ gas, $GeH_4$ gas, $B_2H_6/H_2$ gas, NO gas and $H_2$ may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° to 400° C. by the heater 2038, the power source 2040 is set at a desired power to excite glow discharge in the reaction chamber 2001, simultaneously with controlling of the distributed concentrations of germanium atoms and boron atoms to be contained in the layer formed by carrying out the operation to change gradually the openings of the valves 2018, 2020 by the manual method or by means of an externally driven mtor, etc. thereby changing the flow rates of $GeH_4$ gas and $B_2H_6$ gas according to previously designed change rate curves.

By maintaining the glow discharge as described above for a desired period time, the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valves 2019 or 2020, oxygen atoms or boron atoms may be contained or not, or oxygen atoms or boron atoms may be contained only in a part of the layer region of the respective layers.

When nitrogen atoms are to be contained in place of oxygen atoms, layer formation may be conducted by replacing NO gas in the gas bomb 2004 with $NH_3$ gas or $N_2$ gas. Also, when the kinds of the gases employed are desired to be increased, bombs of desirable gases may be provided additionally before carrying out layer formation similarly. During layer formation, for uniformization of the layer formation, it is desirable to rotate the substrate 2037 by means of a motor 2039 at a constant speed.

Figure 65:
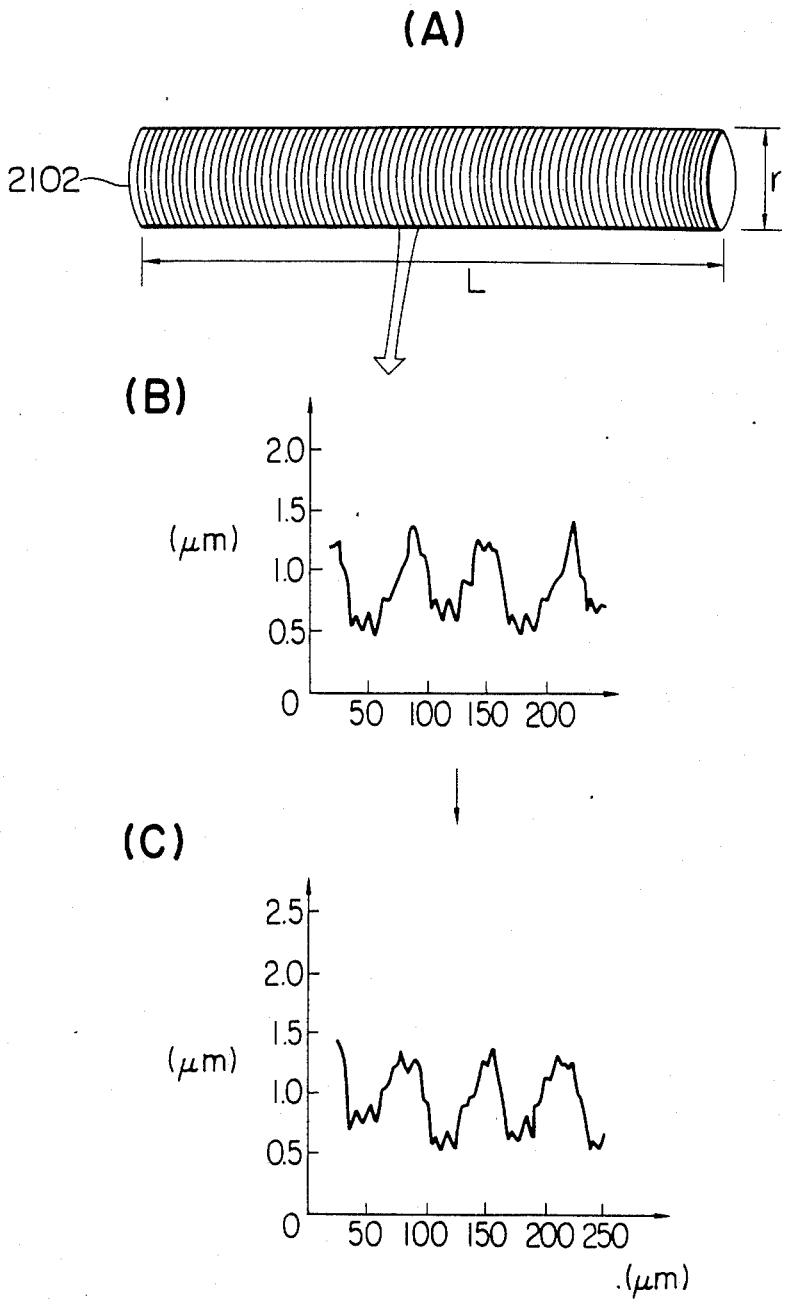

In this Example, a semiconductor laser (wavelength: 780 nm) with a spot size of 80 μm was employed. Thus, in order to deposit A-Si:H, a cylindrical aluminum substrate [length (L) 357 mm, outerdiameter(r) 80 mm] having the surface characteristic as shown in FIG. 65 (B) was prepared.

Next, under the conditions as shown in Table 1aC, by means of the film deposition device as shown in FIG. 63, A-Si type light-receiving members for electrophotography having surface layers formed thereon were prepared following predetermined procedures.

NO gas was introduced by setting the mass flow controller so that the initial value of its flow rate might be 3.4 Vol. % based on the sum of the $SiH_4$ gas flow rate and the $GeH_4$ gas flow rate.

On the other hand, the surface layers were formed by placing plate targets of various kinds of materials as shown in Table 1A (thickness 3 mm) ($ZrO_2$ in this Example) over the entire surface of the cathode in the film deposition device as shown in FIG. 20, replacing $H_2$ gas employed in formation of the first layer and the second layer with Ar gas, evacuating the device internally to about $5\times10^{-6}$ Torr, then introducing Ar gas into the device, exciting glow discharging at a high frequency power of 300 W and sputtering $ZrO_2$ on the cathode. In the following Examples, formation of the surface layer was conducted in the same manner as in this Example except for changing the material for formation of the surface layer.

In this case, as shown in FIG. 65 (B) and (C), the surface of the substrate and the surface of the light-receiving layer were non-parallel to each other.

For the light-receiving member for electrophotography as described above, image exposure was effected by means of the device shown in FIG. 26 with a semiconductor laser of a wavelength 780 nm with a spot size of 80 μm, followed by developing and transfer to obtain an image.

In this case, no interference fringe pattern was observed in the image obtained to give a member exhibiting practically satisfactory electrophotographic characteristics.

EXAMPLE 19

The surfaces of cylindrical aluminum substrates were worked as shown in FIG. 81 and FIG. 82. On these cylindrical aluminum substrates, light-receiving members for electrophotography were prepared under the same conditions as in Example 18.

When image exposure was effected on these light-receiving members with a semiconductor laser with wavelength of 780 nm and a spot diamerer of 80 μm by means of the device of FIG. 26 similarly as in Example 18, no interference image was observed in the image obtained to give a member exhibiting practically satisfactory electrophotographic characteristics.

EXAMPLE 20

Light-receiving members werd prepared under the same conditions as in Example 19 except for the following point. The layer thickness of the first layer in these light-receiving members was made 10 μm.

When image exposure was effected on these light-receiving members with a semiconductor laser with wavelength of 780 nm and a spot diameter of 80 μm by means of the device of FIG. 26 similarly as in Example 18, no interference image was observed in the image obtained to give a member exhibiting practically satisfactory electrophotographic characteristics.

EXAMPLE 21

On cylindrical aluminum substrates having the surface characteristics as shown in FIG. 81 and FIG. 82, light-receiving members for electrophotography were prepared under the conditions shown in Table 1C.

The cross-sections of the light-receiving members prepared under the above conditions were observed by an electron microscope. As the result, the average layer thickness of the first layer was found to be 0.09 μm at the center and both ends of the cylinder. The average layer thickness of the second layer was found to be 3 μm at the center and both ends of the cylinder.

When image exposure was effected on these light-receiving members with a semiconductor laser with wavelength of 780 nm and a spot diameter of 80 μm by means of the device of FIG. 26 similarly as in Example 18, no interference fringe pattern was observed in the image obtained to give a member exhibiting practically satisfactory electrophotographic characteristics.

EXAMPLE 22

On cylindrical aluminum substrates having the surface characteristics as shown in FIG. 81 and FIG. 82, light-receiving members for electrophotography were prepared under the conditions shown in Table 2C.

When image exposure was effected on these light-receiving members with the laser beam similarly as in Example 18, no interference fringe pattern was observed in the image obtained to give a member exhibiting practically satisfactory electrophotographic characteristics.

EXAMPLE 23

On cylindrical aluminum substrates having the surface characteristics as shown in FIG. 81 and FIG. 82, light-receiving members for electrophotography were prepared under the conditions shown in Table 3C.

When image exposure was effected on these light-receiving members with the laser beam similarly as in Example 18, no interference fringe pa was observed in the image obtained to give a exhibiting practically satisfactory electrophotographic characteristics.

EXAMPLE 24

Figure 8:
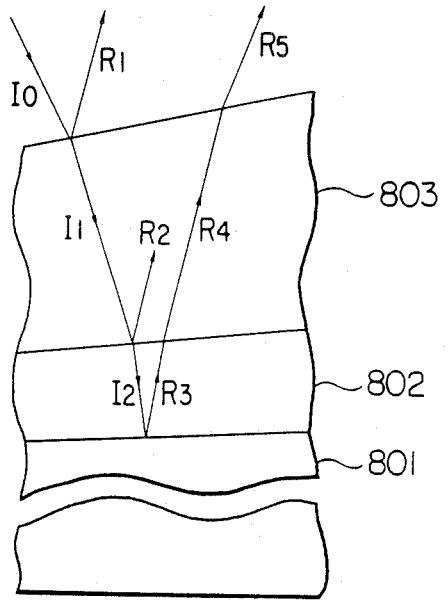
FIG. 8 is a schematic illustration of no appearance of interference fringe in the case of non-parallel interfaces between respective layers.

On cylindrical aluminum substrates having the surface characteristics as shown in FIG. 8 and FIG. 82, light-receiving members for electrophotography were prepared under the conditions shown in 4C.

When image exposure was effected on these light-receiving members with the laser beam similarly in Example 18, no interference fringe was observed in the image obtained to give a member exhibiting practically satisfactory electrophotographic characteristics.

EXAMPLE 25

During formation of the first layer, the NO gas flow rate ratio was varied as shown in FIG. 49 relative to the sum of the $SiH_4$ gas flow rate and $GeH_4$ gas flow rate until the NO gas flow rate was made zero on completion of the layer preparation, following otherwise the same conditions as in Example 18, to prepare a light-receiving member for electrophotography.

The light-receiving member obtained was subjected to image exposure by means of the device shown in FIG. 26 with a semiconductor laser with wavelength of 780 nm and a spot diameter of 80 μm, followed by developing and transfer to an image.

In this case, the obtained image free from any interference fringe pattern observed exhibited practically satisfactory electrophotography charactersitics.

EXAMPLE 26

The surfaces of cylindrical alumin substrates were worked as shown in FIG. 81 and FIG. 82. On these cylindrical aluminum substrates, light-receiving members for electrophotography were prepared under the same conditions as in Example 25.

When image exposure was effected on these light-receiving members with a semiconduct laser with wavelength of 780 nm and a spot diameter of 80 μm by means of the device of FIG. 26 similarly as in Example 25, no interference fringe pattern was observed in the image obtained to give a member exhibiting practically satisfactory electrophotographic characteristics.

EXAMPLE 27

Light-receiving members were prepared under the same conditions as in Example 26 except for the following point. The layer thickness of the first layer in these light-receiving members was 10 μm.

When image exposure was effected on these light-receiving members with the laser beam similarly as in Example 18, no interference fringe pattern was observed in the image obtained to give a member exhibiting practically satisfactory electrophotographic characteristics.

EXAMPLE 28

On cylindrical aluminum substrates the surface characteristics as shown in FIG. 81 and FIG. 82, light-receiving members for electrophotography were prepared under the conditions shown in Table 5C.

When image exposure was effected on these light-receiving members with the laser beam similarly as in Example 18, no interference fringe pattern was observed in the image obtained to give a member exhibiting practically satisfactory electrophotographic characteristics.

EXAMPLE 29

On cylindrical aluminum substrates having the surface characteristics as shown in FIG. 81 and FIG. 82, light-receiving members for electrophotography were prepared under the conditions shown in Table 6C.

When image exposure was effected on these light-receiving members with the laser beam similarly as in Example 18, no interference fringe pattern was observed in the image obtained to give a member exhibiting practically satisfactory electrophotographic characteristics.

EXAMPLE 30

On cylindrical aluminum substrates having the surface characteristics as shown in FIG. 81 and FIG. 82, light-receiving members for electrophotography were prepared under the conditions shown in Table 7C.

When image exposure was effected these light-receiving members with the laser beam similarly as in Example 18, no interference fringe pattern was observed in the image obtained to give a exhibiting practically satisfactory electrophotographic characteristics.

EXAMPLE 31

On cylindrical aluminum substrates having the surface characteristics as shown in FIG. 81 and FIG. 82, light-receiving members for electrophotography were prepared under the conditions shown in Table 8C.

When image exposure was effected on these light-receiving members with the laser beam similarly as in Example 18, no interference fringe was observed in the image obtained to give a member exhibiting practically satisfactory electrophotographic characteristics.

EXAMPLE 32

By means of the preparation device as shown in FIG. 63, on cylindrical aluminum substrates (Cylinder B), layer formation was conducted by varying the gas flow rate ratio of NO to $SiH_4$ according to the change rate curve of gas flow rate ratio as shown in FIG. 66 through 69 under the respective conditions as shown in Table 9C through 12C with lapse of time for layer formation, to prepare light-receiving members for electrophotography, respectively. However, the surface layers were formed with the use of $ZrO_2$ similarly as in Example 18.

The characteristic evaluations were performed for the respective light-receiving members thus obtained under the same conditions and by the same means as in Example 18, with the result that no interference fringe pattern was observed with naked eyes at all and satisfactorily good electrophotographic characteristics were exhibited to be suited for the object of the present invention.

EXAMPLE 33

By means of the preparation device as shown in FIG. 63, on cylindrical aluminum substrates [having the surface characteristic as shown in FIG. 65 (B)], layer formation was conducted by varying the gas flow rate ratio of NO to $SiH_4$ according to the change rate curve of gas flow rate ratio as shown in FIG. 66 under the conditionsas shown in Table 13C with lapse of time for layer formation, to prepare light-receiving members for electrophotography, respectively. However, the surface layers were formed with the use of $ZrO_2$ similarly as in Example 18.

The characteristic evaluations were performed for the respective light-receiving members thus obtained under the same conditions and by the same means as in Example 18, with the result that no interference fringe pattern was observed with naked eyes at all and satisfactorily good electrophotographic characteristics were exhibited to be suited for the object of the present invention.

EXAMPLE 34

By means of the preparation device as shown in FIG. 63, on cylindrical aluminum substrates [having the surface characteristic as shown in FIG. 65 (B)], layer formation was conducted by varying the gas flow rate ratio of $NH_3$ to $SiH_4$ and $CH_4$ to $SiH_4$ according to the change rate curve of gas flow rate ratio as shown in FIG. 68 under the respective conditions as shown in Table 14C and Table 15C with lapse of time for layer formation, to prepare light-receiving members for electrophotography, respectively. However, the surface layers were formed with the use of $ZrO_2$ similarly as in Example 18.

The characteristic evaluations were performed for the respective light-receiving members thus obtained under the same conditions and by the same means as in Example 18, with the result that no interference fringe pattern was observed with naked eyes at all and satisfactorily good electrophotographic characteristics were exhibited to suited for the object of the present invention.

EXAMPLE 35

By means of the device as shown in FIG. 63, 20 a-Si type light-receiving members for electrophotography were prepared following the same conditions and procedure as in Example 18, except for using various kinds of materials and layer thicknesses according to the conditions shown in Table 1A for the surface layer materials on the cylindrical aluminum substrates shown in FIG. 65 (B) (Sample No. 2701C–2720C).

For these light-receiving members for electrophotography, image exposure was effected by means of the image forming device as shown in FIG. 26 (wavelength of laser beam: 780 nm, spot diameter 80 μm), followed by developing and transfer, to obtain an image. In none of the images obtained, no interference fringe pattern was observed, thus giving practically satisfactory results.

EXAMPLE 36

By means of a lathe, an aluminum substrate (length (L): 357 mm, outerdiameter (r): 80 mm) was worked to have the surface characteristic as shown in FIG. 65 (B).

Next, an a-Si type light-receiving member for electrophotography was prepared following predetermined procedure using the deposition device as shown in FIG. 63 under the conditions as shown in Table 1D.

Figure 22:
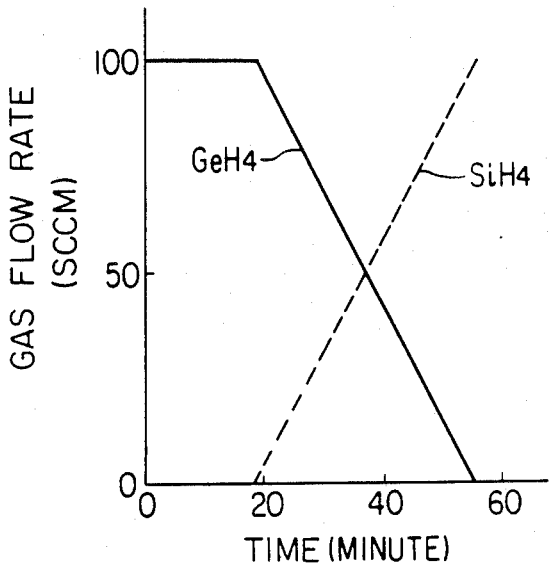
FIGS. 22 through 25, FIGS. 36 through 42, FIGS. 52 through 62, FIGS. 66 through 79 are schematic illustrations of the changes in gas flow rates of the respective gases in Examples.

In preparation of the first layer, the mass flow controllers 2008 and 2007 for $GeH_4$ and $SiH_4$ were controlled by a computer (HP9845B) so that the flow rates of $GeH_4$ and $SiH_4$ might be as shown in FIG. 22. Deposition of the surface layer was carried out with the use of $ZrO_2$ target similarly as in the case of Example 18.

The surface state of the light-receiving member for electrophotography of A-Si:H thus prepared was as shown in FIG. 65(C). In this case, the difference in average layer thickness between the center and the both ends of the aluminum substrate was found to be 2 μm.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference pattern observed and proved to be satisfactory for practical application.

EXAMPLE 37

Example 36 was repeated except that $TiO_2$ was employed as the surface layer material and conditions as shown in Table 2D were employed, by means of the film deposition device as shown in FIG. 63, following various procedures to prepare a-Si type light-receiving members for electrophotography.

Figure 23:
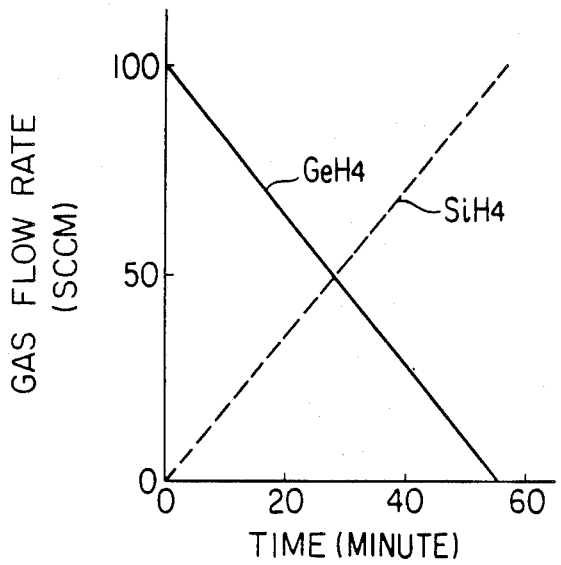

In preparation of the first layer, the mass flow controllers 2008 and 2007 for $GeH_4$ an $SiH_4$ were controlled by a computer (HP9845B) so that the flow rates of $GeH_4$ and $SiH_4$ might be as shown in FIG. 23.

The light-receiving member for electrophotography as prepared above was subjected to image exposure by means of a device as shown in FIG. 26 (wavelength of laser beam: 780 nm, spot diameter 80 μm) similarly as in Example 36, followed by development and transfer to obtain an image. The image was free from any interference fringe pattern observed and proved to be satisfactory for practical application.

EXAMPLE 38

Example 36 was repeated except that $CeO_2$ was employed as the surface layer material and the conditions as shown in Table 3D were employed, by means of the film deposition device as shown in FIG. 63, following various procedures to prepare a-Si type light-receiving members for electrophotography.

Figure 24:
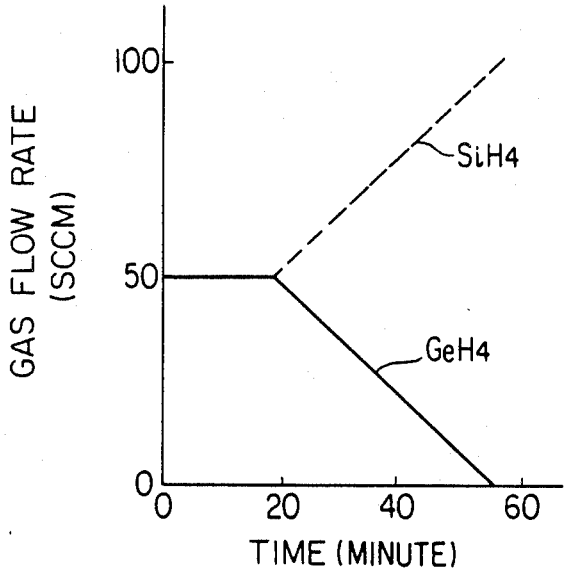

In preparation of the first layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

The light-receiving member for electrophotography as prepared above was subjected to image exposure by means of a device as shown in FIG. 26 (wavelength of laser beam: 780 nm, spot diameter 80 μm) similarly as in Example 36, followed by development and transfer to obtain an image. The image was free from any interference fringe pattern observed and proved to be satisfactory for practical application.

EXAMPLE 39

Aluminum substrates (length (L) 357 mm, outerdiameter (r) 80 mm) were worked by a lathe to the three kinds of surface characteristics shown in FIG. 65 (B), FIG. 81 and FIG. 82.

Next, Example 36 was repeated except that ZnS was employed as the surface layer material and the conditions as shown in Table 4D were employed, by means of the film deposition device as shown in FIG. 63, following various procedures to prepare a-Si type light-receiving members for electrophotography.

Figure 25:
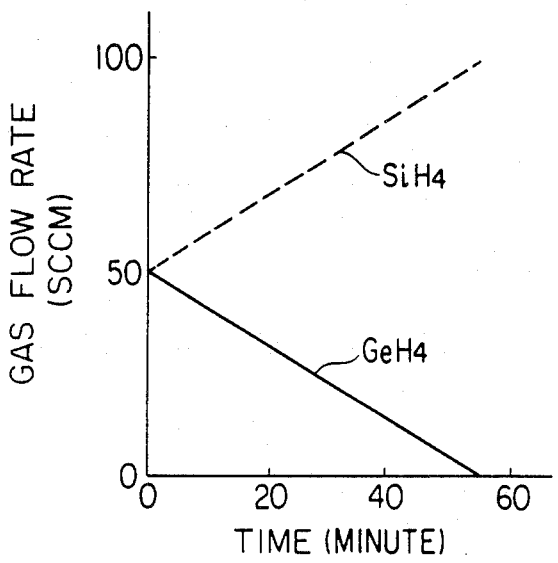

In preparation of the first layer, the mass flow controllers 2008 and 2007 for $GeH_4$ an $SiH_4$ were controlled by a computer (HP9845B) so that the flow rates of $GeH_4$ and $SiH_4$ might be as shown in FIG. 25.

The light-receiving members for electrophotography as prepared above were subjected to image exposure by means of a device as shown in FIG. 26 (wavelength of laser beam: 780 nm, spot diameter 80 μm) similarly as in Example 36, followed by development and transfer to obtain images. All of the images obtained were free from any interference fringe pattern observed and proved to be satisfactory for practical application.

$NH_3$ gas employed in Example 39 was changed to NO gas, following otherwise the same conditions and procedure as in Example 39 to prepare a-Si type light-receiving members for electrophotography.

For the light-receiving members for electrophotography, image exposure was effected by means of an image forming device as shown in FIG. 26 (wavelength of laser beam: 780 nm, spot diameter: 80 μm), followed by development and transfer to obtain image. All the images obtained were found to be free from any interference fringe pattern and satisfactory for practical application.

EXAMPLE 41

$NH_3$ gas employed in Example 39 was changed to $CH_4$ gas, following otherwise the same conditions and procedure as in Example 39 to prepare a-Si type light-receiving members for electrophotography.

For the light-receiving members for electrophotography, image exposure was effected by means of an image forming device as shown in FIG. 26 (wavelength of laser beam: 780 nm, spot diameter: 80 μm), followed by development and transfer to obtain images. All the images obtained were found to be free from any interference fringe pattern and satisfactory for practical application.

EXAMPLE 42

Figure 70:
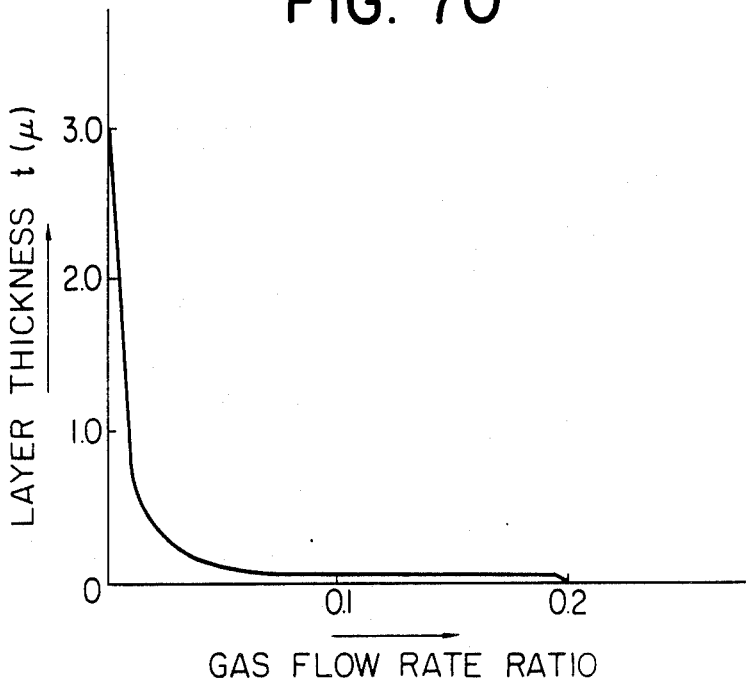

Aluminum substrates (length (L) 357 mm, outerdiamter (r) 80 mm) were worked by a lathe to the surface characteristic as shown in FIG. 65 (B), and light-receiving members were prepared by means of the film deposition device of FIG. 63 under the same conditions as in Example 36 except for changing the NO gas flow rate ratio with layer forming time according to the change rate curve of the gas flow rate ratio as shown in FIG. 70 under the conditions as shown in Table 5D.

For the light-receiving members for electrophotography, image exposure was effected by means of an image forming device as shown in FIG. 26 (wavelength of laser beam: 780 nm, spot diameter: 80 μm), followed by development and transfer to obtain images. All the images obtained were found to be free from any interference fringe pattern and satisfactory for practical application.

EXAMPLE 43

Figure 71:
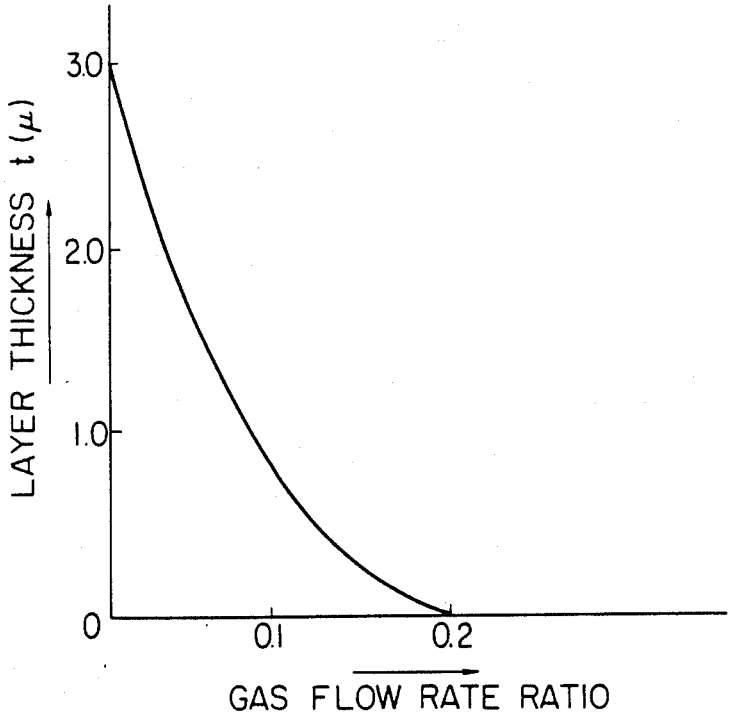

Aluminum substrates (length (L) 357 mm, outerdiameter (r) 80 mm) were worked by a lathe to the surface characteristic as shown in FIG. 65 (B), and light-receiving members were prepared by means of the film deposition device of FIG. 63 under the same conditions as in Example 36 except for changing the $NH_3$ gas flow rate ratio with layer forming time according to the change rate curve of the gas flow rate ratio as shown in FIG. 71 under the conditions as shown in Table 6D.

For the light-receiving members for electrophotography, image exposure was effected by means of an image forming device as shown in FIG. 26 (wavelength of laser beam: 780 nm, spot diameter: 80 μm), followed by development and transfer to obtain images. All the images obtained were found to be free from any interference fringe pattern and satisfactory for practical application.

EXAMPLE 44

Figure 58:
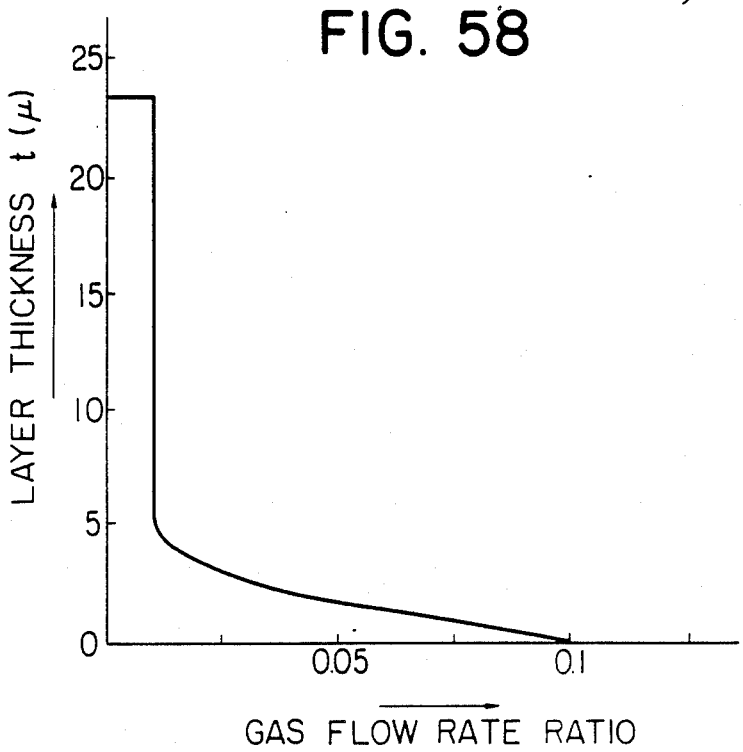

Aluminum substrates (length (L) 357 mm, outerdiameter (r) 80 mm) were worked by a to the surface characteristic as shown in FIG. 65 (B), and light-receiving members were prepared by means of the film deposition device of FIG. 63 under the same conditions as in Example 36 except for changing the NO gas flow rate ratio with layer forming time according to the change rate curve of the gas flow rate ratio as shown in FIG. 58 under the conditions as shown in Table 7D.

For the light-receiving members for electrophotography, image exposure was effected by means of an image forming device as shown in FIG. 26 (wavelength of laser beam: 780 nm, spot diameter: 80 μm), followed by development and transfer to obtain images. All the images obtained were found to be free any interference fringe pattern and satisfactory for practical application.

EXAMPLE 45

NO gas employed in Example 44 was changed to $NH_3$ gas, following otherwise the same conditions and procedure as in Example 44 to prepare a-Si type light-receiving members for electrophotography.

For the light-receiving members for electrophotography, image exposure was effected by means of an image forming device as shown in FIG. 26 (wavelength of laser beam: 780 nm, spot diameter: 80 μm), followed by development and transfer to obtain images. All the images obtained were found to be free from any interference fringe pattern and satisfactory for practical application.

EXAMPLE 46

NO gas employed in Example 44 was changed to $CH_4$ gas, following otherwise the same conditions and procedure as in Example 44 to prepare a-Si type light-receiving members for electrophotography.

For the light-receiving members for electrophotography, image exposure was effected by means of an image forming device as shown in FIG. 26 (wavelength of laser beam: 780 nm, spot diameter: 80 μm) followed by developing and transfer to obtain images. All the images obtained were found to be free from any interference fringe pattern and satisfactory for practical application.

EXAMPLE 47

Figure 72:
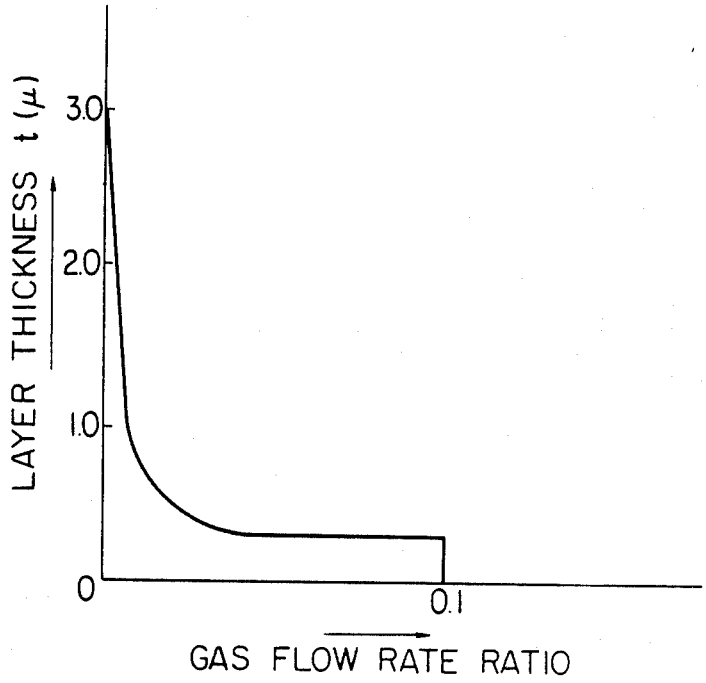

Aluminum substrates (length (L) 357 mm, outerdiameter (r) 80 mm) were worked by a lathe to the surface characteristic as shown in FIG. 65 (B), and light-receiving members were prepared by means of the film deposition device of FIG. 63 under the same conditions as in Example 36 except for changing the $CH_4$ gas flow rate ratio with layer forming time according to the change rate curve of the gas flow rate ratio as shown in FIG. 72 under the conditions as shown in Table 8D.

For the light-receiving members for electrophotography, image exposure was effected by means of an image forming device as shown in FIG. 26 (wavelength of laser beam: 780 nm, spot diameter: 80 μm) followed by developing and transfer to obtain images. All the images obtained were found to be free from any interference fringe pattern and satisfactory for practical application.

EXAMPLE 48

By use of aluminum substrates (length (L) 357 mm, outerdiameter (r) 80 mm) worked by a lathe to the surface characteristic as shown in FIG. 65 (B), with the surface layer material and the layer thickness being changed to those as shown in Table 1A, following otherwise the same conditions as in Example 36, a-Si type light-receiving members for electrophotography were prepared (Sample Nos. 2701D–2720D).

For the light-receiving members for electrophotography, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

EXAMPLE 49

By means of a lathe, an aluminum substrate (length (L): 357 mm, outerdiameter (r): 80 mm) was worked to have the surface characteristic as shown in FIG. 65 (B).

Next, an a-Si type light-receiving member for electrophotography was prepared following predetermined procedure using the deposition device as shown in FIG. 20 under the conditions as shown in Table 1E. The surface layer was formed with the use of $ZrO_2$ target similarly as in the case of Example 18.

The surface state of the light-receiving member for electrophotography of A-si:H thus prepared was as shown in FIG. 65 (C). In this case, the difference in average layer thickness between the center and the both ends of the aluminum substrate was found to be 2 μm.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference pattern observed and proved to be satisfactory for practical application.

EXAMPLE 50

Example 49 was repeated except that the conditions as shown in Table 2E were employed, by means of the film deposition device as shown in FIG. 63, following various procedures to prepare a-Si type light-receiving members for electrophotography.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 51

Example 49 was repeated except that $TiO_2$ was employed as the surface layer meterial and the conditions as shown in Table 3E were employed, by means of the film deposition device as shown in FIG. 63, following various procedures to prepare a-Si type light-receiving members for electrophotography.

The light-receiving member for electrophotography as prepared above was subjected to image exposure by means of a device as shown in FIG. 26 (wavelength of laser beam: 780 nm, spot diameter 80 μm) similarly as in Example 49, followed by development and transfer to obtain an image. The image was free from any interference fringe pattern observed and proved to be satisfactory for practical application.

EXAMPLE 52

Aluminum substrates (length (L) 357 mm, outerdiameter (r) 80 mm) were worked by a lathe to the three kinds of surface characteristics as shown in FIG. 65 (B), FIG. 81 and FIG. 82.

Next, Example 51 was repeated except that the conditions as shown in Table 4E were employed, by means of the film deposition device as shown in FIG. 63, following various procedures to prepare a-Si type light-receiving members for electrophotography. The surface layer was formed in the same manner as in Example 51.

The light-receiving members for electrophotography as prepared above were subjected to image exposure by means of a device as shown in FIG. 26 (wavelength of laser beam: 780 nm, spot diameter 80 μm), followed by developement and transfer to obtain images. All the images obtained were free from any interference fringe pattern observed and proved to be satisfactory for practical application.

EXAMPLE 53

Aluminum substrates (length (L) 357 mm, outerdiameter (r) 80 mm) were worked by a lathe to the three kinds of surface characteristics as shown in FIG. 65 (B), FIG. 81 and FIG. 82.

Next, Example 52 was repeated except that $CeO_2$ was employed as the surface layer material and the conditions as shown in Table 5E were employed, by means of the film deposition device as shown in FIG. 63, following various procedures to prepare a-Si type light-receiving members for electrophotography.

The light-receiving members for electrophotography as prepared above were subjected to image exposure by means of a device as shown in FIG. 26 (wavelength of laser beam: 780 nm, spot diameter 80 μm), followed by development and transfer to obtain images. All of the images obtained were free from any interference fringe pattern observed and proved to be satisfactory for practical application.

EXAMPLE 54

Aluminum substrates (length (L) 357 mm, outerdiameter (r) 80 mm) were worked by a lathe to the three kinds of surface characteristics as shown in FIG. 65 (B), FIG. 81 and FIG. 82.

Next, Example 52 was repeated except that ZnS was employed as the surface layer material and the conditions as shown in Table 6E were employed, by means of the film deposition device as shown in FIG. 63, following various prdcedures to prepare a-Si type light-receiving members for electrophotography.

The light-receiving members for electrophotography as prepared above were subjected to image exposure by means of a device as shown in FIG. 26 (wavelength of laser beam: 780 nm, spot diameter 80 μm), followed by development and transfer to obtain images. All of the images obtained were free from any interference fringe pattern observed and proved to be satisfactory for practical application.

EXAMPLE 55

An aluminum substrate (length (L) 357 mm, outerdiameter (r) 80 mm) was worked by a lathe to the surface characteristic as shown in FIG. 65 (B).

Next, by use of this substrate, Example 49 was repeated except that $Al_2O_3$ was employed as the surface layer material and the conditions as shown in Table 7E were employed, by means of the film deposition device as shown in FIG. 63, following various procedures to prepare a-Si type light-receiving members for electrophotography.

Figure 73:
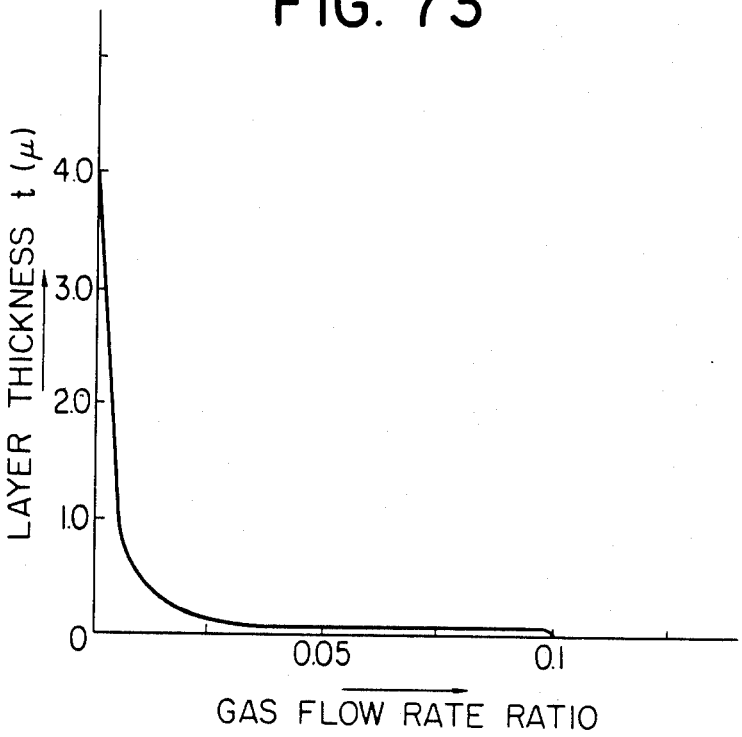

In preparation of the first layer, the flow rate ratio of $CH_4$ gas relative to $SiH_4$ gas and $GeH_4$ gas was controlled so as to become as shown in FIG. 73 by controlling the mass flow controller 2009 for $CH_4$ gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 56

An aluminum substrate (length (L) 357 mm, outerdiameter (r) 80 mm) was worked by a lathe to the surface characteristic as shown in FIG. 65 (B).

Next, by use of this substrate, Example 49 was repeated except that $CeF_3$ was employed as the surface layer material and the conditions as shown in Table 8E were employed, by means of the film deposition device as shown in FIG. 63, following various procedures to prepare a-Si type light-receiving members for electrophotography.

Figure 74:
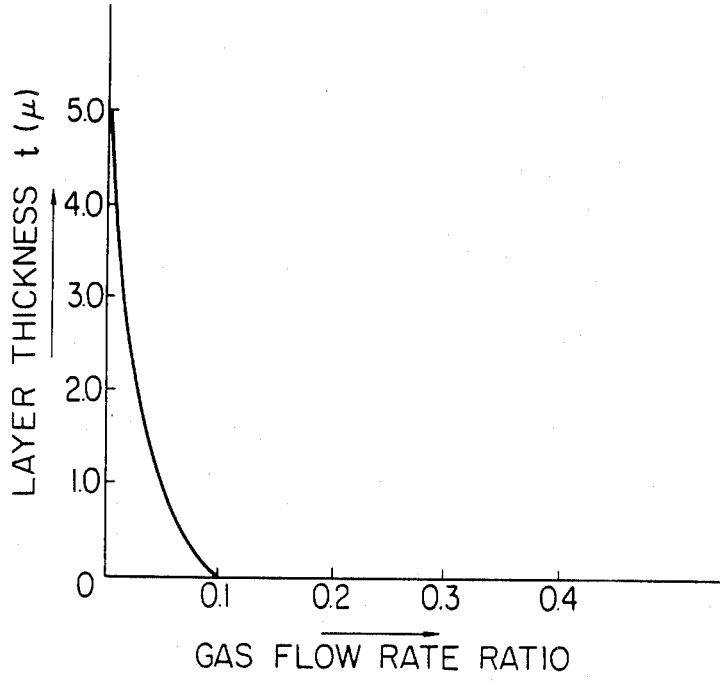

In preparation of the first layer, the flow rate ratio of NO gas relative to the sum of $GeH_4$ gas and $SiH_4$ gas was controlled so as to become as shown in FIG. 74 by controlling the mass flow controller 2009 for NO gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 57

An aluminum substrate (length (L) 357 mm, outerdiameter (r) 80 mm) was worked by a lathe to the surface characteristic as shown in FIG. 65 (B).

Next, by use of this substrate, Example 49 was repeated except that $MgF_2$ was employed as the surface layer material and the conditions as shown in Table 9E were employed, by means of the film deposition device as shown in FIG. 63, following various procedures to prepare light-receiving members for electrophotography.

Figure 57:
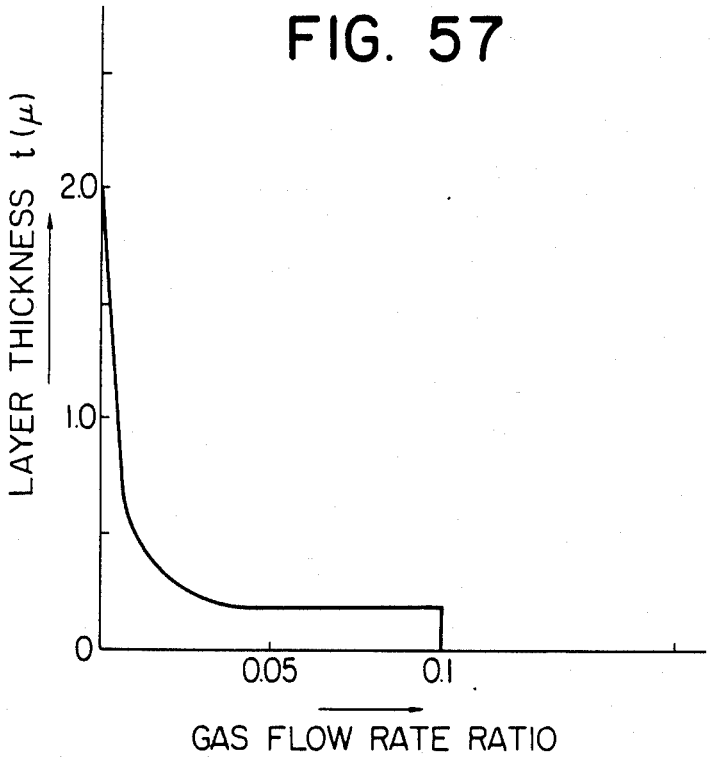

In preparation of the first layer, the flow rate ratio of $NH_3$ gas relative to the sum of $GeH_4$ gas and $SiH_4$ gas was controlled so as to become as shown in FIG. 57 by controlling the mass flow controller 2009 for $NH_3$ gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 58

An aluminum substrate (length (L) 357 mm, outerdiameter (r) 80 mm) was worked by a lathe to the surface characteristic as shown in FIG. 65 (B).

Next, by use of this substrate, Example 49 was repeated except that $MgF_2$ was employed as the surface layer material and the conditions as shown in Table 10E were employed, by means of the film deposition device as shown in FIG. 63, following various procedures to prepare light-receiving members for electrphotography.

Figure 75:
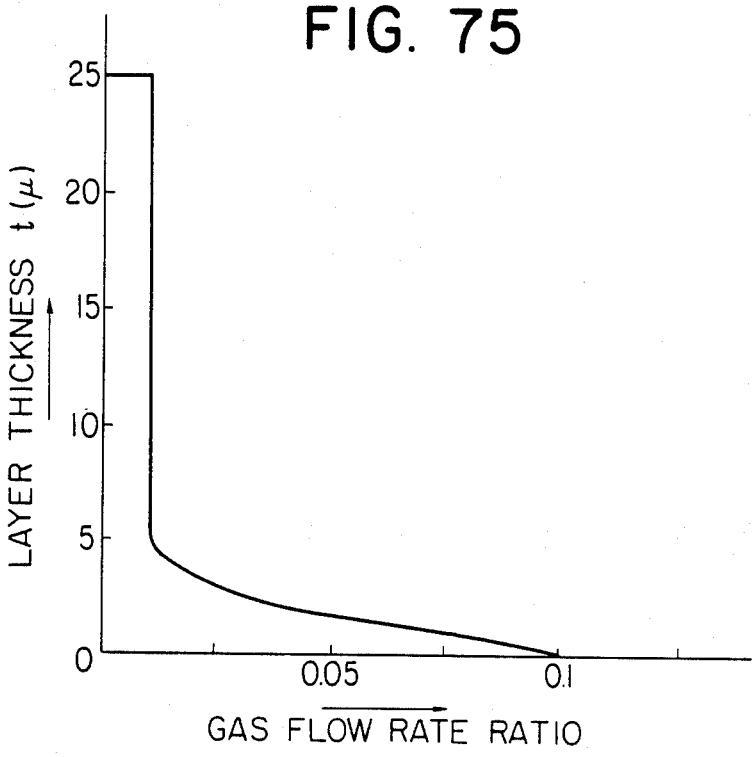

In preparation of the first layer, the flow rate ratio of $CH_4$ gas relative to the sum of $GeH_4$ gas and $SiH_4$ gas was controlled so as to become as shown in FIG. 75 by controlling the mass flow controller 2009 for $CH_4$ gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain images. The image obtained were free from any interference fringe pattern observed and proved to be satisfactory for practical application.

EXAMPLE 59

An aluminum substrate (length (L) 357 mm, outerdiameter (r) 80 mm) was worked by a lathe to the surface characteristic as shown in FIG. 65 (B).

Next, by use of this substrate, Example 49 was repeated except that a mixture of $ZrO_2$ and $TiO_2$ at a weight ratio of 6:1 was employed as the surface layer material and the conditions as shown in Table 11E were employed, by means of the film deposition device as shown in FIG. 63, following various procedures to prepare light-receiving members for electrophotography.

Figure 76:
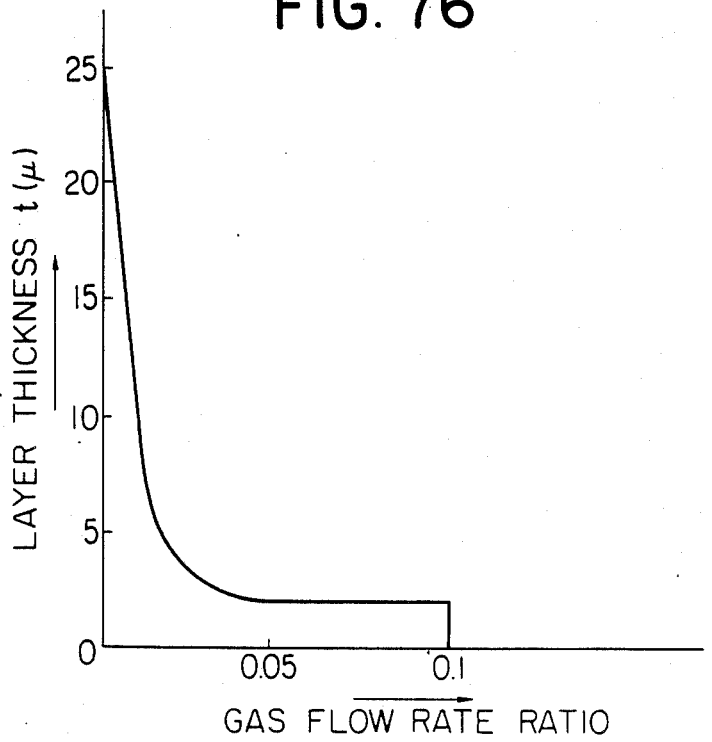

In preparation of the first layer, the flow rate ratio of NO gas relative to the sum of $GeH_4$ gas and $SiH_4$ gas was controlled so as to become as shown in FIG. 76 by controlling the mass flow controller 2009 for NO gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 60

An aluminum substrate (length (L) 357 mm, outerdiameter (r) 80 mm) was worked by a lathe to the surface characteristic as shown in FIG. 65 (B).

Next, by use of this substrate, Example 49 was repeated except that a mixture of $Al_2O_3$ and $ZrO_2$ at a weight ratio of 1:1 was employed as the surface layer material and the conditions as shown in Table 12E were employed, by means of the film deposition device as shown in FIG. 63, following various procedures to prepare light-receiving members for electrophotography.

Figure 77:
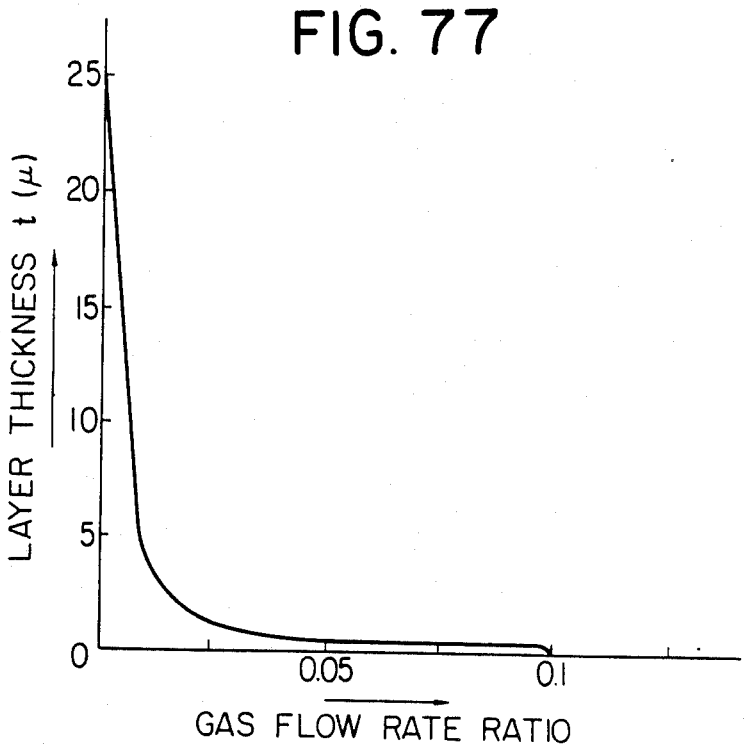

In preparation of the first layer, the flow rate ratio of $NH_3$ gas relative to the sum of $GeH_4$ gas and $SiH_4$ gas was controlled so as to become as shown in FIG. 77 by controlling the mass flow controller 2009 for $NH_3$ gas by a computer (HP9845B).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 61

An aluminum substrate (length (L) 357 mm, outerdiameter (r) 80 mm) was worked by a lathe to the surface characteristic as shown in FIG. 65 (B).

Next, by use of this substrate, Example 49 was repeated except that $MgF_2$ was employed as the surface layer material and the conditions as shown in Table 13E were employed, by means of the film deposition device as shown in FIG. 63, following various procedures to prepare light-receiving members for electrophotography.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image obtained was free from any interference fringe pattern observed and proved to be satisfactory for practical application.

EXAMPLE 62

An aluminum substrate (length (L) 357 mm, outerdiameter (r) 80 mm) was worked by a lathe to the surface characteristic as shown in FIG. 65 (B).

Next, by use of this substrate, Example 49 was repeated except that the conditions as shown in Table 14E were employed, by means of the film deposition device as shown in FIG. 63, following various procedures to prepare light-receiving members for electrophotography.

The light-receiving member for electrophotography as prepared above was subjected to image exposure by means of a device as shown in FIG. 26 (wavelength of laser beam; 780 nm, spot diameter 80 μm), followed by development and transfer to obtain an image. The image obtained was free from any interference fringe pattern observed and proved to be satisfactory for practical application.

EXAMPLE 63

Examples 49 to 62 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as in Examples 49 to 62.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

EXAMPLE 64

By use of aluminum substrates (length (L) 357 mm, outerdiameter (r) 80 mm) worked by a lathe to the surface characteristic as shown in FIG. 65 (B), with the surface layer material and the layer thickness being changed to those as shown in Table 1A, following otherwise the same conditions as in Example 49, light-receiving members for electrophotography were prepared by means of the film deposition device, following various procedures (Sample Nos. 2701E–2720E).

For the light-receiving members for electrophotography, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

EXAMPLE 65

By means of a lathe, an aluminum substrate (length (L): 357 mm, outerdiameter (r): 80 mm) was worked to have the surface characteristic as shown in FIG. 65 (B).

Next, an a-Si type light-receiving member for electrophotography was prepared following predetermined procedures using the deposition device as shown in FIG. 26 under the conditions as shown in Table 1F.

In preparation of the first layer of a-SiGe: H:B:O layer, the mass flow controllers 2007, 2008 and 2010 were controlled by a computer (HP9845B) so that the flow rates of $GeH_4$ and $SiH_4$ might be as shown in FIG. 22. The surface layer was prepared similarly as in the case of Example 18.

The surface state of the light-receiving member thus prepared was as shown in FIG. 65 (C).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 66

Example 65 was repeated except that the mass flow controllers 2008 and 2007 for $GeH_4$ and $SiH_4$ were controlled by a computer (HP9845B) so that the flow rates of $GeH_4$ and $SiH_4$ might be as shown in FIG. 23 in formation of the first layer of a-SiGe:H:B:O layer under the conditions shown in Table 1F, following various procedures by means of the device as shown in FIG. 63, to prepare an a-Si type light-receiving member for electrophotography.

The surface state of the light-receiving member for electrophotography of A-Si:H thus prepared was as shown in FIG. 65 (C).

The light-receiving member for electrophotography as prepared above was subjected to image exposure by means of a device as shown in FIG. 26 (wavelength of laser beam: 780 nm, spot diameter 80 μm), followed by development and transfer to obtain an image.

The image was free from any interference fringe pattern observed and proved to be satisfactory for practical application.

EXAMPLE 67

NO gas employed in Example 93 was changed to $NH_3$ gas, following otherwise the same conditions and procedure as in Example 65 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 68

NO gas employed in Example 65 was changed to $CH_4$ gas, following otherwise the same conditions and procedure as in Example 65 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 69

Example 65 was repeated except that $TiO_2$ was employed as the surface layer material and the conditions as shown in Table 2F were employed, by means of the film deposition device as shown in FIG. 63, following various procedures to prepare a-Si type light-receiving members for electrophtography.

In preparation of the first layer of a-SiGe: H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

The light-receiving member for electrophotography as prepared above was subjected to image exposure by means of a device as shown in FIG. 26 (wavelength of laser beam: 780 nm, spot diameter 80 μm) similarly as in Example 36, followed by development and transfer to obtain an image.

The image was free from any interference fringe pattern observed and proved to be satisfactory for practical application.

EXAMPLE 70

Example 65 was repeated except that $TiO_2$ was employed as the surface layer material and the conditions as shown in Table 2F were employed, by means of the film deposition device as shown in FIG. 63, following various procedures to prepare a-Si type light-receiving members for electrophotography.

In preparation of the first layer of a-SiGe: H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

The light-receiving member for electrophotography as prepared above was subjected to image exposure by means of a device as shown in FIG. 26 (wavelength of laser beam: 780 nm, spot diameter 80 μm) similarly as in Example 36, followed by development and transfer to obtain an image.

The image was free from any interference fringe pattern observed and proved to be satisfactory for practical application.

EXAMPLE 71

$NH_3$ gas employed in Example 69 was changed to NO gas, following otherwise the same conditions and procedure as in Example 69 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 72

$NH_3$ gas employed in Example 69 was changed to $CH_4$ gas, following otherwise the same conditions and procedure as in Example 69 to prepare an a-Si type light-receiving member for electrophotography.

For the light-receiving member for electrophotography, image exposure was effected by means of an image forming device as shown in FIG. 26 (wavelength of laser beam: 780 nm, spot diameter 80 μm), followed by development and transfer to obtain an image.

The image obtained was found to be free from any interference fringe pattern and satisfactory for practical application.

EXAMPLE 73

Example 69 was repeated except that $CeO_2$ was employed as the surface layer material and the conditions as shown in Table 3F were employed, by means of the film deposition device as shown in FIG. 63, following various procedures to prepare a-Si type light-receiving member for electrophotography.

In preparation of the first layer of a-SiGe:H:B:C layer, the mass flow controllers 2008 and 2007 for $GeH_4$ and $SiH_4$ were controlled by a computer (HP 9845B) so that the flow rates of $GeH_4$ and $SiH_4$ might be as shown in FIG. 22.

The flow rate ratio of $CH_4$ gas relative to the sum of $GeH_4$ gas and $SiH_4$ gas was changed according to the change rate curve shown in FIG. 72.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 74

$CH_4$ gas employed in Example 73 was changed to NO gas, following otherwise the same conditions and procedure as in Example 73 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by development and transfer to obtain an image.

The image obtained was found to be free from any interference fringe pattern and satisfactory for practical application.

EXAMPLE 75

$CH_4$ gas employed in Example 73 was changed to $NH_3$ gas, following otherwise the same conditions and procedure as in Example 73 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 76

Example 65 was repeated except that ZnS was employed as the surface layer material and the conditions as shown in Table 4F were employed, by means of the film deposition device as shown in FIG. 63, following various procedures to prepare a-Si type light-receiving members for electrophotography.

In preparation of the first layer of a-SiGe:H:B:O layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

The flow rate ratio of NO gas relative to the sum of $GeH_4$ gas and $SiH_4$ gas was changed according to the change rate curve shown in FIG. 58.

For the light-receiving member for electrophotography, image exposure was effected by means of an image forming device as shown in FIG. 26 (wavelength of laser beam: 780 nm, spot diameter: 80 μm) followed by developing and transfer to obtain an image.

The image obtained was found to be free from any interference fringe pattern and satisfactory for practical application.

EXAMPLE 77

An aluminum substrate (length (L) 357 mm, outer-diameter (r) 80 mm) was worked by means of a lathe to the surface characteristic as shown in FIG. 81.

Next, Example 65 was repeated except that ZnS was employed as the material for the surface layer and the conditions as shown in Table 5F were employed, following various procedures by means of the deposition device as shown in FIG. 63, to prepare light-receiving members for electrophotography.

In preparation of the first layer of a-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

Figure 78:
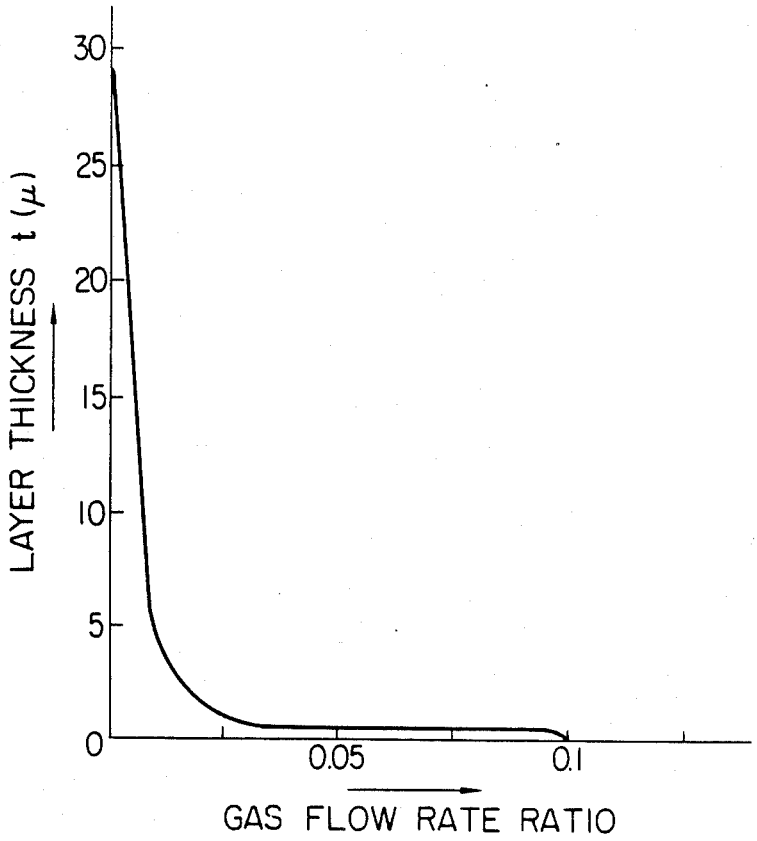

The flow rate ratio of $NH_3$ gas relative to the sum of $GeH_4$ gas and $SiH_4$ gas was changed according to the change rate curve shown in FIG. 78.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 78

An aluminum substrate (length (L) 357 mm, outer-diameter (r) 80 mm) was worked by means of a lathe to the surface characteristic as shown in FIG. 82.

Next, Example 65 was repeated except that ZnS was employed as the material for the surface layer and the conditions as shown in Table 6F were employed, following various procedures by means of the deposition device as shown in FIG. 63, to prepare light-receiving members for electrophotography.

In preparation of the first layer of a-SiGe:H:B:C layer, the mass flow controllers 2008 and 2007 for $GeH_4$ and $SiH_4$ were controlled by a computer (HP9845B) so that the flow rates of $GeH_4$ and $SiH_4$ might be as shown in FIG. 23.

Figure 79:
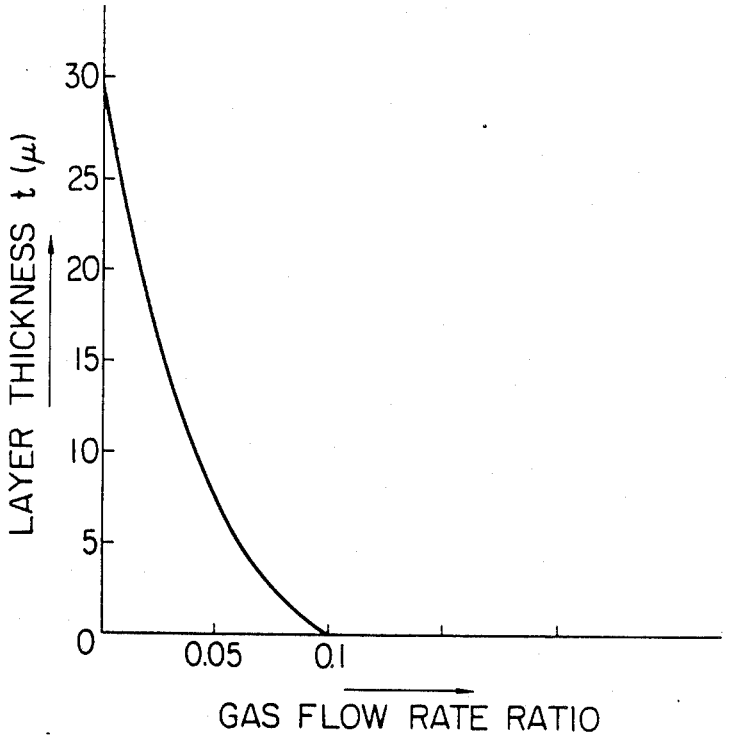

The flow rate ratio of $CH_4$ gas relative to the sum of $GeH_4$ gas and $SiH_4$ gas was changed according to the change rate curve shown in FIG. 79.

For the light-receiving member for electrophotography, image exposure was effected by means of an image forming device as shown in FIG. 26 (wavelength of laser beam: 780 nm, spot diameter: 80 μm), followed by developing and transfer to obtain an image.

The image obtained was found to be free from any interference fringe pattern and satisfactory for practical application.

EXAMPLE 79

Examples 65 to 78 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as in Examples 65 to 78.

For these light-receiving members for electrophotography, image exposure was effected by means of an image exposure device as shown in FIG. 26 (wavelength of laser beam: 780 nm, spot diameter 80 μm), followed by development and transfer, to obtain images.

All of the images were free from interference fringe pattern and practically satisfactory.

EXAMPLE 80

By use of aluminum substrates as employed in Example 65, with the various surface layer materials being as shown in Table 1A, and two surface layer forming time (one being the same as in Example 65, the other being approximately two-fold of Example 65) were employed, following otherwise the same conditions and procedure as in Example 65, a-Si type light-receiving members for electrophotography were prepared (Sample Nos. 2701F–2720F).

For the light-receiving members for electrophotography, image exposure was effected by means of an image forming device as shown in FIG. 26 (wavelength of laser beam: 780 nm, spot diameter 80 μm), followed by developing and transfer to obtain images. All the images obtained were found to be free from any interference fringe pattern and satisfactory for practical application.

EXAMPLE 81

By means of a lathe, an aluminum substrate (length (L): 357 mm, outerdiameter (r): 80 mm) was worked to have the surface characteristic as shown in FIG. 65 (B).

Next, an a-Si type light-receiving member for electrophotography was prepared following predetermined procedures using the deposition device as shown in FIG. 63 under the conditions as shown in Table 1G. The surface layer was formed similarly as in the case of Example 18.

The surface state of the light-receiving member thus prepared was as shown in FIG. 65 (C). In this case, the difference in average layer thickness between the center and the both ends of the aluminum substrate was found to be 2 μm.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 82

Example 81 was repeated except that the conditions as shown in Table 2G were employed, by means of the film deposition device as shown in FIG. 63, following various procedures to prepare a-Si type light-receiving members for electrophotography.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 83

Example 81 was repeated except that $TiO_2$ was employed as the surface layer material and the conditions as shown in Table 3G were employed, by means of the film deposition device as shown in FIG. 63, following various procedures to prepare a-Si type light-receiving members for electrophotography.

The light-receiving member for electrophotography as prepared above was subjected to image exposure by means of a device as shown in FIG. 26 (wavelength of laser beam: 780 nm, spot diameter 80 μm) similarly as in Example 49, followed by development and transfer to obtain an image. The image was free from any interference fringe pattern observed and proved to be satisfactory for practical application.

EXAMPLE 84

Aluminum substrates (length (L) 357 mm, outerdiameter (r) 80 mm) were worked by a lathe to the three kinds of surface characteristics as shown in FIG. 65 (B), FIG. 81 and FIG. 82.

Next, under the conditions as shown in Table 4G, by means of the film deposition device as shown in FIG. 63, following various procedures a-Si type light-receiving members for electrophotography were prepared. The surface layer was formed in the same manner as in Example 83.

The light-receiving members for electrophotography as prepared above were subjected to image exposure by means of a device as shown in FIG. 26 (wavelength of laser beam: 780 nm, spot diameter 80 μm), followed by development and transfer to obtain images. All of the images obtained were free from any interference fringe pattern observed and proved to be satisfactory for practical application.

EXAMPLE 85

$CH_4$ in Example 83 was changed to $NH_3$ gas, following otherwise the same manner as in Example 83 to prepare a-Si type light-receiving members for electrophotography.

For the light-receiving members for electrophogoraphy, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

EXAMPLE 86

NO gas employed in Example 84 was changed to $CH_4$ gas, following otherwise the same manner as in Example 84 to prepare a-Si type light-receiving member for electrophotography.

For the light-receiving members for electrophotography, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

EXAMPLE 87

Aluminum substrates (length (L) 357 mm, outerdiameter (r) 80 mm) were worked by a lathe to the surface characteristic as shown in FIG. 65 (B).

Example 81 was repeated except that $CeO_2$ was employed as the surface layer material and the conditions as shown in Table 5G were employed, by means of the film deposition device as shown in FIG. 63, following various procedures to prepare a-Si type light-receiving members for electrophotography.

Figure 56:
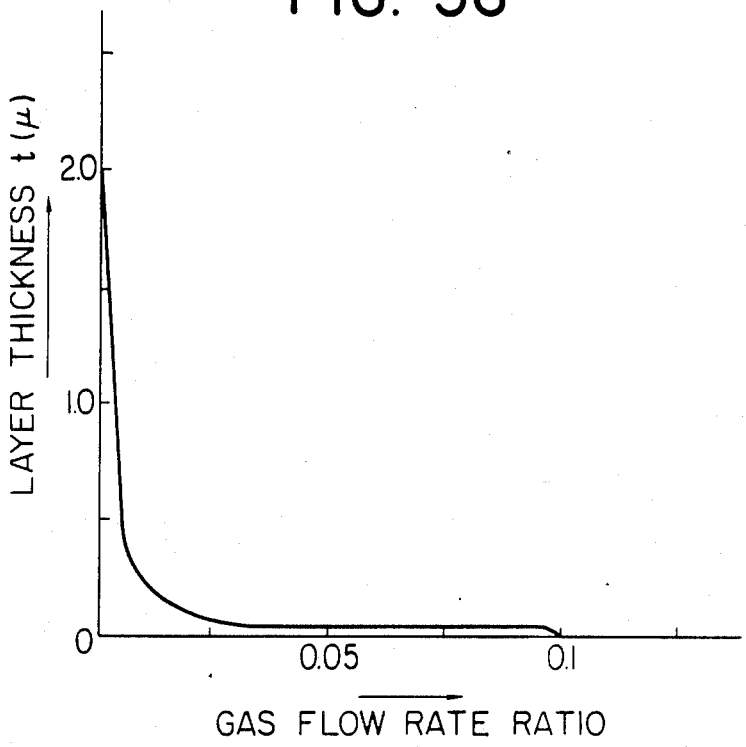
Figure 60:
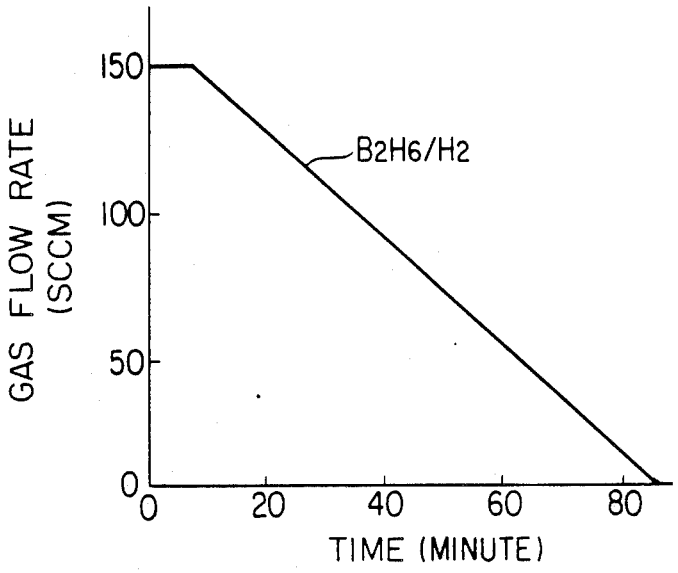

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 60 and the flow rate of $NH_3$ as shown in FIG. 56.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 88

$NH_3$ gas employed in Example 87 was changed to NO gas, following otherwise the same manner as in Example 87 to prepare an a-Si type light-receiving member for electrophotography.

For the light-receiving member for electrophotography, image exposure was effected by means of an image forming device as shown in FIG. 26 (wavelength of laser beam: 7800 nm, spot diameter: 80 μm), followed by developing and transfer to obtain an image. The image obtained was found to be free from any interference fringe pattern and satisfactory for practical application.

EXAMPLE 89

$NH_3$ gas employed in Example 87 was changed to $CH_4$ gas, following otherwise the same manner as in Example 87 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 90

An aluminum substrate (length (L) 357 mm, outer-diameter (r) 80 mm) was worked by a lathe to the surface characteristic as shown in FIG. 65 (B).

Example 81 was repeated except that ZnS was employed as the surface layer material and the conditions as shown in Table 6G were employed, by means of the film deposition device as shown in FIG. 63, following various procedure to prepare a-Si type light-receiving members for electrophotography.

Figure 61:
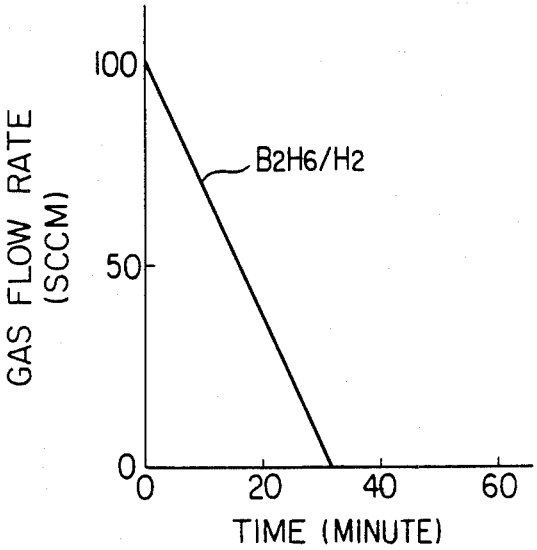
Figure 62:
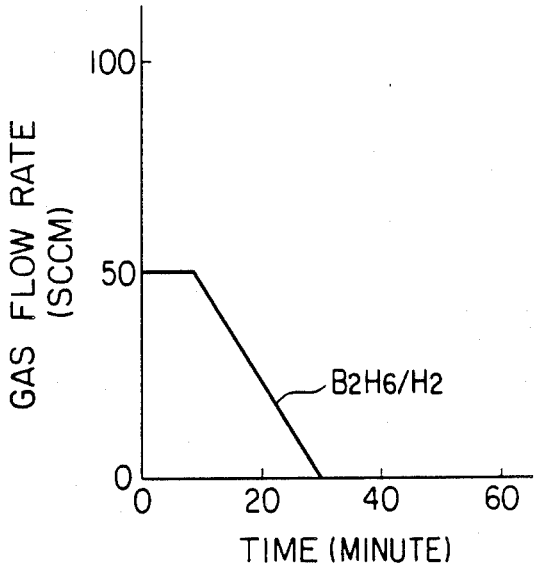

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 61 and the flow rate of $CH_4$ as shown in FIG. 57.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 91

$CH_4$ gas employed in Example 90 was changed to NO gas, following otherwise the same conditions and procedure as in Example 90 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 92

$CH_4$ gas employed in Example 90 was changed to $NH_3$ gas, following otherwise the same manner as in Example 90 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 93

An aluminum substrate (length (L) 357 mm, outer-diameter (r) 80 mm) was worked by a lathe to the surface characteristic as shown in FIG. 65 (B).

Example 81 was repeated except that $Al_2O_3$ was employed as the surface layer material and the conditions as shown in Table 7G were employed, by means of the film deposition device as shown in FIG. 63, following various procedures to prepare light-receiving members for electrophotography.

In formation of the light-receiving member, the mass flow controller for NO gas 2009 was controlled by a computer (HP9845B) so that the flow rate of NO might be as shown in FIG. 58.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 94

NO gas employed in Example 93 was changed to $NH_3$ gas, following otherwise the same manner as in Example 93 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by development and transfer to obtain an image. The image obtained was found to be free from any interference fringe pattern and satisfactory for practical application.

EXAMPLE 95

NO gas employed in Example 93 was changed to $CH_4$ gas, following otherwise the same manner as in Example 93 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 96

An aluminum substrate (length (L) 357 mm, outerdiameter (r) 80 mm) was worked by a lathe to the surface characteristic as shown in FIG. 65 (B).

Example 81 was repeated except that $CeF_3$ was employed as the surface layer material and the conditions as shown in Table 8G were employed, by means of the film deposition device as shown in FIG. 63, following various procedures to prepare light-receiving members for electrophotography.

Figure 59:
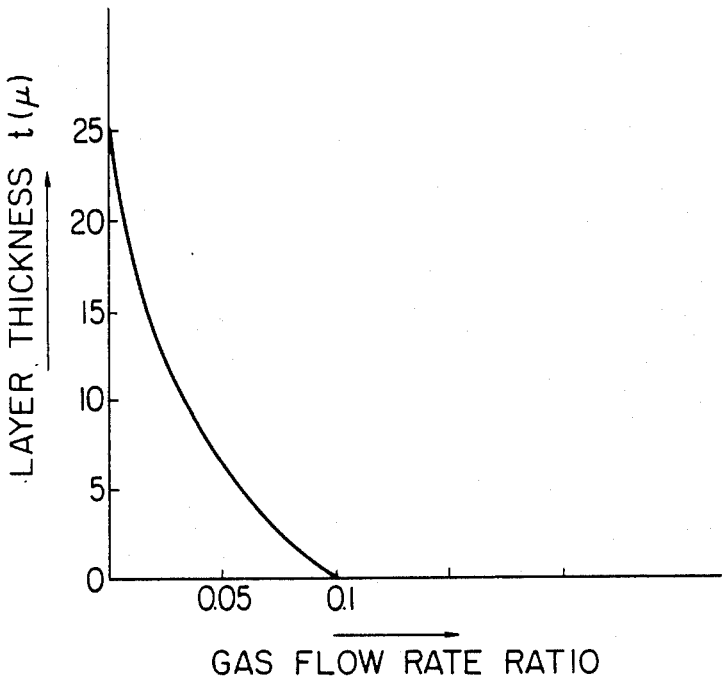

In formation of the light-receiving member the mass flow controller for $NH_3$ gas 2009 was controlled by a computer (HP9845B) so that the flow rate of $NH_3$ might be as shown in FIG. 59.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 97

$NH_3$ gas employed in Example 96 was changed to NO gas, following otherwise the same manner as in Example 96 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 98

$NH_3$ gas employed in Example 96 was changed to $CH_4$ gas, following otherwise the same manner as in Example 96 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), followed by developing and transfer to obtain an image. The image obtained was found to be free from any interference fringe pattern and satisfactory for practical application.

EXAMPLE 99

Examples 81 to 98 were repeated except that $PH_3$ gas diluted to 3000 vol ppm with $H_2$ was employed in place of $B_2H_6$ gas duluted to 3000 vol ppm with $H_2$ to prepare light-receiving members for electrophotography, respectively.

Other preparation conditions were the same as in Examples 81 to 98.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

EXAMPLE 100

By use of aluminum substrates (length (L) 357 mm, outerdiameter (r) 80 mm) worked by a lathe to the surface characteristic as shown in FIG. 65 (B), with the surface layer material and the layer thickness being changed to those as shown in Table 1A, following otherwise the same conditions as in Example 81, a-Si type light-receiving members for electrophotography were prepared by the deposition device as shown in FIG. 63, following various procedure (Sample Nos. 2701G–2720G).

For the light-receiving members for electrophotography, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

EXAMPLE 101

By means of a lathe, an aluminum substrate (length (L): 357 mm, outerdiameter (r): 80 mm) was worked to have the surface characteristic as shown in FIG. 65 (B).

Next, an a-Si type light-receiving member for electrophotography was prepared following predetermined procedures using the deposition device as shown in FIG. 63 under the conditions as shown in Table 1H.

Figure 36:
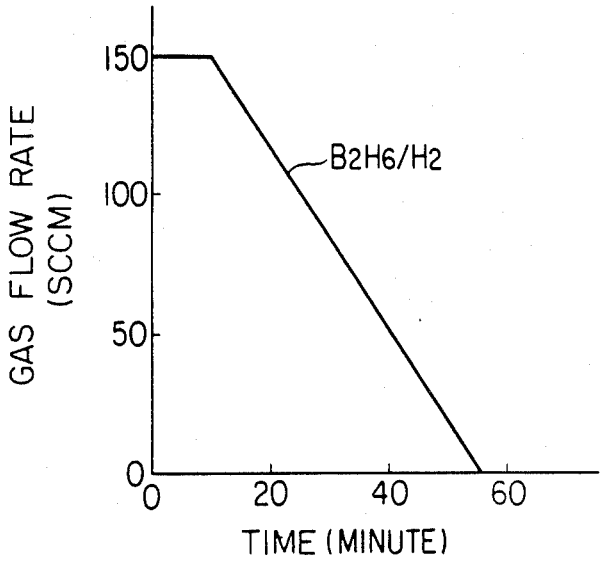

In preparation of the first layer of a-SiGe:H:B:O layer, the mass flow controllers 2008, 2007 and 2010 were controlled by a computer (HP9845B) so that the flow rates of $GeH_4$, $SiH_4$ and $B_2H_6/H_2$ might be as shown in FIG. 22 and FIG. 36. The surface layer was prepared similarly as in the case of Example 18.

The surface state of the light-receiving member thus prepared was as shown in FIG. 65 (C).

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 102

Figure 37:
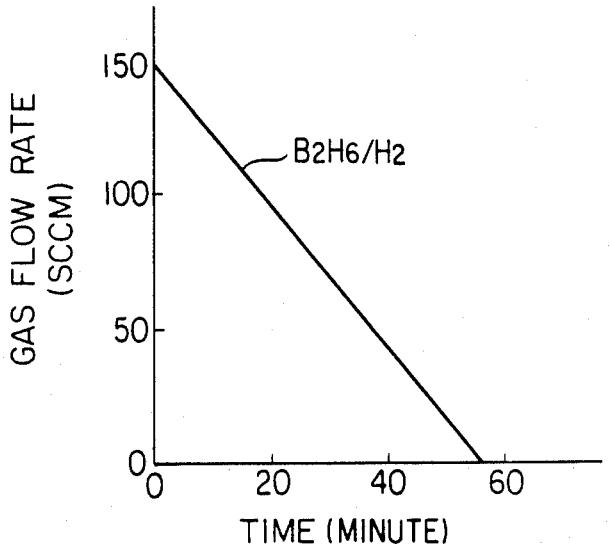

Example 101 was repeated except that the mass flow controllers 2008, 2007 and 2010 were controlled by a computer (HP9845B) so that the flow rates of $GeH_4$, $SiH_4$ and $B_2H_6/H_2$ might be as shown in FIG. 23 and FIG. 37 in formation of the first layer, to prepare an a-Si type light-receiving member for electrophotography.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 103

Example 101 was repeated except that $TiO_2$ was employed as the surface layer material and the conditions as shown in Table 2H were employed, by means of the film deposition device as shown in FIG. 63, following various procedures to prepare a-Si type light-receiving members for electrophotography.

Figure 38:
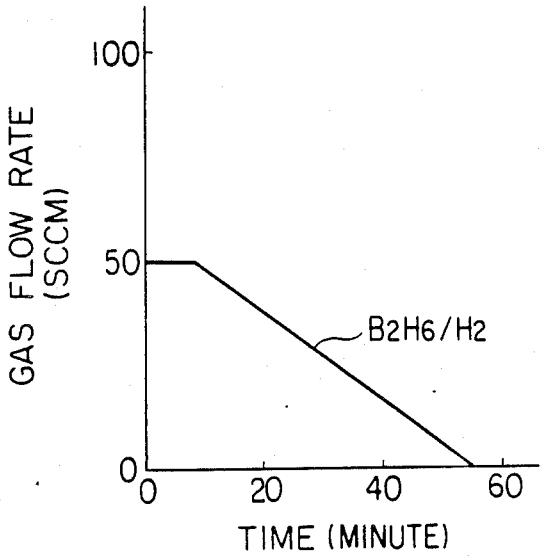

In preparation of the first layer, the mass flow controllers 2008, 2007 and 2010 were controlled by a computer (HP9845B) so that the flow rates of $GeH_4$, $SiH_4$ and $B_2H_6/H_2$ gases might be as shown in FIG. 24 and FIG. 38.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 104

Figure 39:
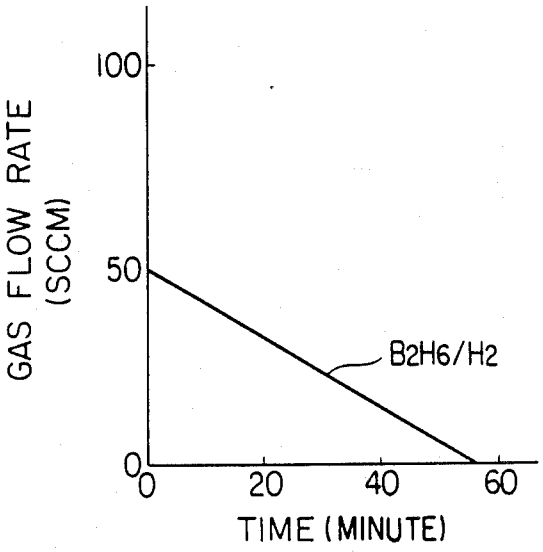

Example 103 was repeated except that, in preparation of the first layer, the mass flow controllers 2008, 2007 and 2010 were controlled by a computer (HP9845B) so that the flow rates of $GeH_4$, $SiH_4$ and $B_2H_6/H_2$ gases might be as shown in FIG. 25 and FIG. 39.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 105

Example 101 was repeated except that $CeO_2$ was employed as the surface layer material and the conditions as shown in Table 3H were employed, by means of the film deposition device as shown in FIG. 63, following various procedures to prepare a-Si type light-receiving members for electrophotography.

Figure 40:
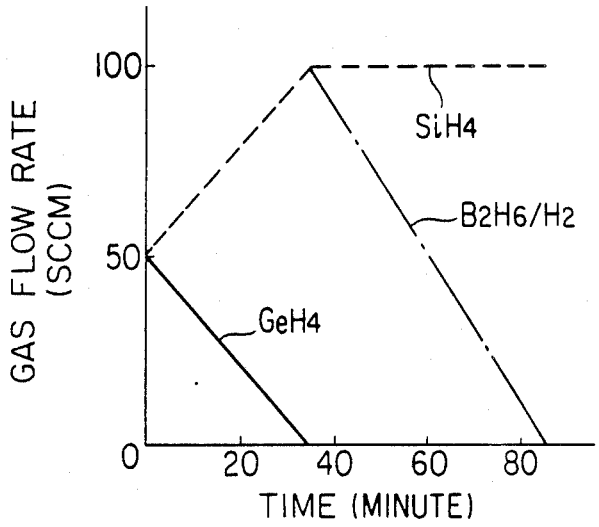
Figure 41:
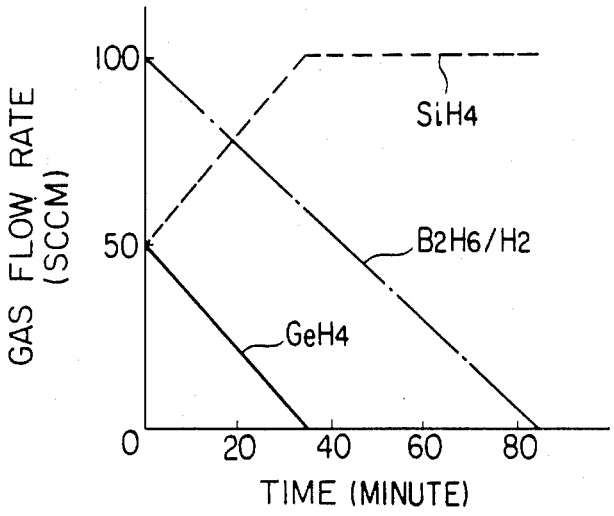
Figure 42:
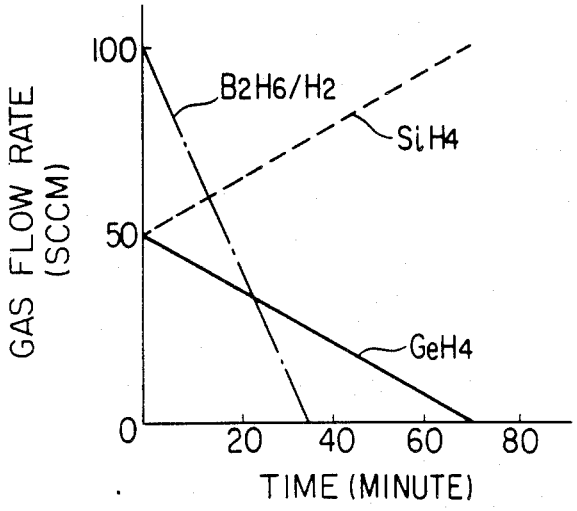

In preparation of the first layer and A layer, the mass flow controllers 2008, 2007 and 2010 were controlled by a computer (HP9845B) so that the flow rates of $GeH_4$, $SiH_4$ and $B_2H_6/H_2$ gases might be as shown in FIG. 40.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 106

Example 101 was repeated except that ZnS was employed as the surface layer material and the conditions as shown in Table 4H were employed, by means of the film deposition device as shown in FIG. 63, following various procedures to prepare a-Si type light-receiving members for electrophotography.

In preparation of the first layer and A layer, the mass flow controllers 2008, 2007 and 2010 were controlled by a computer (HP9845B) so that the flow rates of $GeH_4$, $SiH_4$ and $B_2H_6/H_2$ gases might be as shown in FIG. 40.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 107

Example 101 was repeated except that $Al_2O_3$ was employed as the surface layer material and the conditions as shown in Table 5H were employed, by means of the film deposition device as shown in FIG. 63, following various procedures to prepare a-Si type light-receiving members for electrophotography.

In preparation of the first layer and A layer, the mass flow controllers 2008, 2007 and 2010 were controlled by a computer (HP9845B) so that the flow rates of $GeH_4$, $SiH_4$ and $B_2H_6/H_2$ gases might be as shown in FIG. 40.

The light-receiving member for electrophotography as prepared above was subjected to image exposure by means of a device as shown in FIG. 26 (wavelength of laser beam: 780 nm, spot diameter 80 μm), followed by development and transfer to obtain an image. The image was free from any interference fringe pattern observed and proved to be satisfactory for practical application.

EXAMPLE 108

NO gas employed in Example 101 was changed to $NH_3$ gas, following otherwise the same conditions and procedure as in Example 101 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm), similarly as in Example 101, followed by developing and transfer to obtain an image. The image obtained was found to be free from any interference fringe pattern and satisfactory for practical application.

EXAMPLE 109

NO gas employed in Example 101 was changed to $CH_4$ gas, following otherwise the same conditions and procedure as in Example 101 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 110

$NH_3$ gas employed in Example 103 was changed to NO gas, following otherwise the same conditions and procedure as in Example 103 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 111

$NH_3$ gas employed in Example 103 was changed to $CH_4$ gas, following otherwise the same conditions and procedure as in Example 103 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 112

$CH_4$ gas employed in Example 105 was changed to NO gas, following otherwise the same conditions and procedure as in Example 105 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 113

$CH_4$ gas employed in Example 105 was changed to $NH_3$ gas, following otherwise the same conditions and procedure as in Example 105 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 114

Example 101 was repeated except that $CeF_3$ was employed as the surface layer material and the conditions as shown in Table 6H were employed, by means of the film deposition device as shown in FIG. 63, following various procedures to prepare a-Si type light-receiving members for electrophotography.

Figure 52:
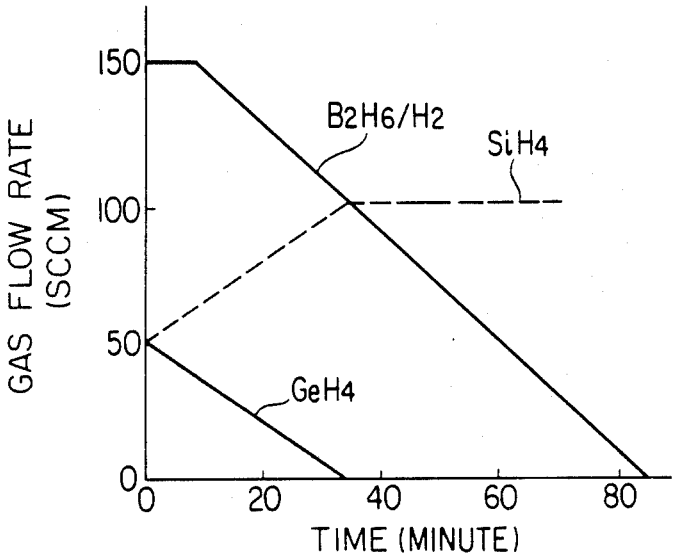

The mass flow controllers 2008, 2007, 2010 and 2009 were controlled by a computer (HP9845B) so that the flow rates of $GeH_4$, $SiH_4$ and $B_2H6/H_2$ gases might be as shown in FIG. 52 and the flow rate of $NH_3$ during formation of the nitrogen containing layer might be as shown in FIG. 56.

The light-receiving member for electrophotography as prepared above was subjected to image exposure by means of a device as shown in FIG. 26 (wavelength of laser beam: 780 nm, spot diameter 80 μm) similarly as in Example 101, followed by development and transfer to obtain an image. The image was free from any interference fringe pattern observed and proved to be satisfactory for practical application.

EXAMPLE 115

$NH_3$ gas employed in Example 114 was changed to NO gas, following otherwise the same conditions and procedure as in Example 114 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 116

$NH_3$ gas employed in Example 114 was changed to $CH_4$ gas, following otherwise the same conditions and and procedure as in Example 114 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 117

An aluminum substrate (length (L) 357 mm, outer-diameter (r) 80 mm) was worked by a lathe to the surface characteristic as shown in FIG. 82.

Next, by using $MgF_2$ as the surface material and the conditions as shown in Table 8H, an a-Si type light-receiving member for electrophotography was prepared by means of the film deposition device as shown in FIG. 63, following various procedures.

Figure 54:
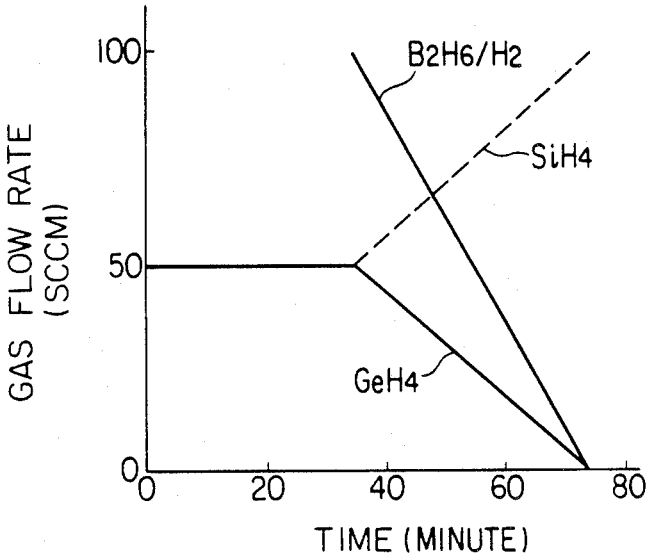
Figure 55:
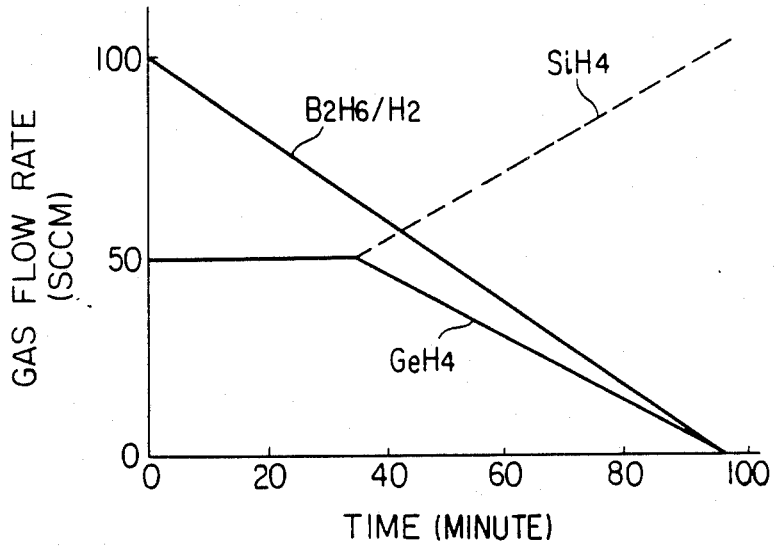

The mass flow controllers 2008, 2007, 2010 and 2009 were controlled by a computer (HP9845B) so that the flow rates of $GeH_4$, $SiH_4$, $B_2H_6/H_2$ and $CH_4$ gases might be as shown in FIG. 54 and the flow rate of $CH_4$ during formation of the carbon containing layer might be as shown in FIG. 57.

The light-receiving member for electrophctography as prepared above was subjected to image exposure by means of a device as shown in FIG. 26 (wavelength of laser beam: 780 nm, spot diameter 80 μm) similarly as in Example 101, followed by development and transfer to obtain an image. The image was free from any interference fringe pattern observed and proved to be satisfactory for practical application.

EXAMPLE 118

$CH_4$ gas employed in Example 117 was changed to NO gas, following otherwise the same conditions and procedure as in Example 117 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 119

$CH_4$ gas employed in Example 117 was changed to $NH_3$ gas, following otherwise the same conditions and procedure as in Example 117 to prepare an a-Si type light-receiving member for electrophotography.

Fit the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 120

An aluminum substrate (length (L) 357 mm, outer-diameter (r) 80 mm) was worked by a lathe to the surface characteristic as shown in FIG. 82.

Next, by using $MgF_2$ as the surface layer material and the conditions as shown in Table 8H, an a-Si type light-receiving member for electrophotography was prepared by means of the film deposition device as shown in FIG. 63, following various procedures.

The mass flow controllers 2008, 2007, 2010 and 2009 were controlled by a computer (HP9845B) so that the flow rates of $GeH_4$, $SiH_4$, $B_2H_6/H_2$ and NO gases might be as shown in FIG. 54 and the flow rate of NO during formation of the oxygen containing layer might be as shown in FIG. 58.

The light-receiving member for electrophotography as prepared above was subjected to image exposure by means of a device as shown in FIG. 26 (wavelength of laser beam: 780 nm, spot diameter 80 μm) similarly as in Example 101, followed by development and transfer to obtain an image. The image was free from any interference fringe pattern observed and proved to be satisfactory for practical application.

EXAMPLE 121

NO gas employed in Example 120 was changed to $NH_3$ gas, following otherwise the same conditions and procedure as in Example 120 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 122

NO gas employed in Example 120 was changed to $CH_4$ gas, following otherwise the same conditions and procedure as in Example 120 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 123

An aluminum substrate (length (L) 357 mm, outer-diameter (r) 80 mm) was worked by a lathe to the surface characteristic as shown in FIG. 65 (B).

Next, by using a 6 : 1 (weight ratio) mixture of $ZrO_2$ and $TiO_2$ as the surface layer material and the conditions as shown in Table 9H, an a-Si type light-receiving member for electrophotography was prepared by means of the film deposition device as shown in FIG. 63, following various procedures.

Figure 53:
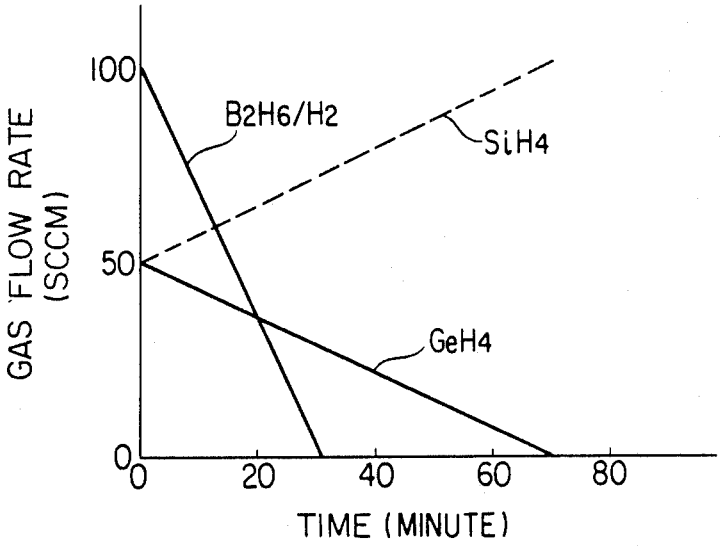

The mass flow controllers 2008, 2007, 2010 and 2009 were controlled by a computer (HP9845B) so that the flow rates of $GeH_4$, $SiH_4$, $B_2H_6/H_2$ and $NH_3$ gases might be as shown in FIG. 53 and the flow rate of $NH_3$ during formation of the nitrogen containing layer might be as shown in FIG. 57.

The light-receiving member for electrophotography as prepared above was subjected to image exposure by means of a device as shown in FIG. 26 (wavelength of laser beam: 780 nm, spot diameter 80 μm) similarly as in Example 101, followed by development and transfer to obtain an image. The image was free from any interference fringe pattern observed and proved to be satisfactory for practical application.

EXAMPLE 124

$NH_3$ gas employed in Example 123 was changed to NO gas, following otherwise the same conditions and procedure as in Example 123 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 125

$NH_3$ gas employed in Example 123 was changed to $CH_4$ gas, following otherwise the same conditions and procedure as in Example 123 to prepare an a-Si type light-receiving member for electrophotography.

For the light-receiving member for electrophotography, image exposure was effected by means of an image forming device as shown in FIG. 26 (wavelength of laser beam: 780 nm, spot diameter: 80 μm) similarly as in Example 101, followed by developing and transfer to obtain an image. The image obtained was found to be free from any interference fringe pattern and satisfactory for practical application.

EXAMPLE 126

Examples 101 to 125 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively (Sample Nos. 2601H–2700H). Other preparation conditions were the same as in Examples 101 to 125.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

EXAMPLE 127

By use of aluminum substrates (length (L) 357 mm, outerdiameter (r) 80 mm) worked by a lathe to the surface characteristic as shown in FIG. 65 (B), with the surface layer material and the layer thickness being changed to those as shown in Table 1A, following otherwise the same conditions as in Example 101, a-Si type light-receiving members for electrophotography were prepared (Sample Nos. 2701H–2720H).

For the light-receiving members for electrophotography, image exposure was effected by means of an image forming device as shown in FIG. 26 (wavelength of laser beam: 780 nm, spot diameter: 80 μm), followed by developing and transfer to obtain images. All the images obtained were found to be free from any interference fringe pattern and satisfactory for practical application.

TABLE 1A

| Condition No. | 101 | 102 | 103 | 104 | 105 | 106 | 107 | 108 | 109 | 110 | 111 | 112 |
|---|---|---|---|---|---|---|---|---|---|---|---|---|
| Material for surface layer | $ZrO_2$ | | $TiO_2$ | | $ZrO_2/TiO_2 = 6/1$ | | $TiO_2/ZrO_2 = 3/1$ | | $CeO_2$ | | Zns | |
| Refractive index | 2.00 | | 2.26 | | 2.09 | | 2.20 | | 2.23 | | 2.24 | |
| Layer thickness (μm) | 0.0975 | 0.293 | 0.0863 | 0.259 | 0.0933 | 0.280 | 0.0886 | 0.266 | 0.0874 | 0.262 | 0.0871 | 0.261 |

| Condition No. | 113 | 114 | 115 | 116 | 117 | 118 | 119 | 120 |
|---|---|---|---|---|---|---|---|---|
| Material for surface layer | $Al_2O_3$ | | $CeF_3$ | | $Al_2O_3/ZrO_2 = 1/1$ | | $MgF_2$ | |
| Refractive index | 1.63 | | 1.60 | | 1.68 | | 1.38 | |
| Layer thickness (μm) | 0.120 | 0.359 | 0.123 | 0.366 | 0.116 | 0.348 | 0.141 | 0.424 |

TABLE 2A

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$ | 300 | $B_2H_6/SiH_4$ = 1600 ppm | 150 | 10 | 5 |
| | $SiH_4$ | 150 | | | | |
| | $NH_3$ | 30 | $NH_3/SiH_4$ = 20% | | | |
| | $B_3H_6$ | 0.24 | | | | |
| Photosensitive layer | $SiH_4$ | 300 | $SiH_4/H_2 = 1$ | 300 | 20 | 20 |
| | $H_2$ | 300 | | | | |
| Surface layer | Ar | 100 | — | 300 | 2 | 0.359 |
| | $Al_2O_3$ target | | | | | |

TABLE 3A

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$ | 300 | $NH_3/SiH_4 = 10\%$ | 100 | 3 | 0.2 |
| | $SiH_4$ | 150 | | | | |
| | $NH_3$ | 15 | | | | |
| | $B_2H_6$ | 0.3 | | | | |
| Photosensitive layer | $SiH_4$ | 300 | $SiH_4/H_2 = 1$ | 300 | 20 | 20 |
| | $H_2$ | 300 | | | | |
| Surface layer | Ar | 100 | | 300 | 2 | 0.359 |
| | $Al_2O_3$ target | | | | | |

TABLE 4A

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$ | 300 | $CH_4/SiH_4 = 10\%$ | 200 | 3 | 0.2 |
| | $SiH_4$ | 150 | | | | |
| | $CH_4$ | 15 | | | | |
| | $B_2H_6$ | 0.45 | | | | |
| Photosensitive layer | $SiH_4$ | 300 | $SiH_4/H_2 = 1$ | 300 | 20 | 20 |
| | $H_2$ | 300 | | | | |
| Surface layer | Ar | 100 | | 270 | 2 | 0.424 |
| | $CeF_4$ target | | | | | |

TABLE 5A

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$ | 300 | $CH_4/SiH_4 = 10\%$ | 300 | 3 | 0.3 |
| | $SiH_4$ | 160 | | | | |
| | $CH_4$ | 16 | | | | |
| | $B_2H_6$ | 0.4 | | | | |
| Photosensitive layer | $SiH_4$ | 300 | $SiH_4/H_2 = 1$ | 300 | 20 | 20 |
| | $H_2$ | 300 | | | | |

TABLE 5A-continued

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Surface layer | Ar<br>$CeO_2$ target | 70 | | 300 | 1.7 | 0.262 |

TABLE 2B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$<br>$SiH_4$<br>$NH_3$<br>$B_2H_6$ | 300<br>150<br>30<br>0.24 | $B_2H_6/SiH_4$ = 1600 ppm<br>$NH_3/SiH_4$ = 2/10~0 | 150 | 10 | 5 |
| Photosensitive layer | $SiH_4$<br>$H_2$ | 300<br>300 | $SiH_4/H_2 = 1$ | 300 | 20 | 20 |
| Surface layer | Ar<br>$Al_2O_3$ target | 100 | — | 300 | 2 | 0.359 |

TABLE 3B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$<br>$SiH_4$<br>$NH_3$<br>$B_2H_6$ | 300<br>150<br>15<br>0.3 | $NH_3/SiH_4$ = 1/10~0 | 100 | 3 | 0.2 |
| Photosensitive layer | $SiH_4$<br>$H_2$ | 300<br>300 | $SiH_4/H_2 = 1$ | 300 | 20 | 20 |
| Surface layer | Ar<br>$Al_2O_3$ target | 100 | — | 300 | 2 | 0.359 |

TABLE 4B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$<br>$SiH_4$<br>$CH_4$<br>$B_2H_6$ | 300<br>150<br>15<br>0.45 | $CH_4/SiH_4$ = 1/10~0 | 200 | 3 | 0.2 |
| Photosensitive layer | $SiH_4$<br>$H_2$ | 300<br>300 | $SiH_4/H_2 = 1$ | 300 | 20 | 20 |
| Surface layer | Ar<br>$CeF_3$ target | 100 | — | 270 | 2 | 0.424 |

TABLE 5B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $H_2$<br>$SiH_4$<br>$CH_4$<br>$B_2H_6$ | 300<br>160<br>16<br>0.4 | $CH_4/SiH_4$ = 1/10~0 | 300 | 3 | 0.3 |
| Photosensitive layer | $SiH_4$<br>$H_2$ | 300<br>300 | $SiH_4/H_2 = 1$ | 300 | 20 | 20 |
| Surface layer | Ar<br>$CeO_2$ target | 70 | — | 300 | 1.7 | 0.262 |

TABLE 6B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>NO | $SiH_4 = 50$ | $NO/SiH_4$ = 3/10~0 | 150 | 12 | 1 |
| Second layer | $SiH_4/He = 0.05$ | $SiH_4 = 50$ | — | 150 | 12 | 20 |

TABLE 7B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 4 \times 10^{-3}$<br>$NO/SiH_4$ = 2/10~0 | 150 | 12 | 0.5 |

TABLE 7B-continued

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Second layer | $SiH_4/He = 0.05$ | $SiH_4 = 50$ | — | 150 | 12 | 20 |

TABLE 8B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 2 \times 10^{-4}$<br>$NO/SiH_4 =$<br>$1/10 \sim 1/100$ | 160 | 14 | 5 |
| Second layer | $SiH_4/He = 0.05$<br>NO | $SiH_4 = 50$ | $NO/SiH_4 = 1/100$ | 160 | 14 | 15 |

TABLE 9B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 2 \times 10^{-4}$<br>$NO/SiH_4 = 3/10 \sim 0$ | 160 | 14 | 1.0 |
| Second layer | $SiH_4/He = 0.05$<br>$B_2H_6/He = 10^{-3}$ | $SiH_4 = 50$ | $B_2H_6/SiH_4 = 2 \times 10^{-4}$ | 160 | 12 | 15 |

TABLE 10B

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$PH_3/He = 10^{-3}$<br>NO | $SiH_4 = 50$ | $PH/SiH_4 = 3 \times 10^{-4}$<br>$NO/SiH_4 = 3/10 \sim 0$ | 170 | 15 | 1 |
| Second layer | $SiH_4/He = 0.05$ | $SiH_4 = 50$ | — | 170 | 15 | 20 |

TABLE 1aC

| Layer constitution | Starting gas | Gas flow rate (SCCM) | Discharging power (W) | Layer thickness (μm) |
|---|---|---|---|---|
| First layer | $H_2$<br>$GeH_4$<br>$SiH_4$<br>NO | 300<br>50<br>100 | 160 | 5 |
| Second layer | $H_2$<br>$SiH_4$ | 300<br>300 | 150 | 20 |
| Surface layer | Material for surface layer $ZrO_2$ | | 300 | 0.0975 |

TABLE 1C

| Layer constitution | Starting gas | Gas flow rate (SCCM) | High frequency power (W) | Layer thickness (μm) |
|---|---|---|---|---|
| First layer | $H_2$<br>$SiH_4$<br>$GeH_4$<br>$NH_3$ | 300<br>100<br>50<br>30 | 160 | 3 |
| Second layer | $H_2$<br>$SiH_4$ | 300<br>300 | 300 | 20 |
| Surface layer | Material for surface layer $TiO_2$ | | 300 | 0.0863 |

TABLE 2C

| Layer constitution | Starting gas | Gas flow rate (SCCM) | High frequency power (W) | Layer thickness (μm) |
|---|---|---|---|---|
| First layer | $H_2$<br>$SiH_4$<br>$GeH_4$<br>$NH_3$ | 300<br>100<br>50<br>15 | 160 | 5 |
| Second layer | $H_2$<br>$SiH_4$<br>$NH_3$ | 300<br>300<br>15 | 200 | 20 |
| Surface | Material for | | 300 | 0.0874 |

TABLE 2C-continued

| Layer constitution | Starting gas | Gas flow rate (SCCM) | High frequency power (W) | Layer thickness (μm) |
|---|---|---|---|---|
| layer | surface layer $CeO_2$ | | | |

TABLE 3C

| Layer constitution | Starting gas | Gas flow rate (SCCM) | High frequency power (W) | Layer thickness (μm) |
|---|---|---|---|---|
| First layer | $H_2$<br>$SiH_4$<br>$GeH_4$<br>$CH_4$ | 300<br>50<br>100<br>15 | 170 | 2.8 |
| Second layer | $H_2$<br>$SiH_4$<br>$CH_4$ | 300<br>300<br>15 | 200 | 21 |
| Surface layer | Material for surface layer ZnS | | 300 | 0.0871 |

TABLE 4C

| Layer constitution | Starting gas | Gas flow rate (SCCM) | High frequency power (W) | Layer thickness (μm) |
|---|---|---|---|---|
| First layer | $H_2$<br>$SiH_4$<br>$GeH_4$<br>$CH_4$ | 300<br>100<br>60<br>16 | 170 | 5.1 |
| Second layer | $H_2$<br>$SiH_4$ | 300<br>300 | 230 | 22 |
| Surface layer | Material for surface layer $Al_2O_3$ | | 300 | 0.120 |

TABLE 5C

| Layer constitution | Starting gas | Gas flow rate (SCCM) | High frequency power (W) | Layer thickness (μm) |
|---|---|---|---|---|
| First layer | $H_2$ | 300 | 160 | 3 |
| | $SiH_4$ | 50 | | |
| | $GeH_4$ | 100 | | |
| | $NH_3$ | 30~0 | | |
| Second layer | $H_2$ | 300 | 300 | 20 |
| | $SiH_4$ | 300 | | |
| Surface layer | Material for surface layer $CeF_3$ | | 300 | 0.123 |

TABLE 6C

| Layer constitution | Starting gas | Gas flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15~0 | | |
| Second layer | $H_2$ | 300 | 200 | 20 |
| | $SiH_4$ | 300 | | |
| | $NH_3$ | | | |
| Surface layer | Material for surface layer $MgF_2$ | | 300 | 0.141 |

TABLE 7C

| Layer constitution | Starting gas | Gas flow rate (SCCM) | High frequency power (W) | Layer thickness (μm) |
|---|---|---|---|---|
| First layer | $H_2$ | 300 | 170 | 2.8 |
| | $SiH_4$ | 100 | | |
| | $GeH_4$ | 50 | | |
| | $CH_4$ | 15~0 | | |
| Second layer | $H_2$ | 300 | 200 | 21 |
| | $SiH_4$ | 300 | | |
| Surface layer | Material for surface layer $MgF_2$ | | 300 | 0.141 |

TABLE 8C

| Layer constitution | Starting gas | Gas flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $CH_4$ | 16~0 | | |
| Second layer | $H_2$ | 300 | 230 | 22 |
| | $SiH_4$ | 300 | | |
| | $CH_4$ | | | |
| Surface layer | Material for surface layer $ZrO_2$ | | 300 | 0.0975 |

TABLE 9C (Sample No. 2201C)

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/SiH_4 + GeH_4) = 3/10 \sim 0$ | 150 | 12 | 1 |
| Second layer | $SiH_4/He = 0.05$ | $SiH_4 = 50$ | | 150 | 12 | 20 |

TABLE 10C (Sample No. 2202C)

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 2/10 \sim 0$ | 150 | 12 | 0.5 |
| Second layer | $SiH_4/He = 0.05$ | $SiH_4 = 50$ | | 150 | 12 | 20 |

TABLE 11C (Sample No. 2203C)

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 1/10 \sim 1/100$ | 160 | 14 | 5 |
| Second layer | $SiH_4/He = 0.05$ | $SiH_4 = 50$ | | 160 | 14 | 15 |

TABLE 12C (Sample No. 2204C)

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 160 | 14 | 1.0 |
| Second layer | $SiH_4/He = 0.05$ | $SiH_4 = 50$ | | 160 | 12 | 15 |

TABLE 13C

| Layer constitution | Gases employed | Flow rate (SCCM) | (Sample No. 2205C) Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 170 | 15 | 1 |
| Second layer | $SiH_4/He = 0.05$ | $SiH_4 = 50$ | | 170 | 15 | 20 |

TABLE 14C

| Layer constitution | Gases employed | Flow rate (SCCM) | (Sample No. 2206C) Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>$NH_3$ | $SiH_4 + GeH_4 = 50$ | $NH_3/(SiH_4 + GeH_4) = 1/10 \sim 1/100$ | 160 | 14 | 5 |
| Second layer | $SiH_4/He = 0.05$<br>$NH_3$ | $SiH_4 = 50$ | $NH_3/SiH_4 = 1/100$ | 160 | 14 | 15 |

TABLE 15C

| Layer constitution | Gases employed | Flow rate (SCCM) | (Sample No. 2206C) Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>$CH_4$ | $SiH_4 + GeH_4 = 50$ | $CH_4/(SiH_4 + GeH_4) = 1/10 \sim 1/100$ | 160 | 14 | 5 |
| Second layer | $SiH_4/He = 0.05$<br>$CH_4$ | $SiH_4 = 50$ | $CH_4/SiH_4 = 1/100$ | 160 | 14 | 15 |

TABLE 1D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | | $GeH_4 + SiH_4 = 100$ | | | |
| | NO | 10 | | | |
| Second layer | $H_2$ | 300 | 300 | 24 | 20 |
| | $SiH_4$ | 300 | | | |
| Surface layer | | Material for surface layer $ZrO_2$ | 300 | 1 | 0.0975 |

TABLE 2D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | | $GeH_4 + SiH_4 = 100$ | | | |
| | $CH_4$ | 10 | | | |
| Second layer | $H_2$ | 300 | 300 | 24 | 20 |
| | $SiH_4$ | 300 | | | |
| Surface layer | | Material for surface layer $TiO_2$ | 300 | 1 | 0.0863 |

TABLE 3D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $50 \rightarrow 0$ | | | |
| | $SiH_4$ | $50 \rightarrow 100$ | | | |
| | | $GeH_4 + SiH_4 = 100$ | | | |
| | $NH_3$ | 10 | | | |
| Second layer | $H_2$ | 300 | 300 | 24 | 20 |
| | $SiH_4$ | 300 | | | |
| Surface layer | | Material for surface layer $CeO_2$ | 300 | 1 | 0.0874 |

TABLE 4D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4 + SiH_4 = 100$ | | | |
| | $NH_3$ | 6 | | | |
| Second layer | $H_2$ | 300 | 300 | 24 | 20 |
| | $SiH_4$ | 300 | | | |
| | $NH_3$ | 6 | | | |
| Surface layer | | Material for surface layer ZnS | 300 | 1 | 0.0871 |

TABLE 5D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| | NO | 20 → 0 | | | |
| Second layer | $H_2$ | 300 | 300 | 24 | 20 |
| | $SiH_4$ | 300 | | | |
| Surface layer | | Material for surface layer $ZrO_2$ | 300 | 1 | 0.0975 |

TABLE 6D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| | $NH_3$ | 20 → 0 | | | |
| Second layer | $H_2$ | 300 | 300 | 24 | 20 |
| | $SiH_4$ | 300 | | | |
| Surface layer | | Material for surface layer $ZrO_2$ | 300 | 1 | 0.0975 |

TABLE 7D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| | NO | 10 → ※ | | | |
| Second layer | $H_2$ | 300 | 300 | 24 | 20 |
| | $SiH_4$ | 300 | | | |
| | NO | ※ → 0 | | | |
| Surface layer | | Material for surface layer $ZrO_2$ | 300 | 1 | 0.0975 |

TABLE 8D

| Layer | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| | $CH_4$ | 10 → 0 | | | |
| Second layer | $H_2$ | 300 | 300 | 24 | 20 |
| | $SiH_4$ | 300 | | | |
| Surface layer | | Material for surface layer $ZrO_2$ | 300 | 1 | 0.0975 |

TABLE 1E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| | NO | 10 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| | | $NH_3$ | 11 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |
| Surface layer | | Material for surface layer $ZrO_2$ | | 300 | 1 | 0.0975 |

TABLE 3E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 50 | | | |
| | | $CH_4$ | 10 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |
| Surface layer | | Material for surface layer $TiO_2$ | | 300 | 1 | 0.0863 |

TABLE 4E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 150 | | | |
| | | NO | 10 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | NO | 10 | | | |
| | Layer B | $H_2$ | 300 | 300 | 24 | 20 |
| | | $SiH_4$ | 300 | | | |
| | | NO | 10 | | | |
| Surface layer | | Material for surface layer $TiO_2$ | | 300 | 1 | 0.0863 |

TABLE 5E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $NH_3$ | 12 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 12 | | | |
| | Layer B | $H_2$ | 300 | 300 | 24 | 20 |
| | | $SiH_4$ | 300 | | | |
| | | $NH_3$ | 12 | | | |
| Surface layer | | Material for surface layer $CeO_2$ | | 300 | 1 | 0.0874 |

TABLE 6E

| Layer constitution | | Starting gas | Gas flow rate (SCCM) | Discharging power (W) | Deposition rate (A/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | 8 | | | |
| | Layer B | $H_2$ | 300 | 100 | 10 | 2 |
| | | $GeH_4$ | 50 | | | |
| | | $SiH_4$ | 50 | | | |
| | | $CH_4$ | 8 | | | |
| Second layer | | $H_2$ | 300 | 300 | 24 | 20 |
| | | $SiH_4$ | 300 | | | |
| | | $CH_4$ | 8 | | | |
| Surface layer | | Material for surface layer ZnS | | 300 | 1 | 0.0871 |

TABLE 7E

| Layer constitution | | Starting gas | Gas flow rate (SCCM) | Discharging power (W) | Deposition rate (A/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $CH_4$ | 10~※ | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | ※~0 | | | |
| Second layer | | $H_2$ | 300 | 300 | 24 | 20 |
| | | $SiH_4$ | 300 | | | |
| Surface layer | | Material for surface layer $Al_2O_3$ | | 300 | 1 | 0.120 |

Note:
The symbol ※ represents continuity of change in the gas flow rate.

TABLE 8E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 vol ppm) | 100 | | | |
| | NO | 10~0 | | | |
| Second layer | $H_2$ | 300 | 300 | 24 | 20 |
| | $SiH_4$ | 300 | | | |
| Surface layer | Material for surface layer $CeF_3$ | | 300 | 1 | 0.123 |

TABLE 9E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $NH_3$ | 10~0 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |
| Surface layer | | Material for surface layer $MgF_2$ | | 300 | 1 | 0.141 |

TABLE 10E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| | | $CH_4$ | 10~※ | | | |
| Second layer | Layer | $H_2$ | 300 | 100 | 8 | 3 |
| | | $SiH_4$ | 100 | | | |
| | | $B_2H_6/H_2$ (= 3000 vol ppm) | 100 | | | |
| | | $CH_4$ | ※~※※ | | | |
| | Layer B | $H_2$ | 300 | 300 | 24 | 20 |
| | | $SiH_4$ | 300 | | | |
| | | $CH_4$ | ※※~0 | | | |
| Surface layer | | Material for surface layer $MgF_2$ | | 300 | 1 | 0.141 |

Note:
The symbols × and × × represent continuity of change in the gas flow rate respectively.
The same note applies to the subsequent other tables.

TABLE 11E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| | | NO | 10~ ※ | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | NO | ※ ~ | | | |
| | Layer B | $H_2$ | 300 | 300 | 24 | 20 |
| | | $SiH_4$ | 300 | | | |
| | | NO | ※※~0 | | | |
| Surface layer | | Material for surface layer $ZrO_2:TiO_2$ = 6:1 | | 300 | 1 | 0.0933 |

TABLE 12E

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $NH_3$ | 10~ ※ | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | $NH_3$ | ※ ~ ※※ | | | |
| | Layer B | $H_2$ | 300 | 300 | 24 | 20 |
| | | $SiH_4$ | 300 | | | |
| | | $NH_3$ | ※※~0 | | | |

TABLE 12E-continued

| Layer constitution | Starting gas | Gas flow rate (SCCM) | Discharging power (W) | Deposition rate (Å/Sec) | Layer thickness (μm) |
|---|---|---|---|---|---|
| Surface layer | Material for Surface layer $Al_2O_3$:$ZrO_2$ = 1:1 | | 300 | 1 | 0.116 |

TABLE 13E

| Layer constitution | | Starting gas | Gas flow rate (SCCM) | Discharging power (W) | Deposition rate (A/Sec) | Layer thickness (μm) |
|---|---|---|---|---|---|---|
| First layer | Layer A | $H_2$ | 300 | 100 | 10 | 2 |
| | $GeH_4$ | 50 | | | | |
| | | $SiH_4$ | 50 | | | |
| | | $B_2H_6/H_2$ (= 3000 vol ppm) | 100 | | | |
| | | NO | 8 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.424 |

TABLE 14E

| Layer constitution | | Starting gas | Gas flow rate (SCCM) | Discharging power (W) | Deposition rate (A/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $NH_3$ | 11 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.424 |

TABLE 1F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4 + SiH_4 = 100$ | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 100 $GeH_4 + SiH_4 = 100$ | | | |
| | | $NH_3$ | 8 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 8 | | | |
| | Layer B | $H_2$ | 300 | 300 | 24 | 20 |
| | | $SiH_4$ | 300 | | | |
| | | $NH_3$ | 8 | | | |

TABLE 2F-continued

| Layer constitution | Starting gas | Gas flow rate (SCCM) | Discharging power (W) | Deposition rate (Å/Sec) | Layer thickness (μm) |
|---|---|---|---|---|---|
| Surface layer | | $TiO_2$ | 300 | 1 | 0.0863 |

TABLE 3F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ | 100 | | | |
| | (= 3000 vol ppm) | $GeH_4 + SiH_4 = 100$ | | | |
| | $CH_4$ | 10 → 0 | | | |
| Second layer | $H_2$ | 300 | 300 | 24 | 20 |
| | $SiH_4$ | 300 | | | |
| Surface layer | | Material for surface layer $CeO_2$ | 300 | 1 | 0.0874 |

TABLE 4F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ | 50 | | | |
| | | (= 3000 vol ppm) | $GeH_4 + SiH_4 = 100$ | | | |
| | | NO | 10 → ※ | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | | NO | ※ → ※※ | | | |
| | Layer B | $H_2$ | 300 | 300 | 24 | 20 |
| | | $SiH_4$ | 300 | | | |
| | | NO | ※※ → 0 | | | |
| Surface layer | | | ZnS | 300 | 1 | 0.0871 |

TABLE 5F

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | | $GeH_4 + SiH_4 = 100$ | | | |
| | | $NH_3$ | 10 → ※ | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | | $NH_3$ | ※ → ※※ | | | |
| | Layer B | $H_2$ | 300 | 300 | 24 | 20 |
| | | $SiH_4$ | 300 | | | |
| | | $NH_3$ | ※※ → 0 | | | |
| Surface layer | | | ZnS | 300 | 1 | 0.0871 |

TABLE 6F

| Layer constitution | | Starting gas | Gas flow rate (SCCM) | Discharging power (W) | Deposition rate (A/Sec) | Layer thickness (μm) |
|---|---|---|---|---|---|---|
| First layer | Layer A | $H_2$ | 300 | 100 | 10 | 1.5 |
| | | $GeH_4$ | 100 → 50 | | | |
| | | $SiH_4$ | 0 → 50 | | | |
| | | $B_2H_6/H_2$ | 100 | | | |
| | | (= 3000 vol ppm) | | | | |
| | | $CH_4$ | 10 → ※ | | | |
| | Layer B | $H_2$ | 300 | 100 | 10 | 1.5 |
| | | $GeH_4$ | 50 → 0 | | | |
| | | $SiH_4$ | 50 → 100 | | | |
| | | $CH_4$ | ※ → ※※ | | | |
| Second layer | | $H_2$ | 300 | 300 | 24 | 20 |
| | | $SiH_4$ | 300 | | | |
| | | $CH_4$ | ※※ → 0 | | | |

TABLE 6F-continued

| Layer constitution | Starting gas | Gas flow rate (SCCM) | Discharging power (W) | Deposition rate (A/Sec) | Layer thickness (μm) |
|---|---|---|---|---|---|
| Surface layer | ZnS | | 300 | 1 | 0.0871 |

TABLE 1G

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ (= 3000 vol ppm) | $B_2H_6/(GeH_4 + SiH_4) = 3/100 \rightarrow 0$ | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2G

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| | $B_2H_6/H_2$ (= 3000 vol ppm) | $B_2H_6/(GeH_4 + SiH_4) = 5/100 \rightarrow 0$ | | | |
| | $NH_3$ | 10 | | | |
| Second layer | $H_2$ | 300 | 300 | 24 | 20 |
| | $SiH_4$ | 300 | | | |
| | $NH_3$ | 10 | | | |
| Surface layer | Material for surface layer $ZrO_2$ | | 300 | 1 | 0.0975 |

TABLE 3G

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| | $B_2H_6/H_2$ (= 3000 vol ppm) | $B_2H_6/(GeH_4 + SiH_4) = 1/100 \rightarrow 0$ | | | |
| | $CH_4$ | 15 | | | |
| Second layer | $H_2$ | 300 | 300 | 24 | 20 |
| | $SiH_4$ | 300 | | | |
| Surface layer | Material for surface layer $TiO_2$ | | 300 | 1 | 0.0863 |

TABLE 4G

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| | $B_2H_6/H_2$ (= 3000 vol ppm) | $B_2H_6/(GeH_4 + SiH_4) = 1/100 \rightarrow 0$ | | | |
| | NO | 15 | | | |
| Second layer | $H_2$ | 300 | 300 | 24 | 20 |
| | $SiH_4$ | 300 | | | |
| | NO | 15 | | | |
| Surface layer | Material for surface layer $TiO_2$ | | 300 | 1 | 0.0863 |

TABLE 5G

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 2 |
| | $GeH_4$ | 50 | | | |
| | $SiH_4$ | 50 | | | |
| | $B_2H_6/H_2$ | $150 \rightarrow 110$ | | | |

TABLE 5G-continued

| Layer constitution | | Starting gas | Gas flow rate (SCCM) | Discharging power (W) | Deposition rate (Å/Sec) | Layer thickness (μm) |
|---|---|---|---|---|---|---|
| | | (= 3000 vol ppm) | | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ | 100 → 0 | | | |
| | | (= 3000 vol ppm) | | | | |
| | Layer B | $H_2$ | 300 | 300 | 24 | 20 |
| | | $SiH_4$ | 300 | | | |
| Surface layer | | Material for layer surface $CeO_2$ | | 300 | 1 | 0.0874 |

TABLE 6G

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ | 100 → 0 | | | |
| | | (= 3000 vol ppm) | | | | |
| | | $CH_4$ | 10 → 0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |
| Surface layer | | Material for surface layer ZnS | | 300 | 1 | 0.0871 |

TABLE 7G

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $SiH_4$ | 50 | | | |
| | | $GeH_4$ | 50 | | | |
| | | NO | 10 → ※ | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ | 100 | | | |
| | | (= 3000 vol ppm) | | | | |
| | | NO | ※ → ※※ | | | |
| Second layer | | $H_2$ | 300 | 300 | 24 | 20 |
| | | $SiH_4$ | 300 | | | |
| | | NO | ※※ → 0 | | | |
| Surface layer | | Material for surface layer $Al_2O_3$ | | 300 | 1 | 0.120 |

TABLE 8G

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $SiH_4$ | 50 | | | |
| | | $GeH_4$ | 50 | | | |
| | | $B_2H_6/H_2$ | 100 → 110 | | | |
| | | (= 3000 vol ppm) | | | | |
| | | $NH_3$ | 10 → ※ | | | |
| Second layer | Layer A | $H_2$ | 300 | 100 | 8 | 3 |
| | | $GeH_4$ | 50 | | | |
| | | $SiH_4$ | 50 | | | |
| | | $B_2H_6/H_2$ | 100 | | | |
| | | (= 3000 vol ppm) | | | | |
| | | $NH_3$ | ※ → ※※ | | | |
| | Layer B | $H_2$ | 300 | 300 | 24 | 20 |
| | | $SiH_4$ | 300 | | | |
| | | $NH_3$ | ※※ → 0 | | | |
| Surface layer | | Material for surface layer $CeF_3$ | | 300 | 1 | 0.123 |

TABLE 1H

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |
| | $B_2H_6/H_2$ (= 3000 vol ppm) | 150 → 0 | | | |
| | NO | 12 | | | |
| Second layer | $H_2$ | 300 | 300 | 24 | 20 |
| | $SiH_4$ | 300 | | | |
| Surface layer | Material for surface layer $ZrO_2$ | | 300 | 1 | 0.0975 |

TABLE 2H

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4 + SiH_4 = 100$ | | | |
| | $B_2H_6/H_2$ (= 3000 vol ppm) | 50 → 0 | | | |
| | $NH_3$ | 12 | | | |
| Second layer | $H_2$ | 300 | 300 | 24 | 20 |
| | $SiH_4$ | 300 | | | |
| | $NH_3$ | 12 | | | |
| Surface layer | Material for surface layer $TiO_2$ | | 300 | 1 | 0.0863 |

TABLE 3H

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $CH_4$ | 15 | | | |
| Second layer | Layer A | $H_2$ | 300 | 300 | 10 | 3 |
| | | $SiH_4$ | 100 | | | |
| | | $B_2H_6/H_2$ (= 3000 vol ppm) | 100 → 0 | | | |
| | Layer B | $H_2$ | 300 | 300 | 24 | 20 |
| | | $SiH_4$ | 300 | | | |
| Surface layer | | Material for surface Layer $CeO_2$ | | 300 | 1 | 0.0874 |

TABLE 4H

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6H_2$ (= 3000 vol ppm) | 100 → ※ | | | |
| | | NO | 10 | | | |
| Second layer | Layer | $H_2$ | 300 | 100 | 10 | 3 |
| | | $SiH_4$ | 100 | | | |
| | | $B_2H_6/H_2$ (= 3000 vol ppm) | ※ → 0 | | | |
| | | NO | 10 | | | |
| | Layer B | $H_2$ | 300 | 300 | 24 | 20 |
| | | $SiH_4$ | 300 | | | |
| | | NO | 10 | | | |
| Surface layer | | Material for surface layer ZnS | | 300 | 1 | 0.0871 |

TABLE 5H

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 → 25 | | | |
| | | $SiH_4$ | 50 → 75 | | | |

TABLE 5H-continued

| Layer constitution | | Starting gas | Gas flow rate (SCCM) | Discharging power (W) | Deposition rate (Å/Sec) | Layer thickness (μm) |
|---|---|---|---|---|---|---|
| | | $B_2H_6/H_2$ (= 3000 vol ppm) | 100 → 0 | | | |
| | | $NH_3$ | 10 | | | |
| | Layer B | $H_2$ | 300 | 100 | 10 | 2 |
| | | $GeH_4$ | 25 → 0 | | | |
| | | $SiH_4$ | 75 → 100 | | | |
| | | $NH_3$ | 10 | | | |
| Second layer | | $H_2$ | 300 | 300 | 24 | 20 |
| | | $SiH_4$ | 300 | | | |
| Surface layer | | Material for surface layer $Al_2O_3$ | | 300 | 1 | 0.120 |

TABLE 6H

| Layer constitution | | Starting gas | Gas flow rate (SCCM) | Discharging power (W) | Deposition rate (Å/Sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 150 → 110 | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |
| Surface layer | | Material for surface layer $CeF_3$ | | 300 | 1 | 0.123 |

TABLE 7H

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 → * | | | |
| | | $SiH_4$ | 50 → ** | | | |
| | | $B_2H_6/H_2$ (= 3000 vol ppm) | 100 → 0 | | | |
| | | $CH_4$ | 10 → 0 | | | |
| | Layer B | $H_2$ | 300 | 100 | 10 | 2 |
| | | $GeH_4$ | * → 0 | | | |
| | | $SiH_4$ | ** → 100 | | | |
| Second layer | | $H_2$ | 300 | 300 | 24 | 20 |
| | | $SiH_4$ | 300 | | | |
| Surface layer | | Material for surface layer $MgF_2$ | | 300 | 1 | 0.141 |

TABLE 8H

| Layer constitution | | Starting gas | Gas flow rate (SCCM) | Discharging power (W) | Deposition rate (Å/Sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10 → * | | | |
| | Layer B | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 100 → 0 | | | |
| | | NO | * → ** | | | |
| Surface layer | | $H_2$ | 300 | 300 | 24 | 20 |
| | | $SiH_4$ | 300 | | | |
| | | NO | ** → 0 | | | |
| Surface layer | | Material for surface layer $MgF_2$ | | 300 | 1 | 0.141 |

TABLE 9H

| Layer constitution | Starting gas | Gas flow rate (SCCM) | Discharging power (W) | Deposition rate (Å/Sec) | Layer thickness (μm) |
|---|---|---|---|---|---|
| First layer | $H_2$ | 300 | 100 | 10 | 2 |

TABLE 9H-continued

| Layer constitution | | Starting gas | Gas flow rate (SCCM) | Discharging power (W) | Deposition rate (Å/Sec) | Layer thickness (μm) |
|---|---|---|---|---|---|---|
| | | $GeH_4$ | 50 | | | |
| | | $SiH_4$ | 50 | | | |
| | | $B_2H_6/H_2$ (= 3000 vol ppm) | 100 → ※※※ | | | |
| | | $NH_3$ | 10 → ※ | | | |
| Second layer | Layer A | $H_2$ | 300 | 100 | 8 | 3 |
| | | $GeH_4$ | 50 → 0 | | | |
| | | $SiH_4$ | 50 → 100 | | | |
| | | $B_2H_6/H_2$ (= 3000 vol ppm) | ※※ → 0 | | | |
| | | $NH_3$ | ※ → ※※ | | | |
| | Layer B | $H_2$ | 300 | 300 | 24 | 20 |
| | | $SiH_4$ | 300 | | | |
| | | $NH_3$ | ※※ → 0 | | | |
| Surface layer | | Material for surface layer $ZrO_2/TiO_2$ = 6:1 | | 300 | 1 | 0.0933 |

Note:
The symbol ※※※ represents continuity of change in the gas flow rate.

What we claim is:

1. A light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer with a multi-layer structure having a first layer comprising an amorphous material containing silicon atoms and germanium atoms, a second layer comprising an amorphous material containing silicon atoms and exhibiting photoconductivity, and a surface layer having the reflection preventive function provided successively from the substrate side, said light-receiving layer containing at least one selected from oxygen atoms, carbon atoms and nitrogen atoms.

2. An electrophotographic system comprising a light-receiving member comprising a substrate having a large number of protruding portions on a surface thereof, each of said protruding portions having at a predetermined cut position a sectional shape comprising a main-projection, and a subprojection, the main projection and the subprojection overlapping each other, and a light-receiving layer with a multi-layer structure having a first layer comprising an amorphous material containing silicon atoms and germanium atoms, a second layer comprising an amorphous material containing silicon atoms and exhibiting photoconductivity, and a surface layer having the reflection preventive function provided successively from the substrate side, said light-receiving layer containing at least one selected from oxygen atoms, carbon atoms and nitrogen atoms.

3. A light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer comprising a layer comprising an amorphous material containing silicon atoms, at least a part of the layer region of which has photosensitivity, and a surface layer having the reflection preventive function, said layer at least a part of the layer region of which has photosensitivity containing at least one selected from oxygen atoms, carbon atoms and nitrogen atoms.

4. An electrophotographic system comprising a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer comprising a layer comprising an amorphous material containing silicon atoms, at least a part of the layer region of which has photosensitivity, and a surface layer having the reflection preventive function, said layer at least a part of the layer region of which has photosensitivity containing at least one selected from oxygen atoms, carbon atoms and nitrogen atoms.

5. The invention according to claims 1, 2, 3 or 4, wherein said protruding portions are arranged regularly.

6. The invention according to claims 1, 2, 3 or 4, wherein said protruding portions are arranged in cycles.

7. The invention according to claims 1, 2, 3 or 4, wherein each of said protruding portions has the same shape as the first order approximation.

8. The invention according to claims 1, 2, 3 or 4, wherein said protruding portions have a plurality of subprojections.

9. The invention according to claims 1, 2, 3 or 4, wherein said sectional shape of said protruding portion is symmetrical with the main projection as its center.

10. The invention according to claims 1, 2, 3 or 4, wherein said sectional shape of said protruding portion is asymmetrical with the main projection as its center.

11. The invention according to claims 1, 2, 3 or 4, wherein said protruding portion is formed by mechanical working.

12. The invention according to claims 1, 2, 3 or 4, wherein the light-receiving layer contains at least one kind of atoms selected from oxygen atoms, carbon atoms and nitrogen atoms in uniform distribution state in the layer thickness direction.

13. The invention according to claims 1, 2, 3 or 4, wherein the light-receiving layer contains at least one kind of atoms selected from oxygen atoms, carbon atoms and nitrogen atoms in non-uniform distribution state in the layer thickness direction.

14. A light-receiving member according to claims 1, or 2, wherein the distribution state of germanium atoms in the first layer is non-uniform in the layer thickness direction.

15. A light-receiving member according to claims 1, or 2, wherein the distribution state of germanium atoms is more enriched toward the substrate side.

16. A light-receiving member according to claims 1, or 2, wherein a substance for controlling conductivity is contained in the first layer.

17. A light-receiving member according to claims 1, or 2, wherein a substance for controlling conductivity is including in the first layer which is an atom belonging to the group III or the group v of the periodic table.

18. A light-receiving member according to claims 1, or 2, wherein a substance for controlling conductivity is contained in the second layer.

19. A light-receiving member according to claims 1, or 2, wherein a substance for controlling conductivity is included in the second layer which is an atom belonging to the group III or the group V of the periodic table.

20. A light-receiving member according to claims 1, or 2, wherein either of the first layer and the second layer has a layer region (PN) containing a substance for controlling conductivity.

21. A light-receiving member according to claims 1, or 2, wherein the distribution state of a substance for controlling conductivity in a layer region (PN) located in either the first or second layer is non-uniform in the layer thickness direction.

22. A light-receiving member according to claims 1, or 2, wherein the distribution state of a substance for controlling conductivity in a layer region (PN) located in either the first or second layer is uniform in the layer thickness direction.

23. A light-receiving member according to claims 1, or 2, wherein a substance for controlling conductivity is included whcih is an atom belonging to the group III or the group V of the periodic table.

24. A light-receiving member according to claims 1, or 2, wherein a conductivity controlling layer region (PN) is provided in the second layer.

25. A light-receiving member according to claims 1, or 2, wherein a conductivity controlling layer region (PN) is provided in the second layer.

26. A light-receiving member according to claims 1, or 2, wherein a conductivity controlling layer region (PN) is provided at the end portion on the substrate side of the light-receiving layer.

27. A light-receiving member according to claims 1, or 2, wherein a conductivity controlling layer region (PN) is provided over both the first layer and the second layer.

28. A light-receiving member according to claims 1, or 2, wherein a conductivity controlling layer region (PN) occupies a layer region in the light-receiving layer.

29. A light-receiving member according to claims 1, or 2, wherein a substance for controlling conductivity included in a layer region (PN) is 0.01 to $5\times10^4$ atomic ppm.

30. A light-receiving member according to claims 1, or 2, wherein at least one of hydrogen atoms and halogen atoms are contained in the first layer.

31. A light-receiving member according to claims 1, or 2, wherein 0.01 to 40 atomic % of hydrogen atoms are contained in the first layer.

32. A light-receiving member according to claims 1, or 2, wherein 0.01 to 40 atomic % of halogen atoms are contained in the first layer.

33. A light-receiving member according to claims 1, or 2, wherein 0.01 to 40 atomic % as a total of hydrogen atoms and halogen atoms are contained in the first layer.

34. A light-receiving member according to claims 1, or 2, wherein 1 to 40 atomic % of hydrogen atoms are contained in the second layer.

35. A light-receiving member according to claims 1, or 2, wherein 1 to 40 atomic % of halogen atoms are contained in the second layer.

36. A light-receiving member according to claims 1, or 2, wherein 1 to 40 atomic % as a total of hydrogen atoms and halogen atoms are contained in the second layer.

37. A light-receiving member according to claims 1, or 2, wherein at least one of hydrogen atoms and halogen atoms are contained in the second layer.

38. A light-receiving member according to claims 1, or 2, wherein the first layer has a layer thickness of 30 Å to 50μ.

39. A light-receiving member according to claims 1, or 2, wherein the second layer has a layer thickness of 0.5 to 90μ.

40. A light-receiving member according to claims 1, or 2, wherein the light-receiving layer has a layer thickness of 1 to 100μ.

41. A light-receiving member according to claims 1, or 2, wherein the layer thickness $T_B$ of the first layer and the layer thickness $T_B$ of the second layer satisfy the relationship of $T_B/T \leqq 1$.

42. The invention according to claims 3, or 4, wherein a charge injection preventive layer exists between the substrate and the photosensitive layer.

43. The invention according to claims 3, or 4, wherein a charge injection preventive layer is included and comprises an amorphous material containing silicon atoms.

44. The invention according to claims 3, or 4, wherein a charge injection preventive layer is included and contains a substance (C) for controlling conductivity.

45. The invention according to claims 3, or 4, wherein a substance (C) for controlling conductivity is 0.001 to $5\times10^4$ atomic ppm is included in a charge injection preventive layer.

46. The invention according to claims 3, or 4, wherein a substance (C) for controlling conductivity is a p-type impurity is included in a charge injection preventive layer.

47. The invention according to claims 3, or 4, wherein a substance (C) for controlling conductivity is an n-type impurity is included in a charge injection preventive layer.

48. The invention according to claims 3, or 4, wherein a charge injection preventive layer is included and has layer thickness of 30 Å to 10μ.

49. The invention according to claims 1, 2, 3, or 4, wherein the light-receiving layer has a layer region (OCN) containing at least one kind of atoms selected from oxygen atoms, carbon atoms and nitrogen atoms.

50. The invention according to claims 1, 2, 3, or 4, wherein a layer region (OCN) is provided at the end portion on the substrate side of the light-receiving layer.

51. The invention according to claims 1, 2, 3, or 4, wherein a layer region (OCN) is included and contains 0.001 to 50 atomic % of oxygen atoms.

52. The invention according to claims 1, 2, 3, or 4, wherein a layer region (OCN) is included and contains 0.001 to 50 atomic % carbon atoms.

53. The invention according to claims 1, 2, 3, or 4, wherein a layer region (OCN) is included and contains 0.001 to 50 atomic % of nitrogen atoms.

54. The invention according to claims 1, 2, 3, or 4, wherein oxygen atoms are contained in a layer region (OCN) in non-uniform distribution state in the layer thickness direction.

55. The invention according to claims 1, 2, 3, or 4, wherein oxygen atoms are contained in a layer region (OCN) in uniform distribution state in the layer thickness direction.

56. The invention according to claims 1, 2, 3, or 4, wherein nitrogen atoms are contained in a layer region (OCN) in non-uniform distribution state in the layer thickness direction.

57. The invention according to claims 1, 2, 3, or 4, wherein nitrogen atoms are contained in a layer region (OCN) in uniform distribution state in the layer thickness direction.

58. The invention according to claims 1, 2, 3, or 4, wherein carbon atoms are contained in a layer region (OCN) in non-uniform distribution state in the layer thickness direction.

59. The invention according to claims 1, 2, 3, or 4, wherein carbon atoms are contained in a layer region (OCN) in uniform distribution state in the layer thickness direction.

60. The invention according to claims 3, or 4, wherein the light-receiving layer has a layer thickness of 1 to 100$\mu$.

61. The invention according to claims 3, or 4, wherein hydrogen atoms are contained in the light-receiving layer.

62. The invention according to claims 3, or 4, wherein halogen atoms are contained in the light-receiving layer.

63. The invention according to claims 3, or 4, wherein hydrogen atoms and halogen are contained in the light-receiving layer.

* * * * *

UNITED STATES PATENT AND TRADEMARK OFFICE

CERTIFICATE OF CORRECTION

PATENT NO. : 4,705,731

DATED : November 10, 1987

INVENTOR(S) : KEISHI SAITOH, ET AL.

It is certified that error appears in the above-identified patent and that said Letters Patent is hereby corrected as shown below:

COLUMN 2

Line 51, "2nd=mλ(m+1/2)λ" should read --2nd=(m+1/2)λ--.

COLUMN 9

Line 49, "$Al_2$ $O_3$," should read --$Al_2O_3$,--.

COLUMN 10

Line 34, "a-Si" should read --A-Si--.
Line 37, ""a-SiGe(H,X)")," should read --"A-SiGe(H,X)"),--.
Line 40, ""a-Si(H,X)")" should read --"A-Si(H,X)")--.

COLUMN 15

Line 56, "$siH_2I_2$" should read --$SiH_2I_2$--.

COLUMN 16

Line 35, "a-Si(H,X)" should read --A-Si(H,X)--.

COLUMN 29

Line 29, "$B_2H_6$" should read --$B_2H_6/H_2$--.

COLUMN 45

Line 65, "A-si:H" should read --A-Si:H--.

UNITED STATES PATENT AND TRADEMARK OFFICE

CERTIFICATE OF CORRECTION

PATENT NO. : 4,705,731

DATED : November 10, 1987

INVENTOR(S) : KEISHI SAITOH, ET AL.

It is certified that error appears in the above-identified patent and that said Letters Patent is hereby corrected as shown below:

COLUMN 57

Line 30, "7800 nm," should read --780 nm,--.

COLUMN 83

Table 10E, "The symbols X and X X" should read --The symbols ⊗ and ⊗⊗--.

Table 11E, "NO ⊗ ~" should read --NO ⊗ ~ ⊗⊗--.

COLUMN 85

Table 13E, "First layer Layer A $H_2$ 300" $GeH_4$ 50 should read --First layer Layer A $H_2$ 300-- $GeH_4$ 50

COLUMN 86

Table 13E, "rate (A/Sec)" should read --rate (Å/Sec)--.

Table 14E, "rate (A/Sec)" should read --rate (Å/Sec)--.

COLUMN 88

Table 6F, "rate (A/Sec)" should read --rate (Å/Sec)--.

COLUMN 91

Table 5G, "$B_2H_6/H_2$ 100 → 0" should read --$B_2H_6/H_2$ 110 → 0--.

UNITED STATES PATENT AND TRADEMARK OFFICE

CERTIFICATE OF CORRECTION

PATENT NO. : 4,705,731

DATED : November 10, 1987

INVENTOR(S) : KEISHI SAITOH, ET AL.

It is certified that error appears in the above-identified patent and that said Letters Patent is hereby corrected as shown below:

COLUMN 93

Table 4H, "$B_2H_6H_2$" should read --$B_2H_6/H_2$--.

COLUMN 97

Table 9H, "$B_2H_6/H_2$ ⁘⁘ → 0" should read --$B_2H_6/H_2$ ⁘⁘⁘ → 0--.
Line 41, "main-" should read --main--.
Line 42, "projection," should read --projection--.

COLUMN 99

Line 9, "including" should read --included--.
Line 10, "group v" should read --group V--.
Line 35, "whcih" should read --which--.
Line 39, "second" should read --first--.

COLUMN 100

Line 28, "$T_B$of" should read --T of--.
Line 68, "carbon" should read --of carbon--.

UNITED STATES PATENT AND TRADEMARK OFFICE

CERTIFICATE OF CORRECTION

PATENT NO. : 4,705,731

DATED : November 10, 1987

INVENTOR(S) : KEISHI SAITOH, ET AL.

It is certified that error appears in the above-identified patent and that said Letters Patent is hereby corrected as shown below:

COLUMN 102

Line 19, "halogen" should read --halogen atoms--.

Signed and Sealed this

Thirteenth Day of September, 1988

*Attest:*

DONALD J. QUIGG

*Attesting Officer*

*Commissioner of Patents and Trademarks*